US009701124B2

(12) United States Patent
Ono et al.

(10) Patent No.: US 9,701,124 B2
(45) Date of Patent: Jul. 11, 2017

(54) LIQUID EJECTING APPARATUS

(71) Applicant: SEIKO EPSON CORPORATION, Tokyo (JP)

(72) Inventors: Hirokazu Ono, Suwa (JP); Kazuhiko Sato, Matsumoto (JP); Toru Tanjo, Shiojiri (JP); Yuichi Segawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/006,785

(22) Filed: Jan. 26, 2016

(65) Prior Publication Data

US 2016/0271955 A1 Sep. 22, 2016

(30) Foreign Application Priority Data

Mar. 20, 2015 (JP) ..... 2015-057153

(51) Int. Cl.
*B41J 2/165* (2006.01)
*B41J 29/02* (2006.01)

(52) U.S. Cl.
CPC ..... *B41J 2/16535* (2013.01); *B41J 2/16585* (2013.01); *B41J 29/02* (2013.01)

(58) Field of Classification Search
CPC ..... B41J 2/2146; B41J 2/245; B41J 2/16535; B41J 2/16585; B41J 2/165
See application file for complete search history.

(56) References Cited

U.S. PATENT DOCUMENTS 5,963,229 A * 10/1999 Fukuoka ..... B41J 2/16544 347/31
6,088,049 A * 7/2000 Austin ..... B41J 2/32 347/222
6,402,290 B1 * 6/2002 Johnson ..... B41J 2/16508 347/29
2003/0085948 A1 5/2003 Sekiya
2004/0189741 A1 9/2004 Kimura et al.
2005/0030324 A1 * 2/2005 Monclus ..... B41J 2/16547 347/1
2005/0146554 A1 * 7/2005 Asanuma ..... B41J 2/16535 347/33
2008/0286021 A1 * 11/2008 Asami ..... B41J 2/16538 399/351
2013/0100189 A1 * 4/2013 Azuma ..... B41J 2/16579 347/14

FOREIGN PATENT DOCUMENTS

EP 1792732 6/2007
JP 2003-182113 7/2003
JP 2004-291619 10/2004
JP 2007-144826 6/2007

* cited by examiner

*Primary Examiner* — Jason Uhlenhake
(74) *Attorney, Agent, or Firm* — Workman Nydegger

(57) ABSTRACT

A liquid ejecting apparatus includes a line head which ejects liquid from a plurality of nozzles with respect to a medium, a wiping member that is able to wipe a nozzle forming surface on which the nozzles are formed, and an electronic mounting member that governs an electronic control, in which the wiping member is attachable and detachable with respect to the liquid ejecting apparatus, and the electronic mounting member is disposed at a location which is different from below an attachment/detachment path when the wiping member is attached and detached.

9 Claims, 44 Drawing Sheets

88
96, 97
93
92
101
82
102
85
XXXIIB
89
90
87
86
95
91
F1
104
89, 90
XXXIID
103

LIQUID EJECTING APPARATUS

BACKGROUND

1. Technical Field

The present invention relates to a liquid ejecting apparatus which is provided with a wiping member that wipes a nozzle forming surface of a line head.

2. Related Art

As this type, Japanese Patent No. 4863702 and JP-A-2004-291619 are given as related art documents according to a liquid ejecting apparatus such as an ink jet printer which is provided with a wiping member (also referred to as a wiper). The documents describe exchangeably providing a wiping unit. A wiping operation of the wiping unit is executed in which a signal from a control section is sent to a driving section of the wiping unit. The control section is configured by an electronic mounting member such as an electronic circuit board, and is disposed within an apparatus main body.

When the wiping unit is exchanged, there are cases where liquid drips from the wiping unit. When the liquid drips on the electronic mounting member which configures the control section, the electronic mounting member receives damage.

Each of Japanese Patent No. 4863702 and JP-A-2004-291619 neither describe nor suggest there being a problem in which the electronic mounting member receives damage due to liquid from the wiping unit dripping on the electronic mounting member when the wiping unit is exchanged.

SUMMARY

An advantage of some aspects of the invention is that when a wiping member is removed from an installation location, a risk of liquid dripping on an electronic mounting member such as an electronic circuit board is reduced.

According to a first aspect of the invention, there is provided a liquid ejecting apparatus including a line head which ejects liquid from a plurality of nozzles with respect to a medium, a wiping member that is able to wipe a nozzle forming surface on which the nozzles are formed, and an electronic mounting member that governs an electronic control, in which the wiping member is attachable and detachable with respect to the liquid ejecting apparatus, and the electronic mounting member is disposed at a location which is different from below an attachment/detachment path when the wiping member is attached and detached.

Here, in "the wiping member is attachable and detachable with respect to the liquid ejecting apparatus", in the specification of the present application, "attachable and detachable" is used in a meaning including both a portion of the wiping member, which wipes by coming into contact with the nozzle forming surface, being attached and detached in order to exchange or repair, and a portion or the entirety of the wiping unit, which includes a holding member which holds the wiping member, a machine section, or the like related to a wiping operation, being attached and detached in order to exchange or repair.

In addition, the "attachment/detachment path" has the meaning of a region through which the wiping member may pass through by means of the wiping operation when the wiping member is attached and detached with respect to the liquid ejecting apparatus, in simple words, an operation region when the wiping member is attached and detached.

According to the aspect, since the electronic mounting member is disposed at a location which is different from below the attachment/detachment path when the wiping member is attached and detached, when the wiping member is removed from an installation location in order to exchange or repair, it is possible to reduce the risk of liquid dripping on the electronic mounting member such as an electronic circuit board.

In the liquid ejecting apparatus of a second aspect of the invention, according to the first aspect, the wiping member may be movable in a direction that intersects with a direction in which the medium is transported, and may be removable from at least one movable direction.

In the case of the line head, there are many cases in which the line head does not move, and the wiping member wipes by being moved along the nozzle forming surface of the line head.

According to the aspect, since such a movable wiping member is removable from at least the one movable direction, it is possible to easily remove the wiping member to exchange, repair, or the like.

In the liquid ejecting apparatus of a third aspect of the invention, according to the first aspect or the second aspect, the wiping member may be movable to an attaching and detaching position when removed from the liquid ejecting apparatus.

According to the aspect, it is possible to easily remove the wiping member to exchange, repair, or the like.

In the liquid ejecting apparatus of a fourth aspect of the invention, according to the second aspect or the third aspect, an engagement member which engages in a movement end to which the wiping member is moved may be further included and the wiping member may be movable to the attaching and detaching position from an engaging position with the engagement member when removed from the liquid ejecting apparatus.

According to the aspect, when the wiping member is removed from the liquid ejecting apparatus, since the wiping member is movable to the attaching and detaching position from the engaging position in the movement end, it is possible to easily remove the wiping member to exchange, repair, or the like.

In the liquid ejecting apparatus of a fifth aspect of the invention, according to the fourth aspect, a liquid reservoir section which retains liquid accumulated by wiping using the wiping member may be further included, the engagement member may include a communication section which communicates with the liquid reservoir section, and a negative pressure may be applied to the communication section.

According to the aspect, liquid is accumulated due to the wiping member being moved to wipe, and the liquid is retained in the liquid reservoir section of the wiping member. When the wiping member moves to the engaging position and engages with the engagement member, due to the engagement, the communication section of the engagement member comes to be in a linking state by being inserted into a receiving hole of the liquid reservoir section. In the linking state, the liquid which is accumulated in the liquid reservoir section is discharged by a negative pressure from a suction section acting on the communication section.

Furthermore, when the wiping member is removed from the liquid ejecting apparatus, since the wiping member is movable to the attaching and detaching position by releasing the linking state with the communication section at the engaging position on the movement end, it is possible to easily remove the wiping member to exchange, repair, or the like.

In the liquid ejecting apparatus of a sixth aspect of the invention, according to any one of the first aspect to the fifth aspect, a cover which is openable and closeable and forms a casing of an apparatus main body on a side on which the wiping member is attached and detached with respect to the liquid ejecting apparatus, may be further included, the electronic mounting member may be attached to an inner surface of the cover, and the electronic mounting member may retreat from the attachment/detachment path due to the cover being open.

According to the aspect, the electronic mounting member such as an electronic circuit board is attached to the inner surface of the openable and closeable cover of the casing, and retreats from the attachment/detachment path of the wiping member due to the cover being open. Thereby, it is possible to retreat the electronic mounting member which is positioned in the attachment/detachment path other than when maintenance is carried out on the wiping member from the attachment/detachment path by opening only the cover when maintenance is carried out on the wiping member. Accordingly, it is possible to come to be in a state in which a risk that the liquid drips on the electronic mounting member is reduced by opening only the cover when the wiping member is removed from the installation location.

In the liquid ejecting apparatus of a seventh aspect of the invention, according to any one of the first aspect to the sixth aspect, a cleaning section which cleans the wiping member may be further included, and the cleaning section may be attachable and detachable in the same direction as the wiping member.

According to the aspect, when the cleaning section which cleans the wiping member is removed in order to repair, exchange, or the like, in the same manner, it is possible to reduce the risk of liquid dripping on the electronic mounting member such as an electronic circuit board.

BRIEF DESCRIPTION OF THE DRAWINGS

The invention will be described with reference to the accompanying drawings, wherein like numbers reference like elements.

DESCRIPTION OF EXEMPLARY EMBODIMENTS

Respective embodiments of the liquid ejecting apparatus according to the invention will be described below based on the drawings. In an X-Y-Z coordinate system illustrated in each drawing, an X direction represents an apparatus width direction (entire width direction of a medium), a Y direction represents a transport direction of the medium, and a Z direction represents an apparatus height direction. Here, front side, rear side, left side, and right side directions of the apparatus are shown in some of the drawings in order to make the description easy to understand.

Figure 1B:
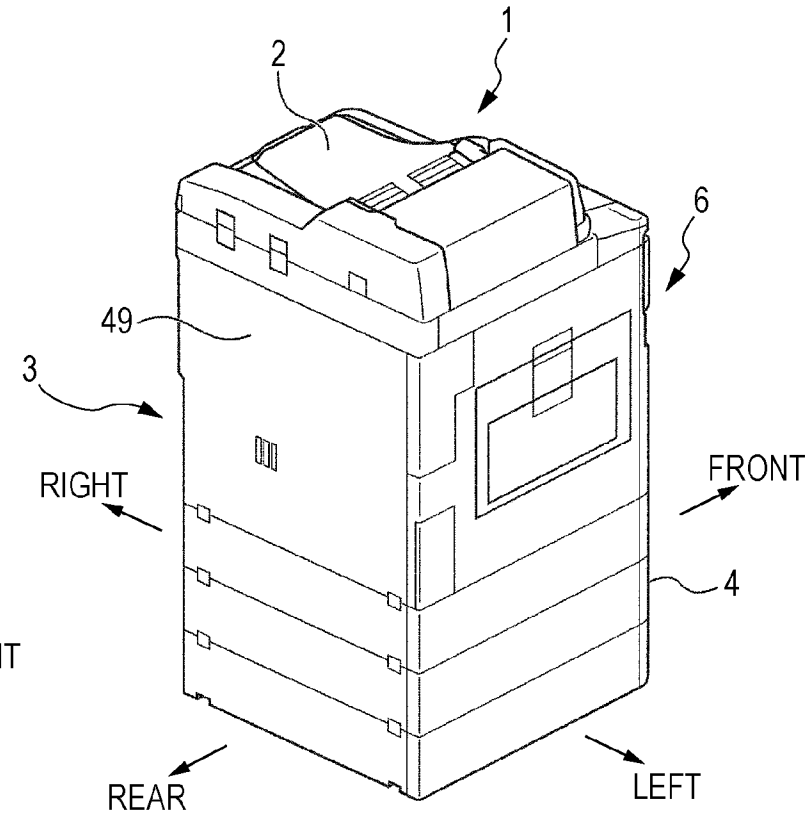
FIG. 1B is a perspective view of the entire outer appearance of an example of the liquid ejecting apparatus according to the invention from the rear.
Figure 1A:
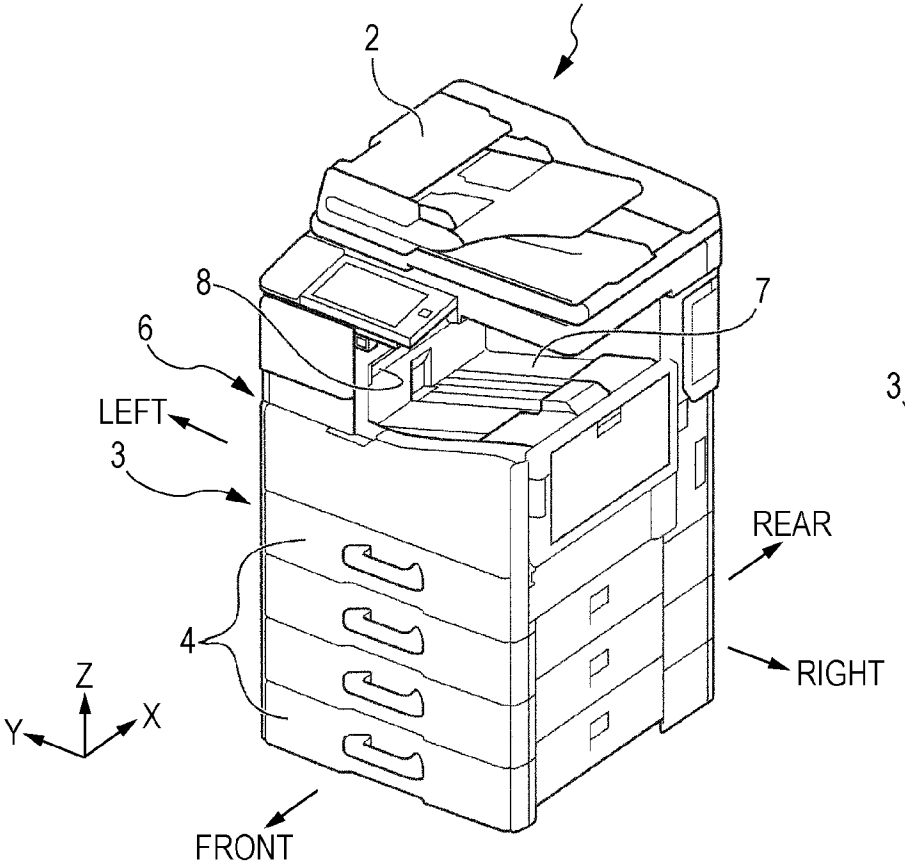
FIG. 1A is a perspective view of the entire outer appearance of an example of a liquid ejecting apparatus according to the invention from a front direction.

FIGS. 1A and 1B are perspective views of the entire outer appearance of an example of a liquid ejecting apparatus according to the invention.

The liquid ejecting apparatus is an ink jet printer 1 which is one recording apparatus (hereinafter simply referred to as a printer 1). The printer 1 is configured as a multifunction printer in which a scanner unit 2 is provided on an upper section. Here, in the invention, the scanner unit 2 need not be provided.

In the printer 1, a plurality of medium accommodating cassettes 4 in which a paper sheet M (in FIG. 5 and after also referred to as a "medium M") such as regular paper or photographic paper as example of the "medium" are disposed on a lower section of an apparatus main body 3, and a recording execution section 6, inside which a line head 14 (FIG. 2) is provided, is provided on an upper side of the medium accommodating cassette 4. Each medium accommodating cassette 4 is attachable and detachable from the front surface side of the apparatus main body 3.

A discharge tray 7 which discharges the paper sheet M that executes recording using the line head 14 is provided on one section of a top surface section of the recording execution section 6 between the recording execution section 6 and the scanner unit 2. In FIGS. 1A and 1B, a reference numeral 8 indicates an outlet which discharges the paper sheet M toward the discharge tray 7. In addition, the discharge tray 7 is configured to be openable and closeable, and the internal line head 14 is removed by being lifted upward. An extraction structure of the line head 14 will be described later.

(A) Process of a Problem of Receiving a Flexible Tube by Raising and Lowering the Line Head An embodiment of a process with respect to a problem of receiving a flexible tube 9 by raising and lowering the line head 14 will be described below.

The embodiment will be described using mainly FIGS. 2 to 13, and 19.

(A-1) Embodiment 1

(A-1-1) Configuration

Figure 2:
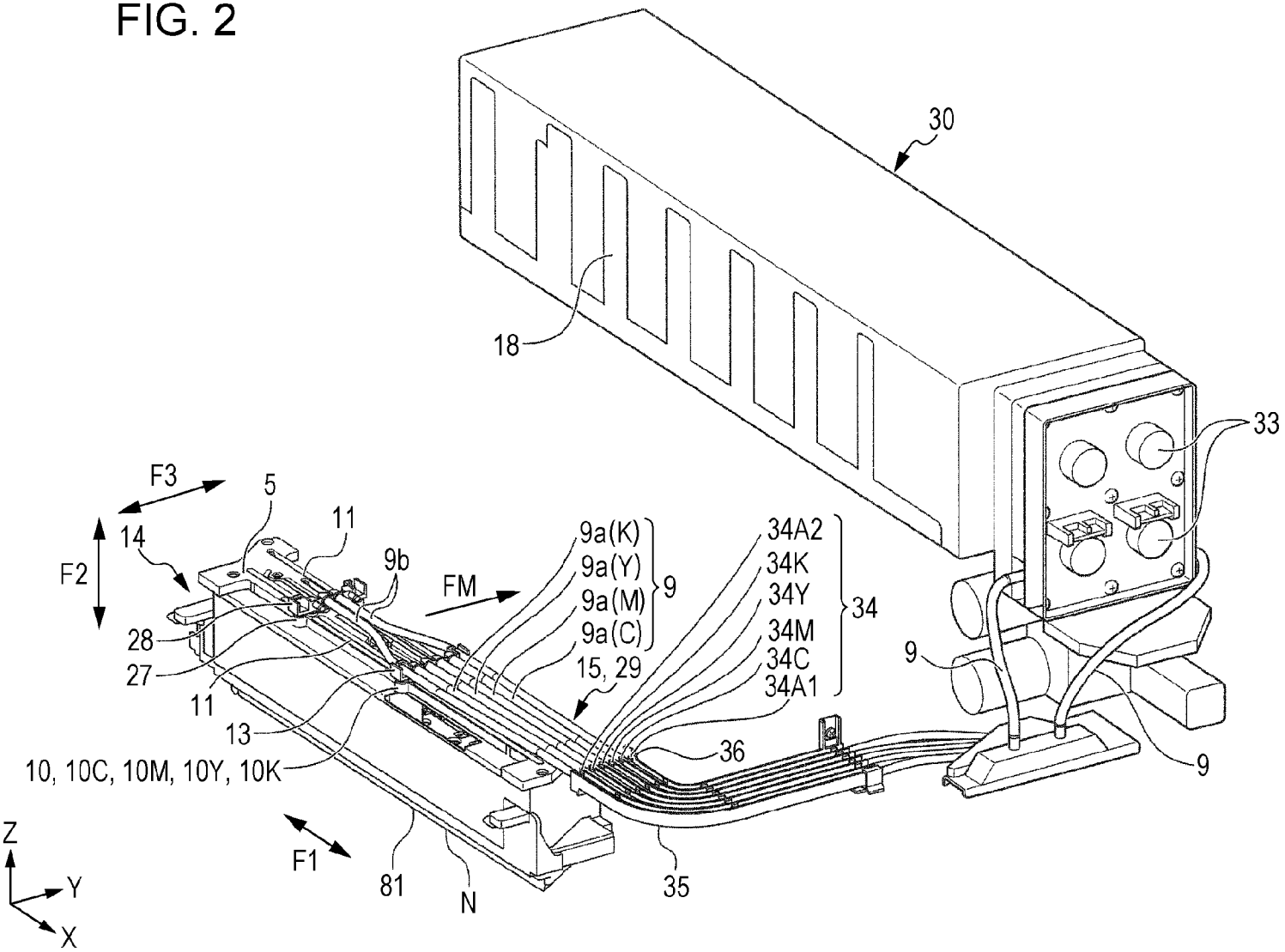
FIG. 2 is a perspective view of the main section which represents a portion of a line head, a flexible tube, and a liquid accommodating body according to an embodiment of the liquid ejecting apparatus.
Figure 3:
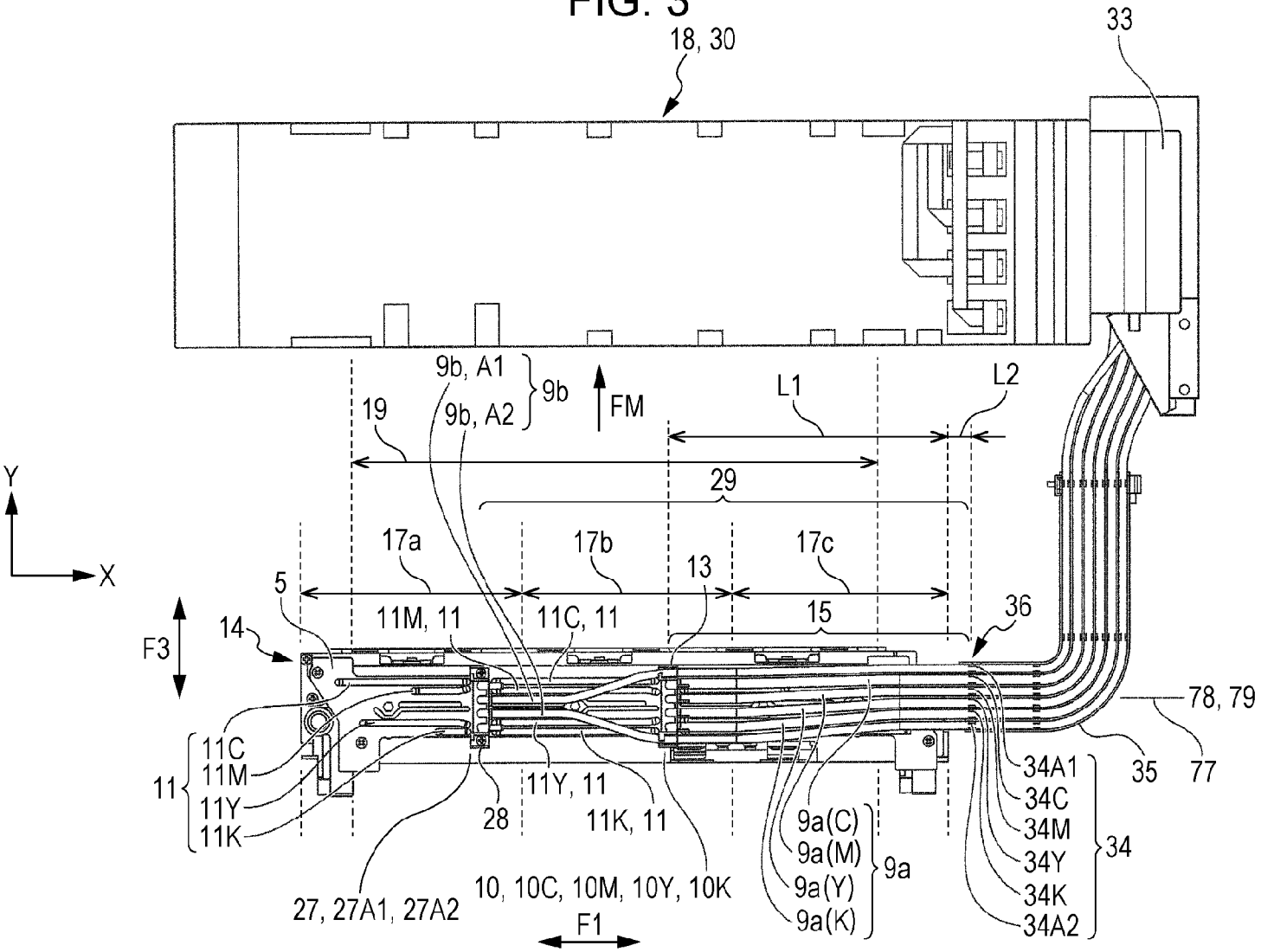
FIG. 3 is a planar view of the main section of the liquid ejecting apparatus.
Figure 4:
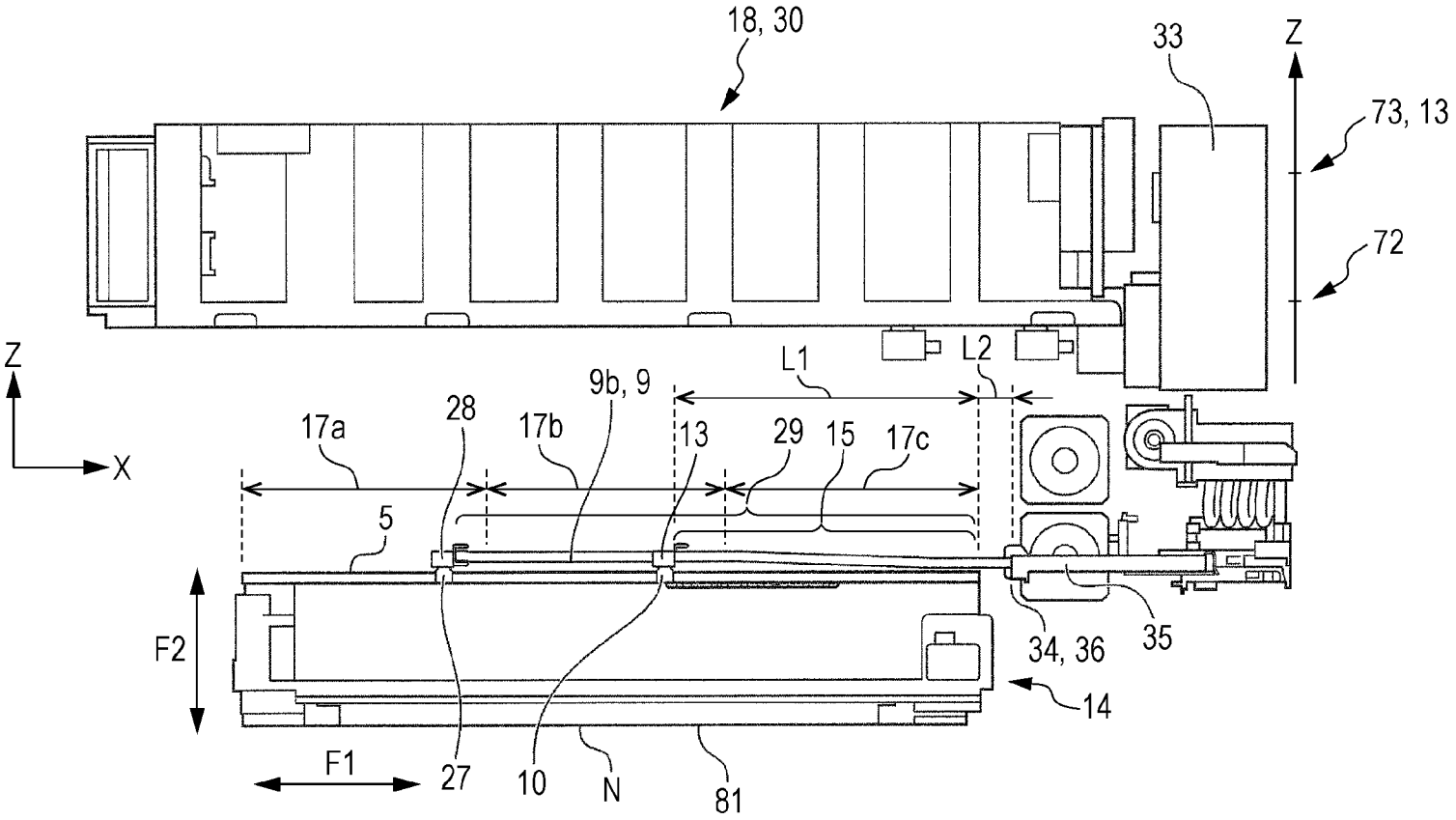
FIG. 4 is a front surface view of the main section of the liquid ejecting apparatus.

As represented in FIGS. 2 to 4, in the embodiment, the flexible tube 9 is provided with four first flexible tubes 9*a* which supply ink which is a liquid to the line head 14, and two second flexible tubes 9*b* which supply air which is a gas to the line head 14. Here, the plurality of tubes is not limited thereto.

A base end side of the first flexible tube 9*a* is connected to a liquid accommodating body 18 side which is a liquid supply source. In FIGS. 2 to 4, a reference numeral 30 is a liquid accommodating body holder, and the liquid accommodating body 18 is mounted to the liquid accommodating body holder 30. The liquid accommodating body 18 is an ink cartridge, an ink pack, or the like. The base end side of the second flexible tube 9*b* is connected to a pump 16 (FIG. 5) which is an air supply source.

As represented in FIGS. 2 to 4, the printer 1 is provided with an elongated line head 14 along a first direction F1 (the same as the X direction), and the first flexible tube 9*a* which supplies ink to the line head 14.

The line head 14 is provided with a plurality of nozzles N (also refer to FIG. 8) which are positioned along the first direction F1, a first joint 10 which is connected to the first flexible tube 9*a*, and a plurality of flow paths 11 which form flow paths between the first joint 10 and the plurality of nozzles N. Furthermore, the line head 14 is raised and lowered by a raising/lowering mechanism which is not shown in the drawings in a second direction F2 (the same as the Z direction) which is orthogonal to the first direction F1.

The first flexible tube 9*a* is provided with a first connecting portion 13 which is connected to the first joint 10. Furthermore, in a state in which the first connecting portion 13 is connected to the first joint 10, the first flexible tube 9*a* extends along the first direction F1 from the first connecting portion 13 to one side (+X side) in the first direction F1, does not extend to the other side (−X side), and is provided with a first extending portion 15 which is movable accompanying the raising and lowering of the line head 14.

The "plurality of flow paths" will be described in detail in a portion of the description of the line head structure based on FIGS. 5 to 13 which will be described later.

The first joint 10 is disposed on a center portion 17*b* where the line head is divided into three equal parts of each of regions 17*a*, 17*b*, and 17*c* in the first direction F1.

Here, in the first joint 10 is disposed on a center portion 17*b* in a case in which the line head 14 is divided into three equal parts in the first direction F1", "a center portion 17*b* in a case of dividing into three equal parts", the first joint 10 is provided in the center portion of the elongated line head 14 and not in a portion of an end in the longitudinal direction (first direction F1) thereof, but specifies a range in the longitudinal direction of the center portion. The range of the "center portion 17*b*" is determined by a relationship to a problem in which the "variance in supply pressure" is reduced based on the "variance in the flow path length". Accordingly, "three equal parts" is not necessarily three exactly equal parts.

Simply put, in the structure of the line head 14 in which the nozzles N are provided across the entire longitudinal direction of the line head 14, from end to end in the longitudinal direction of the line head 14 may be the entirety of the center portion of the region which is divided into three equal parts (FIG. 3).

Alternatively, in a plurality of flow paths 11 which are provided between the first joint 10 and the plurality of nozzles N (in a flow path PI1 (FIG. 9) which is provided in a flow path structure G1 which will be described later), from end to end in a formation range in the first direction F1 may be the entirety of the center portion of the region which is divided into three equal parts.

In the embodiment, on the line head 14, a region in which the nozzles N are formed in the first direction F1 that is a direction which intersects with a movement direction FM that is a transport direction of the medium M onto which the liquid such as ink is ejected, is provided so as to be able to cover the entirety of a medium transport region 19 (FIG. 3) in the first direction F1 of the medium M. Here, the region on the nozzles N in the first direction F1 of the line head 14 not need be able to cover the entirety of the first direction F1 of the medium M which corresponds to the entirety pf the liquid ejecting apparatus.

In the embodiment, on the line head 14, the first joint 10 is positioned on an upper surface 5 in the raising and lowering direction (second direction F2).

Furthermore, the first flexible tube 9*a* overlaps with each of the positions in the second direction F2 (Z direction), that is, includes four tubes of a first tube 9*a* (C), a second tube 9*a* (M), a third tube 9*a* (Y), and a fourth tube 9*a* (K) which are disposed so as to be positioned substantially on a horizontal plane. The color of ink of the first tube 9*a* (C) is cyan, the color of ink of the second tube 9*a* (M) is magenta, the color of ink of the third tube 9*a* (Y) is yellow, and the color of ink of the fourth tube 9*a* (K) is black.

Then, the first joint 10 includes a first joint 10C which is connected to the first tube 9*a* (C), a second joint 10M which is connected to the second tube 9*a* (M), a third joint 10Y which is connected to the third tube 9*a* (Y), and a fourth joint 10K which is connected to the fourth tube 9*a* (K) (also refer to FIG. 26 which will be described later).

Here, the number of tubes is not limited to four. The number of tubes is determined according to the type of printer.

In addition, each tube is not limited to a tube which supplies ink of different colors described above (CMYK), and for example, may be tubes which supply the same type (color) of ink, or alternatively tubes which supply ink, a tube which recovers ink, or the like. Furthermore, in a case where the liquid ejecting apparatus is an apparatus other than a printer, of course there are cases where the liquid which passes through the tubes is not ink, and is liquid for another apparatus.

As represented in FIG. 3, in the embodiment, the plurality of flow paths 11 includes a first flow path 11C which has a plurality of branch points along the first direction F1 communicating the first joint 10C, a second flow path 11M which has a plurality of branch points along the first direction F1 communicating with the second joint 10M, a third flow path 11Y which has a plurality of branch points along the first direction F1 communicating with the third joint 10Y, and a fourth flow path 11K which has a plurality of branch points along the first direction F1 communicating with the fourth joint 10K.

Then, the first tube 9*a* (C), the second tube 9*a* (M), the third tube 9*a* (Y), and the fourth tube 9*a* (K) are disposed in the same order as the first flow path 11C, the second flow path 11M, the third flow path 11Y, and the fourth flow path 11K along a third direction F3 which is orthogonal to each of the first direction F1 and the second direction F2.

Here, the "plurality of branch points" are points at which the flow path is branched in one flow path in order to provide a plurality of outflow ports with respect to one supply port. That is, the branch points are provided to correspond to the number of outflow ports. The "plurality of branch points" will be described in further detail in a portion of the description of the line head structure based on FIGS. 5 to 13 which will be described later.

Figure 26:
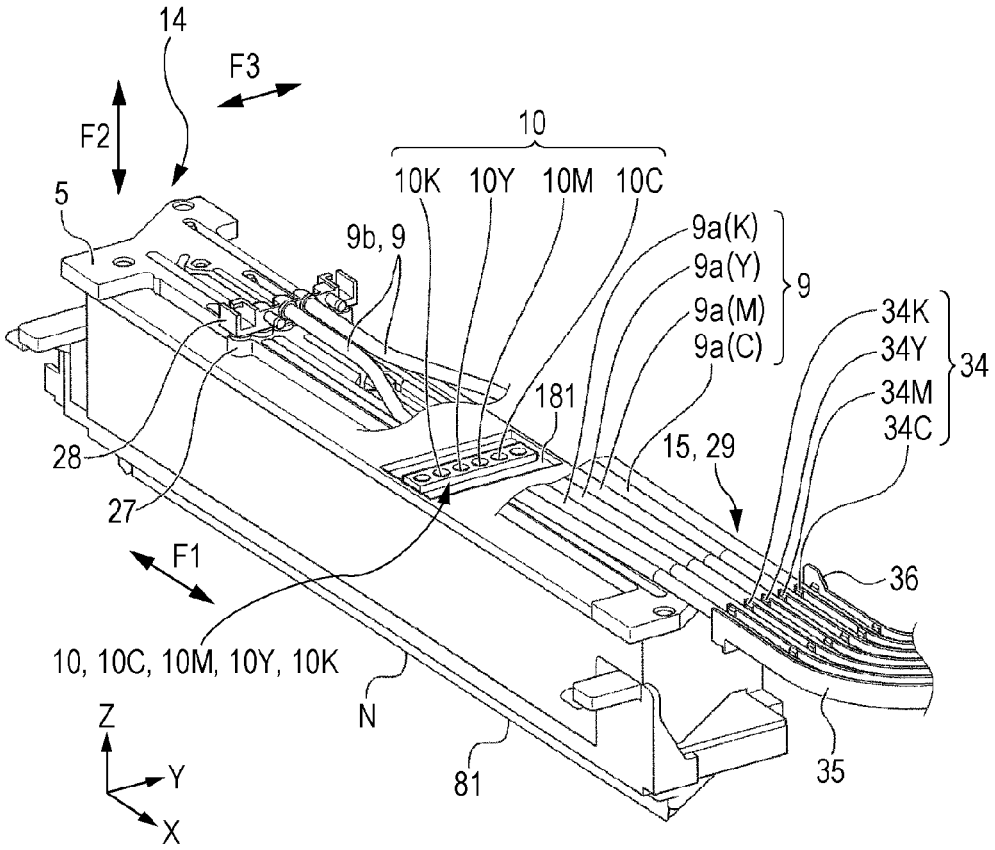
FIG. 26 is a partially cut away perspective view which represents a portion of the line head and the flexible tube according to the embodiment of the liquid ejecting apparatus which is represented in FIGS. 1A and 1B.

Furthermore, as represented in FIGS. 2, 3 and FIG. 26 which will be described later, in the embodiment, in the first joint 10, each joint of the first joint 10C, the second joint 10M, the third joint 10Y, and the fourth joint 10K is disposed along the third direction F3 (Y direction). In other words, the direction in which each of the plurality of joints 10C, 10M, 10Y, and 10K of the first joint 10 are lined up is parallel to the third direction F3 (Y direction).

Furthermore, as represented in FIGS. 2, 3 and FIG. 26 which will be described later, in the embodiment, the first extending portion 15 of the first flexible tube 9*a* has a support point section 34 when raised and lowered along with the line head 14 at a position which is separated from the line head 14 in the first direction F1. The support point section 34 includes each of support points 34C, 34M, 34Y, and 34K which correspond respectively to the tubes of the first tube 9*a* (C), the second tube 9*a* (M), the third tube 9*a* (Y), and the fourth tube 9*a* (K). Then, each support point 34C, 34M, 34Y, and 34K is disposed along the third direction F3 in the same manner as each of the plurality of joints 10C, 10M, 10Y, and 10K of the first joint 10.

Here, although the support point section 34 is configured by an end section 36 of a support section 35 which supports the second flexible tube 9*a* which is drawn around inside the apparatus main body 3 from the lower side, the support point section 34 is not limited to being configured by the end section 36.

In addition, as represented in FIGS. 2 to 4, the printer 1 of the embodiment is provided with the second flexible tube 9*b* which supplies air which is a gas to the line head 14, and the line head 14 is provided with a second joint 27 which is connected to the second flexible tube 9*b*.

The second flexible tube 9*b* is provided with a second connecting portion 28 which is connected to the second joint 27. Furthermore, in a state in which the second connecting portion 28 is connected to the second joint 27, the second flexible tube 9*b* extends along the first direction F1 from the second connecting portion 28 to one side (+X side) in the first direction F1, and does not extend to the other side (−X side), and is provided with a second extending portion 29 which is movable accompanying the raising and lowering of the line head 14.

The second joint 27 is disposed more on the other side (−X side) in the first direction F1 than the first joint 10.

Here, the flow paths and roles inside the line head 14 of air which is sent by the second flexible tube 9*b* will be described in detail with reference to a portion of the description of the line head structure based on FIGS. 5 to 13 which will be described later.

In the embodiment, on the line head 14, the second joint 27 is positioned on the upper surface 5 in the raising and lowering direction (second direction F2).

Then, four first flexible tubes 9*a* and two second flexible tubes 9*b* are disposed such that the positions overlap with each other in the second direction F2 (Z direction), that is, disposed so as to be positioned substantially on a horizontal plane.

Furthermore, in the embodiment, in the second joint 27, each joint of a first joint 27A1 and a second joint 27A2 is disposed along the third direction F3 (Y direction). In other words, the direction in which each of the plurality of joints 27A1 and 27A2 of the second joint 27 are lined up is parallel to the third direction F3 (Y direction).

Furthermore, in the embodiment, the second extending portion 29 of the second flexible tube 9*b* has the support point section 34 when raised and lowered along with the line head 14 at a position which is separated from the line head 14 in the first direction F1. Since the support point section 34 is the support point section 34 common to the first extending portion 15, the support point section 34 includes each support point 34A1 and 34A2 with respect to each tube of the first tube 9*b*(A1) and the second tube 9*b*(A2). Then, each support point 34A1 and 34A2 is disposed along the third direction F3 in the same manner as each of the plurality of joints 27A1 and 27A2 of the second joint 27.

(A-1-2) Effects (1) According to the embodiment, the first flexible tube 9*a* extends along the first direction F1 from the first connecting portion 13 which is connected to the first joint 10 of the line head 14 to one side (+X side) in the first direction F1 which is the longitudinal direction of the line head 14, does not extend to the other side (−X side), and is provided with the first extending portion 15 which is movable accompanying raising and lowering of the line head 14. Since such a first extending portion 15 extends along the line head 14 from the one end section side to the center portion 17*b* in the longitudinal direction of the elongated line head 14, it is possible for the first extending portion 15 to flexibly correspond to the raising and lowering operation of the line head 14.

Thereby, stress which is applied to the first flexible tube 9*a* which is connected to the line head 14 accompanying the raising and lowering of the line head 14 is able to be reduced by absorbing using the first extending portion 15.

In addition, since the first joint 10 is disposed in the center portion 17*b* in a case where the line head 14 is divided into three equal parts in the first direction F1 which is the longitudinal direction of the line head 14, variance of a flow path length from the first joint 10 which are a supply port for liquid to the nozzles N is able to be made small in comparison to a structure in which the first joint is disposed on an end section in the longitudinal direction, and similarly variance of liquid supply pressure for each nozzle N of the line head 14 is able to be reduced.

(2) According to the embodiment, the first flexible tube 9*a* is disposed such that the positions of the first tube 9*a* (C), the second tube 9*a* (M), the third tube 9*a* (Y), and the fourth tube 9*a* (K) overlap with each other in the second direction F2 (Z direction). Accordingly, it is possible to minimize in the second direction F2 (height direction of the apparatus) with respect to other dispositions such as being stacked in the second direction F2.

(3) According to the embodiment, the first tube 9*a* (C), the second tube 9*a* (M), the third tube 9*a* (Y), and the fourth tube 9*a* (K) are lined up in the same order as the first flow path 11C, the second flow path 11M, the third flow path 11Y, and the fourth flow path 11K along the third direction F3 (Y direction) which is orthogonal to each of the first direction F1 and the second direction F2. Thereby, it is possible to simplify the linking structure of the plurality of joints (10C, 10M, 10Y, and 10K) and the plurality of flow paths (11C, 11M, 11Y, and 11K), and it is possible to reduce the size of the portion with respect to the structure of being lined up in a different order.

In addition, in a case where the first tube 9*a* (C), the second tube 9*a* (M), the third tube 9*a* (Y), and the fourth tube 9*a* (K) use a transparent member to set the flow paths to be externally visually recognizable, it is possible to make the connection position of the plurality of tubes (9*a* (C), 9*a* (M), 9*a* (Y), and 9*a* (K)) easier to understand, and reduce the number of misconnections.

(4) According to the embodiment, since each of the plurality of joints 10C, 10M, 10Y, and 10K of the first joint 10 are disposed along the third direction F3, it becomes easy to align the flow path lengths of the liquid which is supplied by the first tube 9*a* (C), the second tube 9*a* (M), the third tube 9*a* (Y), and the fourth tube 9*a* (K) in comparison to a structure of being disposed in a direction which intersects with the third direction F3.

(5) In addition, in the embodiment, in the support point section 34, each support point 34C, 34M, 34Y, and 34K is disposed along the third direction F3 with respect to each of the tubes 9*a* (C), 9*a* (M), 9*a* (Y), and 9*a* (K), furthermore, in the first joint 10, each of the plurality of joints 10C, 10M, 10Y, and 10K are disposed along the third direction F3. Thereby, in the first extending portion 15, the lengths of each of the plurality of tubes 9*a* (C), 9*a* (M), 9*a* (Y), and 9*a* (K) which are positioned between the first joint 10 and the support point section 34 are substantially the same. Furthermore, each of the plurality of tubes 9*a* (C), 9*a* (M), 9*a* (Y), and 9*a* (K) are disposed such that the positions overlap with other in the second direction F2.

When the first extending portion 15 swings the support point section 34 about a support point by raising and lowering the line head 14, according to embodiment, as above, the swing postures of each of the plurality of tubes 9*a* (C), 9*a* (M), 9*a* (Y), and 9*a* (K) are substantially the same due to a configuration in which the "lengths of each of the plurality of tubes are substantially the same" and "each of the plurality of tubes are positioned in the second direction so as to overlap with each other". Thereby, stress based on the swinging is able to be received substantially equally in each of the plurality of tubes 9*a* (C), 9*a* (M), 9*a* (Y), and 9*a* (K), and similarly it is possible to reduce the stress based on the swinging by effectively absorbing the stress without biasing.

In other words, in a case where stress according to each of the plurality of tubes 9*a* (C), 9*a* (M), 9*a* (Y), and 9*a* (K) based on the swinging is not uniform, there is a risk of a problem of coming out, deterioration, and the like being concentrated in a tube of a portion in which there is a great amount of stress, but such a risk is slight according to the embodiment.

(6) According to the embodiment, also in the second flexible tube 9*b*, the second extending portion 29 extends along the line head 14 from one end section side to the position of the second joint 27 in the longitudinal direction of the elongated line head 14. Thereby, in the same manner as the first flexible tube 9*a*, it is possible for the second extending portion 29 to flexibly correspond to the raising and lowering operation of the line head 14. Accordingly, stress which is applied to the second flexible tube 9*b* which is connected to the line head 14 accompanying the raising and lowering of the line head 14 is able to be reduced by absorbing using the second extending portion 15.

In addition, since the second joint 27 is disposed more on the other side (−X side) in the first direction F1 than the first joint 10, the structure of the joint is not complicated.

(7) According to the embodiment, the first flexible tube 9*a* and second flexible tube 9*b* are disposed such that the positions overlap with each other in the second direction F2 (Z direction), that is, so as to be disposed substantially on a horizontal plane. Thereby, it is possible to achieve a reduction in size in the second direction F2 in comparison to another structure in which the positions are different in the second direction F2.

Furthermore, each support point 34A1 and 34A2 of the support point section 34 is disposed along the third direction F3 in the same manner as each of the plurality of joints 27A1 and 27A2 of the second joint 27.

Accordingly, when the second extending portion 29 swings the support point section 34 about the support point by raising and lowering the line head 14, the swinging posture is substantially the same in each of the plurality of the first tube 9*b* (A1) and the second tube 9*b* (A2). Thereby, stress based on the swinging is able to be received substantially equally in each of the plurality of tubes 9*b* (A1) and 9*b* (A2), and similarly it is possible to reduce the stress based on the swinging by effectively absorbing the stress without biasing.

(A-1-3) Description of Line Head Structure

The structure of the line head 14 will be described in detail based on FIGS. 5 to 13.

Figure 5:
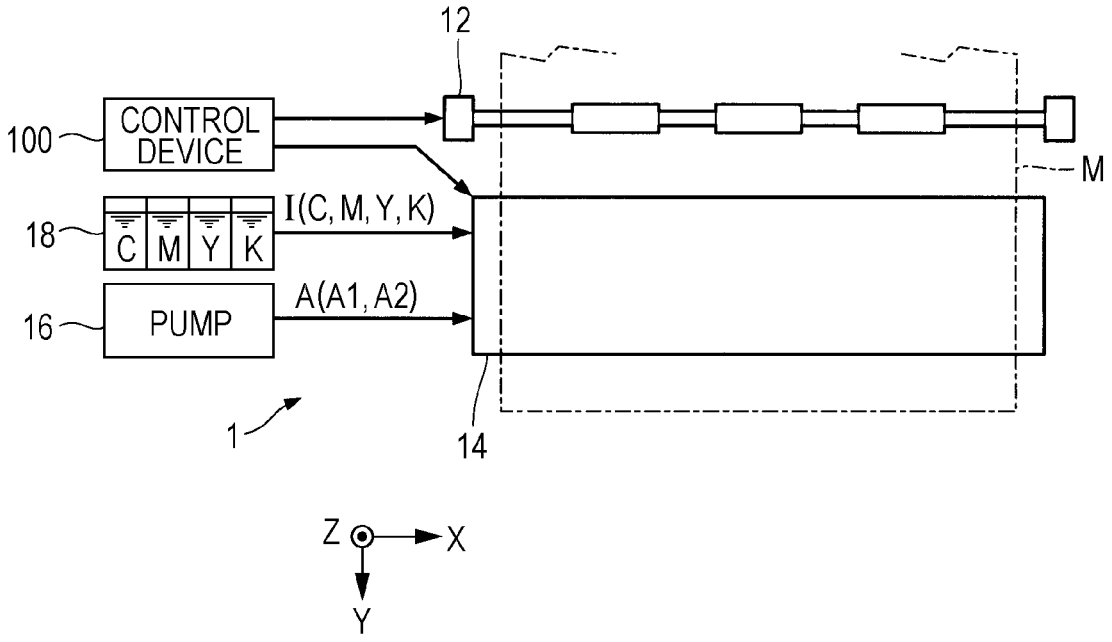
FIG. 5 is an outline configuration diagram of the liquid ejecting apparatus which is represented in FIGS. 1A and 1B.

FIG. 5 is a partial configuration diagram of the printer 1 according to the embodiment of the invention. The printer 1 is a liquid ejecting apparatus which ejects ink which is an exemplification of a liquid on a printing medium (ejection object) M such as printing paper, and is equipped with a control device 100, a transport mechanism 12, the line head (hereinafter in some cases referred to as a "liquid ejecting head") 14, and the pump 16. The liquid accommodating body (hereinafter in some cases referred to as a "liquid container (ink cartridge)") 18 which retains ink I of a plurality of colors is mounted in the printer 1. In the first embodiment, ink I of four colors of cyan (C), magenta (M), yellow (Y), and black (B) is retained in the liquid container 18.

The control device 100 collectively controls each of the components of the printer 1. The transport mechanism 12 transports the printing medium M in the Y direction under control by the control device 100. The pump 16 is an air supply device which supplies two groups of air A (A1 and A2) to the liquid ejecting head 14 via the second flexible tube 9*b* under the control of the control device 100. The air A1 and air A2 is gas which is utilized in the control of a flow path inside the liquid ejecting head 14. The pump 16 of the embodiment is able to pressurize each of the air A1 and the air A2 independently from each other.

The liquid ejecting head 14 ejects the ink I which is supplied from the liquid container 18 onto the printing medium M under the control of the control device 100. The liquid ejecting head 14 of the embodiment is an elongated line head in the X direction that intersects with the Y direction. Here, a direction which is perpendicular to the X-Y horizontal plane (the horizontal plane which is parallel to the surface of the printing medium M) is represented below by the Z direction. The ejection direction of the ink I by the liquid ejecting head 14 is equivalent to the −Z direction.

Figure 6:
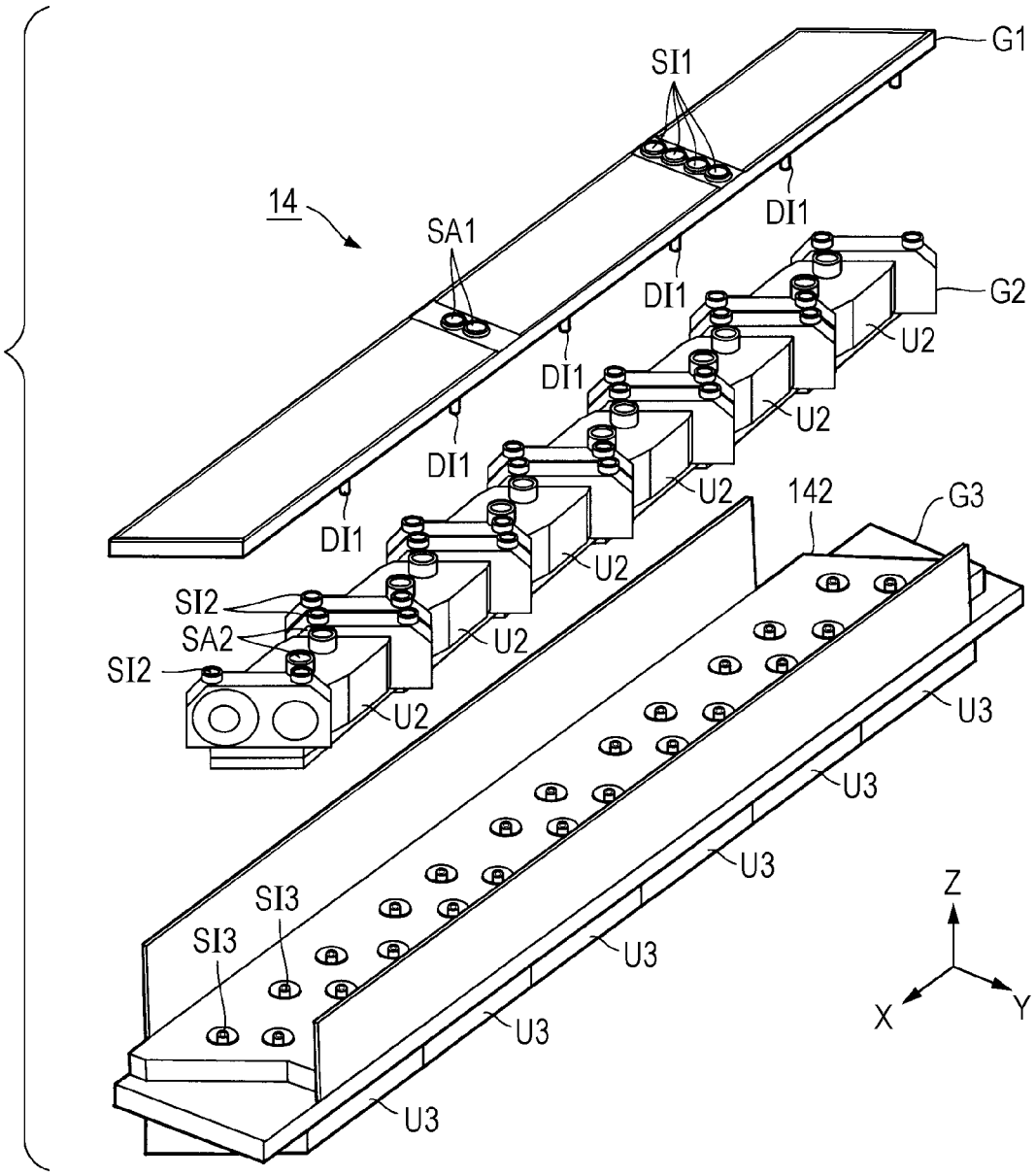
FIG. 6 is an exploded perspective diagram view (from above) of the line head according to the embodiment.
Figure 7:
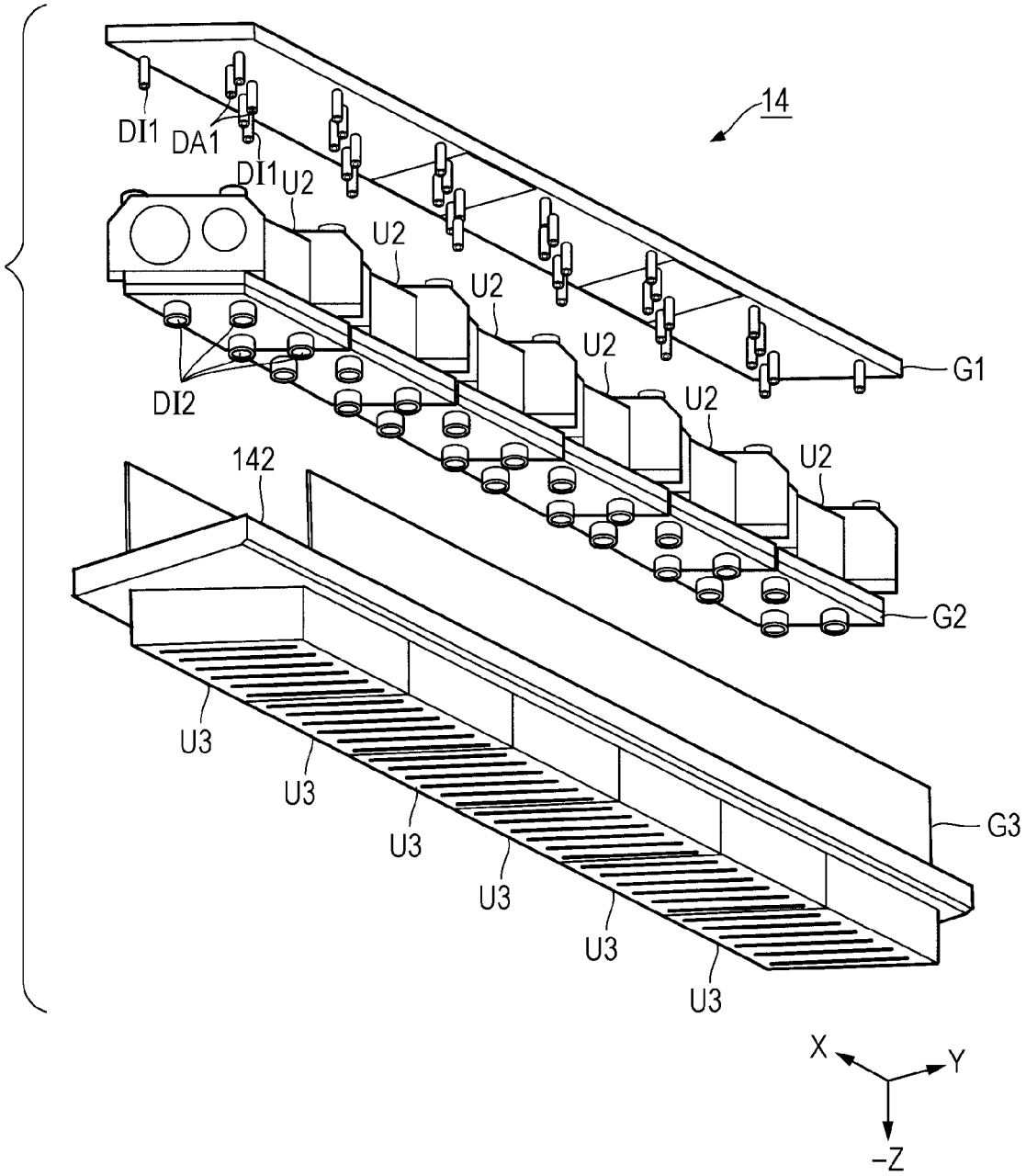
FIG. 7 is an exploded perspective diagram view (from below) of the line head according to the embodiment.

FIGS. 6 and 7 are exploded perspective views of the liquid ejecting head 14. As exemplified in FIGS. 6 and 7, the liquid ejecting head 14 of the embodiment is configured by a flow path structure G1, a flow path control section G2, and a liquid ejecting section G3. In outline, the flow path control section G2 is installed between the flow path structure G1 and the liquid ejecting section G3. That is, the flow path structure G1, the flow path control section G2, and the liquid ejecting section G3 overlap each other viewed from the Z direction. The liquid ejecting section G3 is a structure which accommodates and supports six liquid ejecting units U3 in a casing 142.

Figure 8:
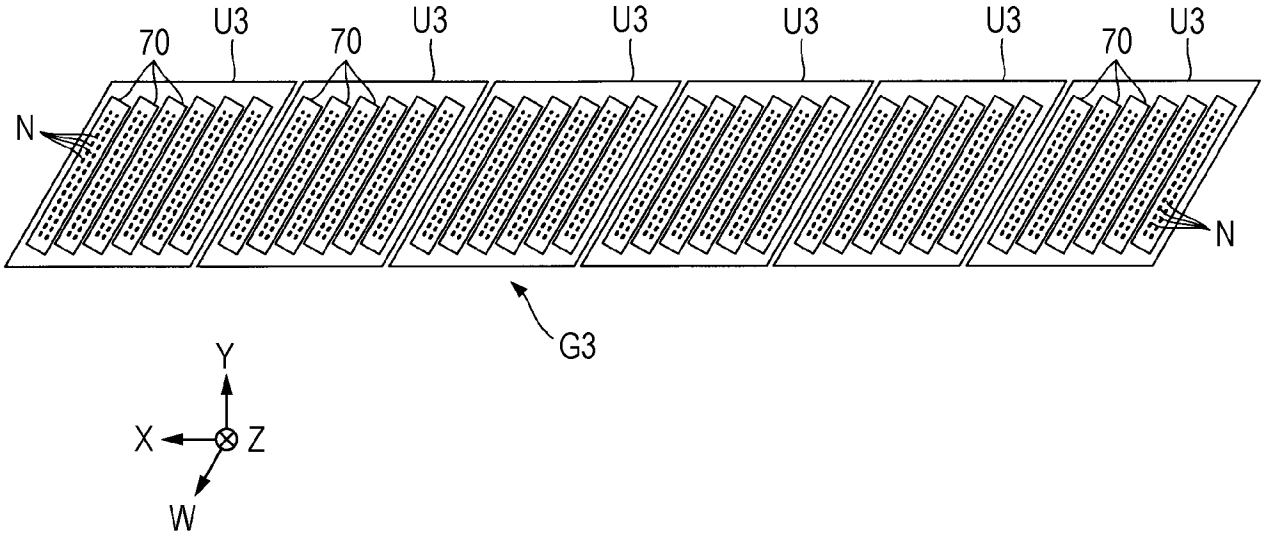
FIG. 8 is a planar view of the line head from a medium side according to the embodiment.

FIG. 8 is a planar view of a surface facing the printing medium M in the liquid ejecting section G3. As exemplified in FIG. 8, six liquid ejecting units U3 are arranged along the X direction. Each liquid ejecting unit U3 is equipped with a plurality (six are exemplified in the embodiment) of ejecting head sections 70 which are arranged along the X direction. Each of the ejecting head sections 70 contains a head tape which ejects the ink I from the plurality of nozzles N. The plurality of nozzles N of one ejecting head section 70 are arranged in two rows along a W direction which is inclined at a predetermined angle with respect to the X direction and the Y direction. In each of the ejecting head sections 70 of the liquid ejecting unit U3, the ink I of four groups (four colors) is supplied in parallel. The plurality of nozzles N of one ejecting head section 70 are split into four sets, and the ink I, which is respectively different in each set, is ejected.

Figure 9:
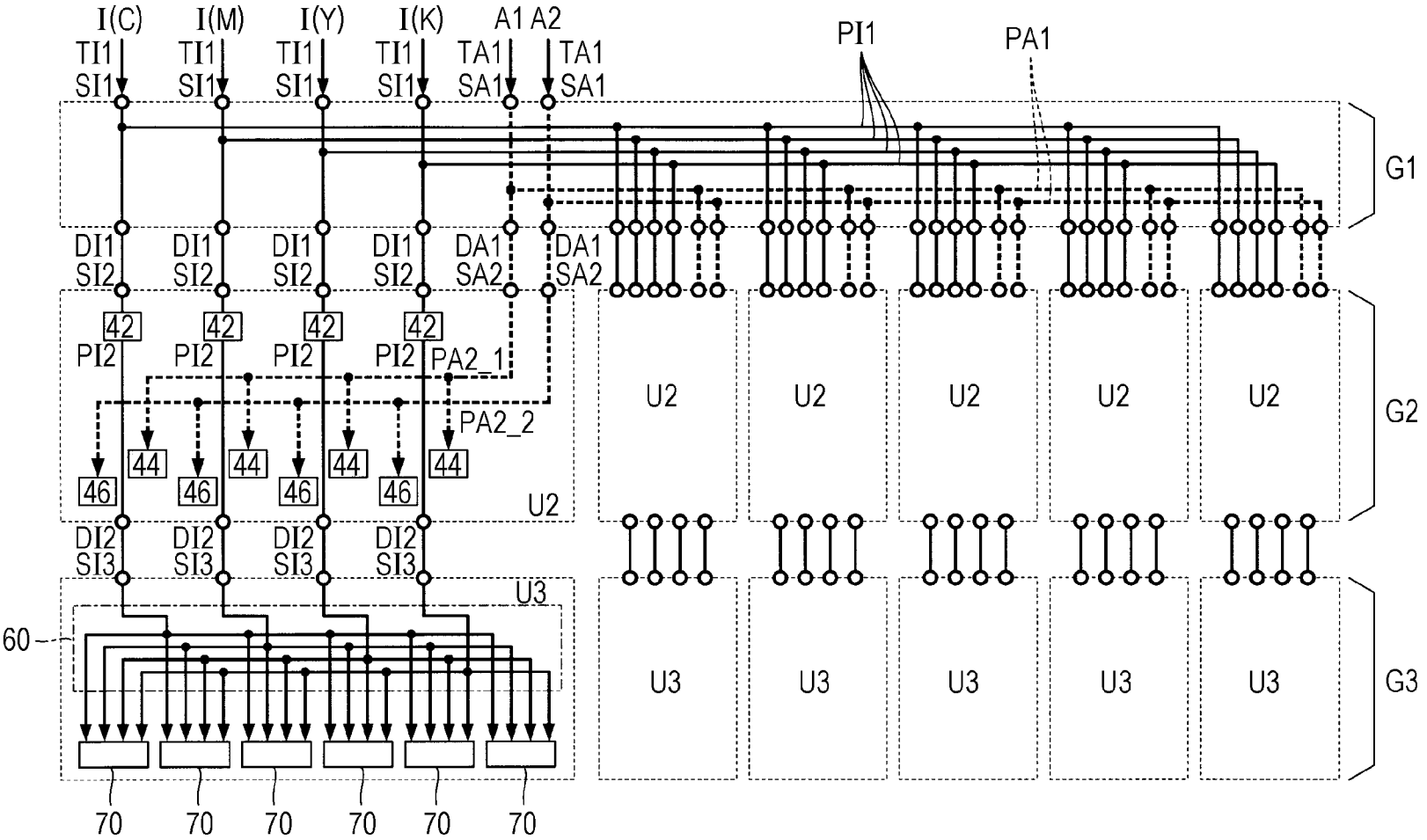
FIG. 9 is an explanatory diagram of a flow path of the line head according to the embodiment.

FIG. 9 is a configuration diagram of the liquid ejecting head 14 which is focused on a fluid body (ink I and air A) flow path. As understood from FIG. 9, in the flow path structure G1, the two groups of air A (A1 and A2) are supplied from the pump 16 while the four groups of the ink I are supplied from the liquid container 18. The flow path structure G1 distributes the respective four groups of the ink I and the respective two groups of the air A in six groups which correspond to respectively different liquid ejecting units U3. That is, the distribution number (6) of the one group of the ink I by the flow path structure G1 is greater than the type number K of the ink I (K=4).

The flow path control section G2 of FIGS. 6 and 7 is a component which controls the flow path of the liquid ejecting head 14 (for example, opening and closing of the flow path and pressure within the flow path), and is configured to include six flow path control units U2 which correspond to the respectively different liquid ejecting units U3. As exemplified in FIG. 9, the four groups of the ink I and the two groups of the air A are supplied in parallel to the six flow path control units U2 by distribution using the flow path structure G1. Each of the flow path control units U2 controls the opening and closing and the pressure of the flow path of the four groups of the ink I which are distributed by the flow path structure G1 to each liquid ejecting unit U3 according to the two groups of the air A.

The four groups of the ink I are supplied in parallel to the six liquid ejecting units U3 via each of the flow path control units U2 after distribution using the flow path unit structure G1. Each of the liquid ejecting units U3 is equipped with a liquid distributing section 60. The liquid distributing section 60 distributes each of the four groups of the ink I which is supplied from the flow path control unit U2 in the previous stage in six groups which correspond to the respective different ejecting head sections 70. That is, the four groups of the ink I are supplied in parallel to the respective six ejecting head sections 70 after distribution by the liquid distributing section 60. Each of the ejecting head sections 70 ejects the four groups of the ink I from the respective different nozzles N.

Specific examples of the respective components (the flow path structure G1, the flow path control section G2, and the liquid ejecting section G3) of the liquid ejecting head 14 which are outlined above will be described below.

Flow Path Structure G1

Figure 10:
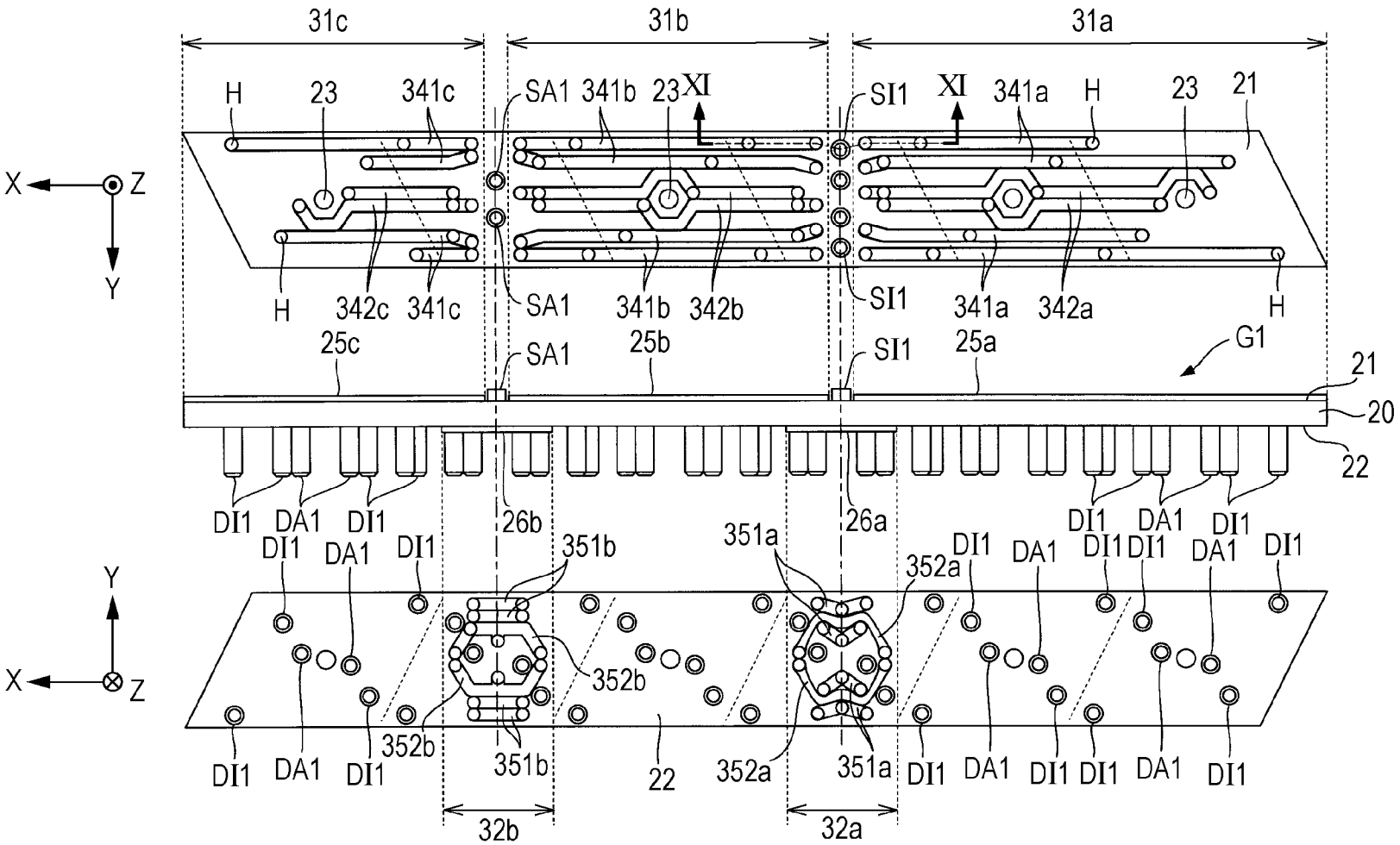
FIG. 10 is a side surface view and planar view of a flow path structure of the line head according to the embodiment.
Figure 11:
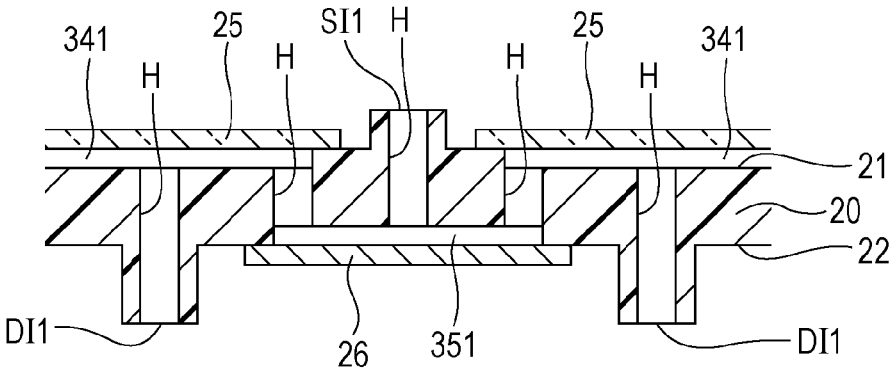
FIG. 11 is a cross sectional diagram along line XI-XI in FIG. 10.

FIG. 10 is a side surface view and planar view of the flow path structure G1, and FIG. 11 is a sectional view along line XI-XI in FIG. 10. As exemplified in the side surface view in FIG. 10, the flow path structure G1 of the embodiment is a structure with a flat plate form which includes a substrate 20, a plurality of sealing sections 25 (25*a*, 25*b*, and 25*c*), and a plurality of sealing sections 26 (26*a* and 26*b*). Here, for convenience, the planar view of FIG. 10 omits illustration of the respective sealing sections 25 and the respective sealing sections 26.

The substrate 20 of the embodiment is an elongated flat plate shape in the X direction, and includes a first surface 21 and a second surface 22 which are parallel to the X-Y horizontal plane. FIG. 10 shows a planar view of the first surface 21 and a planar view of the second surface 22. The first surface 21 is a front surface (upper surface) on an opposite side to the flow path control section G2 and the liquid ejecting section G3, and the second surface 22 is a front surface on the opposite side to the first surface 21 (the surface facing the flow path control section G2). The substrate 20 of the embodiment is formed from a thermoplastic resin material (for example, polypropylene).

As exemplified in FIG. 10, the first surface 21 of substrate 20 includes a region 31*a*, a region 31*b*, and a region 31*c*. Four supply ports SI1 which correspond to the respective groups of the ink I are formed between the region 31*a* and the region 31*b* in the first surface 21, and two supply ports SA1 which correspond to the respective groups of the air A are formed between the region 31*b* and the region 31*c* on the first surface 21.

Figure 12:
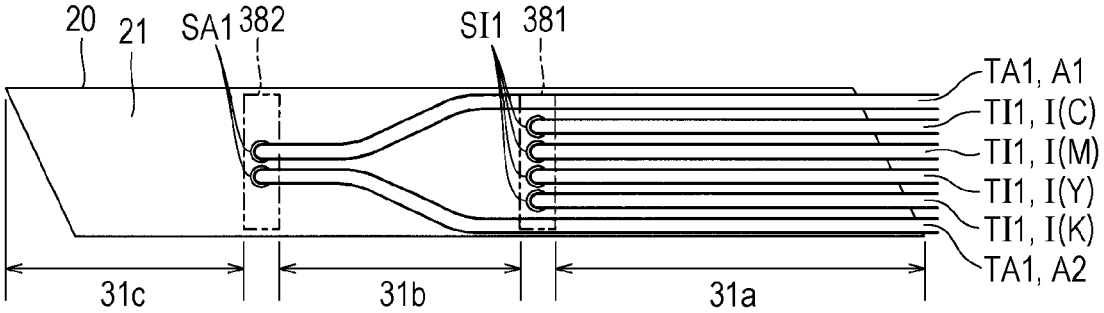
FIG. 12 is an explanatory diagram of a relationship of the flow structure and a supply pipe of ink and air of the line head according to the embodiment.

FIG. 12 is an explanatory diagram of a connection state of the flow path structure G1. As exemplified in FIG. 12, an end section of a supply tube TI1 of the respective inks I which is formed of the first flexible tube 9*a* is connected respectively to the four supply ports SI1 via a connecting section (joint) 381 (portion to which the first joint 10 in FIG. 3 is connected) which is installed on the first surface 21. Each of the supply pipes TI1 extend along the X direction on the upper surface of the region 31*a*, and an end section on the side opposite to the supply port SI1 is connected to the liquid container 18.

Meanwhile, an end section of a supply tube TA1 of the respective air A (A1 and A2) which is formed of the second flexible tube 9*b* is connected respectively to the two supply ports SA1 via a connecting section 382 (portion to which the second joint 27 in FIG. 3 is connected) which is installed on the first surface 21. Each of the supply pipes TA1 extend along the X direction on the upper surface of the region 31*b* and the region 31*a*, and an end section on the side opposite to the supply port SA1 is connected to the pump 16.

In the configuration above, the four groups of the ink I (C, M, Y, and K) which are retained in the liquid container 18 are supplied in parallel to the four supply ports SI1 via the respective supply pipes TI1, and the two groups of the air A (A1 and A2) which are delivered from the pump 16 are supplied in parallel to the two supply ports SA1 via the supply port TA1.

As exemplified in FIG. 10, four groove sections 341*a* which correspond to the respective inks I are formed in the region 31*a* of the first surface 21 on the substrate 20. In the same manner, four groove sections 341*b* are formed in the region 31*b*, and four groove sections 341*c* are formed in the region 31*c*. The groove sections 341*a* and the groove sections 341*b* are positioned on opposite sides to each other to interpose the supply port SI1 in planar view (that is, viewed from the Z direction perpendicular to the substrate 20).

In addition, two groove sections 342*a* which correspond to the respective air A are formed in the region 31*a* of the first surface 21 on the substrate 20. In the same manner, two groove sections 342*b* are formed in the region 31*b*, and two groove sections 342*c* are formed in the region 31*c*. The groove sections 342*b* and the groove sections 342*c* are positioned on opposite sides to each other to interpose the supply port SA1 in planar view.

As exemplified in FIG. 10, in each region 31 (31*a*, 31*b*, and 31*c*) of the first surface 21, the respective groove sections 341 (341*a*, 341*b*, and 341*c*) which correspond to the inks I are formed on both sides which interpose the two groove sections 342 (342*a*, 342*b*, and 342*c*) which correspond to the air A.

In outline, each groove section 341 (341*a*, 341*b*, and 341*c*) and each groove section 342 (342*a*, 342*b*, and 342*c*) are grooves (front side groove sections) which are formed so as to extend in the X direction. In detail, in the embodiment, each of the groove sections 341 which correspond to the inks I extend substantially in a straight line along the X direction, and each of the groove sections 342 which correspond to the air A are formed in a bent shape so as to bypass a mounting hole 23 that is formed on the substrate 20. Each mounting hole 23 is a through hole which is utilized in fixing to the substrate 20, and in detail, is a screw hole into which a screw (not shown in the diagram) is inserted that fixes the flow path structure G1 to the flow path control section G2.

As exemplified in the side surface view of FIG. 10, sealing sections 25 (25*a*, 25*b*, and 25*c*) which are separate to each other are installed in the respective regions 31 (31*a*, 31*b*, and 31*c*) on the first surface 21. In detail, the sealing section 25*a* is installed in the region 31*a*, the sealing section

25*b* is installed in the region 31*b*, and the sealing section 25*c* is installed in the region 31*c*. Each sealing section 25 is a member with a film form (film thickness of approximately 0.1 mm) which is affixed to the first surface 21 of the substrate 20, and configures the flow path by sealing (closing) each groove section 341 and each groove section 342 which are formed on the first surface 21.

Meanwhile, as exemplified in FIG. 10, the second surface 22 of the substrate 20 includes the region 32*a* and the region 32*b*. The region 32*a* is a region which overlaps with a region of a gap between the region 31*a* and the region 31*b* of the first surface 21 (that is, a region in which the four supply ports SI1 are formed) in planar view, and the region 32*b* is a region which overlaps with a region of a gap between the region 31*b* and the region 31*c* of the first surface 21 (that is, a region in which the two supply ports SA1 are formed) in planar view.

The four groove sections 351*a* which correspond to each ink I and the two groove sections 352*a* which correspond to each air A are formed in the region 32*a* of the second surface 22. In the same manner, the four groove sections 351*b* and the two groove sections 352*b* are also formed in the region 32*b*. Each groove section 351 (351*a* and 351*b*) and each groove section 352 (352*a* and 352*b*) is a groove (rear side groove section) which is formed on the second surface 22. The four groove sections 351*b* are positioned outside of the two groove sections 352*b* within the region 32*b*, and the groove section 352*a* are positioned in a gap between the pair of groove sections 351*a* within the region 32*a*.

FIG. 10 illustrates a boundary of each liquid ejecting unit U3 using a broken line. As exemplified in FIG. 10, four outflow ports DI1 which correspond to each ink I and two outflow ports DA1 which correspond to each air A are respectively formed in six liquid ejecting units U3 (respectively in six flow path control units U2) on the second surface 22. Each outflow port DI1 and each outflow port DA1 is an annular portion which protrudes from the second surface 22 in the Z direction.

The six outflow ports DI1 which correspond to one arbitrary group of ink I are arranged along the X direction at substantially equal intervals so as to overlap with each groove section 341 (341*a*, 341*b*, and 341*c*) which correspond to the ink I on the first surface 21 in planar view, and as understood from FIG. 11, each groove section 341 communicates via a through hole H which passes through the substrate 20 in the Z direction. In the same manner, the six outflow ports DA1 which correspond to one arbitrary group of air A are arranged along the X direction at substantially equal intervals so as to overlap with each groove section 342 (342*a*, 342*b*, and 342*c*) which correspond to the air A on the first surface 21 in planar view, and each groove section 342 communicates via the through hole H which passes through the substrate 20.

As exemplified in the side surface view of FIG. 10, sealing sections 26 (26*a* and 26*b*) which are separate from each other are installed in the respective regions 32 (32*a* and 32*b*) on the second surface 22. In detail, the sealing section 26*a* is installed in the region 32*a*, and the sealing section 26*b* is installed in the region 32*b*. Each sealing section 26 is a member with a film form (film thickness of approximately 0.1 mm) which is affixed to the second surface 22, and in the same manner as the sealing section 25 on the first surface 21 side, configure the flow path by sealing each groove section 351 (351*a* and 351*b*) and each groove section 352 (352*a* and 352*b*) which are formed on the second surface 22.

As exemplified above, in the embodiment, since the film form sealing section 25 and sealing section 26 are installed on the substrate 20, it is advantageous in that, for example, it is possible to reduce a dimension (thickness) of the flow path structure G1 in the Z direction in comparison to a configuration in which the flow path is formed by adhering a flat plate member with a predetermined thickness to the substrate 20.

In addition, in the embodiment, since the plurality of sealing sections 25 are installed on the first surface 21, it is advantageous in that installation of the sealing section 25 is easy (it is possible to reduce sealing errors in each groove section) in comparison to a configuration in which the entire first surface 21 is covered by one sealing section 25. The same applies for the sealing section 26.

In each sealing section 25 and each sealing section 26 of the embodiment, a front layer is formed using a material (a thermoplastic resin material such as polypropylene) which is common with the substrate 20, and the front surface of the front layer is fused to the substrate 20 in a heating state by pressing on the substrate 20. Accordingly, it is advantageous in that installation of each sealing section 25 and each sealing section 26 is easy. For example, the sealing section 25 and the sealing section 26 are appropriately formed by a laminate of PET and polypropylene.

In addition, in the embodiment, each sealing section 25 and each sealing section 26 is formed separately from each other. Accordingly, it is advantageous in that installation of the sealing section 25 and the sealing section 26 is easy in comparison to a state in which the sealing section 25 and the sealing section 26 are integrally formed.

As exemplified in FIGS. 10 and 11, the groove section 351*a* of the second surface 22 communicates with the supply port SI1 of the first surface 21 via the through hole H of the substrate 20. In addition, each groove section 351 (351*a* and 351*b*) of the second surface 22 communicates with each groove section 341 of the first surface 21 via the through hole H of the substrate 20. In detail, as understood from FIG. 10, the groove section 351*a* communicates with the groove section 341*a* and 341*b*, and the groove section 351*b* communicates with the groove section 341*b* and 341*c*. That is, the groove section 341*a*, the groove section 341*b*, and the groove section 341*c* on the first surface 21 communicate with each other via the groove section 351*a* and the groove section 351*b* of the second surface 22.

As understood from the above explanation, the flow paths PI1 in FIG. 9 which reach from one arbitrary supply port SI1 to six outflow ports DI1 of the second surface 22 via the groove section 351 of the second surface 22 and each groove section 341 of the first surface 21 are formed respectively in four groups of ink. That is, the flow path PI1 is a flow path which distributes one group of the ink I which is supplied to the supply port SI1 to six outflow ports DI1.

Meanwhile, each groove section 352*b* of the second surface 22 in FIG. 10 communicates with the supply port SA1 of the first surface 21 via the through hole H of the substrate 20. In addition, each groove section 352 (352*a* and 352*b*) of the second surface 22 communicates with each groove section 342 of the first surface 21 via the through hole H of the substrate 20. In detail, the groove section 352*a* communicates with the groove sections 342*a* and 342*b*, and the groove section 352*b* communicates with the groove sections 342*b* and 342*c*. That is, the groove section 342*a*, the groove section 342*b*, and the groove section 342*c* on the first surface 21 communicate with each other via the groove section 352*a* and the groove section 352*b* of the second surface 22.

As understood from the above explanation, the flow paths PA1 in FIG. 9 which reach from one arbitrary supply port SA1 to six outflow ports DA1 of the second surface 22 via the groove section 352 of the second surface 22 and each groove section 342 of the first surface 21 are formed respectively in two groups of air A. That is, the flow path PA1 is a flow path which distributes one group of the air A (A1 and A2) which is supplied to the supply port SA1 to six outflow ports DA1.

Here, the flow path PA1 of the embodiment is bent on the X-Y horizontal plane so as to bypass the mounting hole 23. In a case where the flow path PI1 for supplying the ink I is bent in the same manner, an increase in flow path resistance becomes a problem, but the increase in flow path resistance which causes the flow path PA1 to bend becomes a particular problem since the fluid body which flows through the flow path PA1 is the air A.

As above, the flow paths (PI1 and PA1) which reach from the outflow ports (SI1 and SA1) to the plurality of outflow ports (DI1 and DA1) are respectively formed in the plurality of fluid bodies which include the ink I and the air A in the flow path structure G1 of the embodiment. As understood from FIG. 10, in the embodiment, the four flow paths PI1 for distributing the ink I are positioned in twos on both sides of the two flow paths PA1 for distributing the air A.

The configuration of the flow path structure G1 according to embodiment is as above.

As explained above, in the embodiment, each outflow port (SI1 and SA1) is formed on the first surface 21 of the substrate 20, and the size of the flow path structure G1 is reduced viewed from the Z direction in comparison to another configuration in which the supply ports and outflow ports are formed on the side surface of the substrate to connect a pipe since each outflow port (DI1 and DI2) is formed on the second surface 22 of the substrate 20. Accordingly, it is possible to reduce the size of the liquid ejecting head 14.

Flow Path Control Section G2

As exemplified in FIG. 6, four supply ports SI2 and two supply ports SA2 are formed on a surface facing the flow path structure G1 out of each flow path control units U2 of the flow path control section G2. In a state in which the flow path structure G1 and each flow path control unit U2 are fixed to each other, the outflow port DI1 of the flow path structure G1 is inserted into the supply port SI2 of the flow path control unit U2, and the outflow port DA1 of the flow path structure G1 is inserted into the supply port SA2 of the flow path control unit U2. Accordingly, as understood from FIG. 9, each group of the ink I is supplied from each outflow port DI1 of the flow path structure G1 to each supply port SI2 of the flow path control unit U2, and each group of the air A is supplied from each outflow port DA1 of the flow path structure G1 to each outflow port SA2 of the flow path control unit U2.

As exemplified above, in the embodiment, since the outflow port DI1 of the flow path structure G1 and the supply port SI2 of each flow path control unit U2 are directly connected, it is possible to realize a reduction of the number of parts, prevent leaking of liquid, and the like, in comparison to a configuration in which, for example, the outflow port DI1 and the supply port SI2 are connected by a pipe.

Meanwhile, as exemplified in FIG. 7, four outflow ports DI2 are formed on the surface facing the liquid ejecting section G3 out of each of the flow path control units U2. As exemplified in FIG. 9, the flow path control unit U2 includes four groups of flow paths PI2 which reach from the respective supply flow paths SI2 to the respective outflow ports DI2. The four inks I which are respectively supplied to each of the flow path control units U2 after distribution by the flow path structure G1 are supplied in parallel to the liquid ejecting unit U3 from the four outflow ports DI2 via the respective flow paths PI2.

As exemplified in FIG. 9, a negative pressure generating section 42, a flow path opening and closing section 44, and a pressure adjustment section 46 are installed respectively in the four groups of flow paths PI2 in the flow path control unit U2. In addition, the flow path control unit U2 of the embodiment includes a flow path PA2_1 which distributes the air A1 which is supplied to the supply ports SA2 to the four groups which correspond to the respective flow paths PI2, and a flow path PA2_2 which distributes the air A2 which is supplied to the supply ports SA2 to the four groups which correspond to the respective flow paths PI2. The air A1 which is distributed by the flow path PA2_1 is supplied in parallel to the four flow path opening and closing sections 44 of the flow path control unit U2, and the air A2 which is distributed by the flow path PA2_2 is supplied in parallel to the four pressure adjustment sections 46 of the flow path control unit U2.

Figure 13:
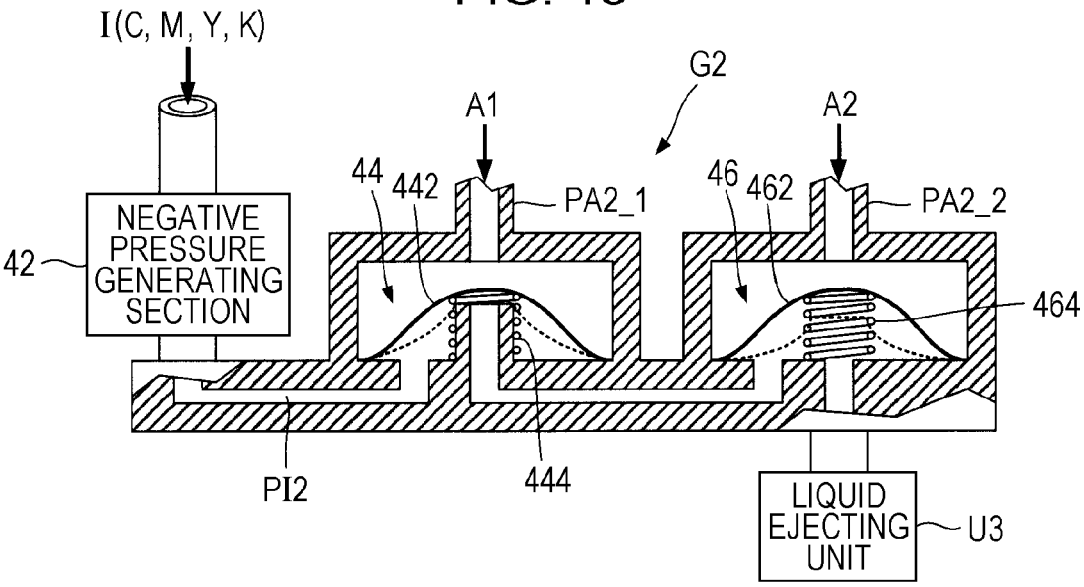
FIG. 13 is a configuration diagram which is focused on an ink flow path of one group of ink out of the flow path control section of the line head according to the embodiment.

FIG. 13 is a configuration diagram which is focused on the flow path PI2 of the ink I of one arbitrary group of the flow path control unit U2. As exemplified in FIG. 13, the negative pressure generating section 42 is installed on the flow path PI2 to maintain a predetermined negative pressure within the flow path PI2. In detail, in the normal state, the flow path PI2 is closed, and in a case where the negative pressure within the flow path PI2 which is caused by ejection (consumption) of the ink I using the liquid ejecting section U3 reaches a predetermined value, a pressure control valve into which the ink I is autonomously introduced by opening the flow path PI2 is appropriately adopted as the negative pressure generating section 42.

As exemplified in FIG. 13, the flow path opening and closing section 44 is installed on the downstream side of the negative pressure generating section 42 in the flow path PI2, and the pressure adjustment section 46 is installed on the downstream side of the flow path opening and closing section 44. That is, the flow path opening and closing section 44 is positioned between the negative pressure generating section 42 and the pressure adjustment section 46 on the flow path PI2.

The flow path opening and closing section 44 is a mechanism (choke valve) which controls opening and closing of the flow path PI2 according to the air A1 which is supplied via the flow path PA2_1. The flow path opening and closing section 44 which is exemplified in FIG. 13 is configured to include a flexible member 442 which is interposed between the flow path PI2 of the ink I and the flow path PA2_1 of the air A1, and an elastic body 444 which biases the flexible member 442 to the flow path PA2_1 side. In the normal state (reduced pressure state) in which the air A1 of the flow path PA2_1 is not pressurized, the flow path PI2 is open, and as illustrated by the broken line in FIG. 13, when the air A1 is pressurized by the pump 16, the flow path PI2 is closed by the flexible member 442 changing shape counteracting the biasing by the elastic body 444.

The pressure adjustment section 46 in FIG. 13 is a mechanism which adjusts the pressure within the flow path PI2 (capacity of the flow path PI2), and for example, is a negative pressure release valve which releases negative pressure in the flow path PI2. In detail, the pressure adjustment section 46 which is exemplified in FIG. 13 is configured to include a flexible member 462 which is interposed between the flow path PI2 of the ink I and the flow path PA2_2 of the air A2, and an elastic body 464 which biases the flexible member 462 to the flow path PA2_2 side. In the normal state, the air A2 of the flow path PA2_2 is set to atmospheric pressure (atmospheric release), as illustrated by a broken line in FIG. 13, when the air A2 is pressurized by the pump 16, the pressure of the flow path PI2 increases to the extent to which the negative pressure is released by the negative pressure generating section 42 by the flexible member 462 changing shape to the flow path PI2 side counteracting the biasing by the elastic body 464 (the capacity of the flow path PI2 is reduced).

The ink I is ejected from each of the nozzles N upon the negative pressure of the ink I in the flow path being released, for example, during cleaning of the liquid ejecting unit U3 (ejecting head sections 70). However, in a state in which the negative pressure generating section 42 is effective, it is possible to inhibit release of the negative pressure using the pressure adjustment section 46. Accordingly, there is a possibility that the ink I is not sufficiently discharged from each of the nozzles N and there is a possibility that bubbles enter from each nozzle N. Therefore, in the embodiment, the flow path PI2 is closed by the flow path opening and closing section 44 by pressurizing the air A1 of the flow path PA2_1, then the negative pressure of the flow path PI is released by the pressure adjustment section 46 by pressurizing the air A2 of the flow path PA2_2.

According to the operation above, in a state in which the negative pressure generating section 42 and pressure adjustment section 46 are isolated from each other (that is, a state in which application of the negative pressure by the negative pressure generating section 42 is ineffective) by closing the flow path PI2 using the flow path opening and closing section 44, release of the negative pressure is executed by the pressure adjustment section 46, and therefore it is advantageous in that it is possible to effectively release the negative pressure of the flow path on the downstream side of the flow path opening and closing section 44.

As understood from the above explanation, the negative pressure generating section 42, the flow path opening and closing section 44, and the pressure adjustment section 46 of the embodiment function as components which control the flow path PI2 of each ink I, and the flow path control section G2 is comprehensively realized as components which control each flow path PI2 by utilizing the air A (A1 and A2) of each group after the distribution by the flow path structure G1. The configuration of each flow path control unit U2 of the flow path control section G2 according to the embodiment is as above.

Liquid Ejecting Section G3

The liquid ejecting section G3 ejects each group of the ink I from the nozzles N via the flow path control section G2. As exemplified in FIG. 6, four supply ports SI3 is formed on a surface facing the flow path control section G2 out of each liquid ejecting units U3 of the liquid ejecting section G3. In a state in which the flow path control section G2 and the liquid ejecting section G3 (a casing 142) are fixed to each other, each supply port SI3 of the each liquid ejecting unit U3 is inserted into each outflow port DI2 of the flow path control unit U2. Accordingly, as understood from FIG. 9, each group of the ink I is supplied in parallel from the outflow port DI2 of the flow path control unit U2 to the four supply ports SI3 of each liquid ejecting unit U3.

Detailed description of the structure of the liquid ejecting section G3 is omitted.

(A-1-4) Other Configurations and Effects (2) Furthermore, as represented in FIGS. 3 and 4, in the embodiment, there is a support point section 34 when the first extending portion 15 of the first flexible tube 9*a* is raised and lowered with the line head 14 to a position which is separated from the line head 14 in the first direction F1, and a length L1 on the line head of the first extending portion 15 is configured to be longer than a length L2 to the support point section 34 on the main body 3 side closest to the line head 14, and the line head 14.

There are a cases where the first flexible tube 9*a* is bound to the end section vicinity of the line head 14, and becomes the support point section 34 when a bound portion is raised and lowered.

According to the embodiment, since the length L1 on the line head 14 of the first extending portion 15 is longer than the length L2 to the support point section 34 on the main body 3 side closest to the line head 14, and the line head 14, it is possible to reduce stress which is applied to the first flexible tube 9*a* which is connected to the line head 14 accompanying raising and lowering of the line head 14 by absorbing using the first extending portion 15.

(3) Furthermore, as represented in FIG. 3, in the embodiment, the first extending portion 15 of the first flexible tube 9*a* is positioned within the width of the line head 14 in a case of projection in the second direction F2. Furthermore, the second extending portion 29 of the second flexible tube 9*b* is also positioned within the width of the line head 14 in a case of projection in the second direction F2.

Thereby, the flexible tubes 9 (9*a* and 9*b*) are not bulky when raising and lowering the line head 14, and it is possible to reduce the size of the apparatus.

(4) Furthermore, as represented in FIG. 13, in the embodiment, the negative pressure generating section 42 is provided in each of the plurality of flow paths which reach the nozzles N within the line head 14.

Here, as previously described, the negative pressure generating section 42 maintains the inside of the flow path which communicates with the nozzles N at a predetermined negative pressure, and has a function of reducing influence of variance of the supply pressure on the upstream side of the negative pressure generating section 42 by setting the supply pressure within the flow path to the nozzles N further on the downstream side than the negative pressure generating section 42 to a certain predetermined pressure.

According to the embodiment, it is possible to effectively reduce the variance of the supply pressure of the liquid to each nozzle N of the line head 14 using the negative pressure generating section 42, and similarly it is possible to reduce variance of weight of the liquid droplets which are ejected from the nozzles N.

In addition, there is an operation which causes the liquid to be ejected from the nozzles N as a cleaning operation of the nozzles N of the line head 14, but in a case where the operation is executed, there is a structure in which the negative pressure generating section 42 is in a non-operation state. In the case of the structure, there is a risk that variance of the flow path length is increased and variance occurs in a cleaning flow rate due to receiving the influence when cleaning.

However, according to the embodiment, as above, variance of the flow path length from the first joint 10 which is the liquid supply port to the nozzles N is reduced as above by the first joint 10 being disposed in the center portion 17*b* in the longitudinal direction of the line head 14. Accordingly, it is possible to effectively execute cleaning by reducing the risk that variance of the cleaning flow path occurs.

Figure 19:
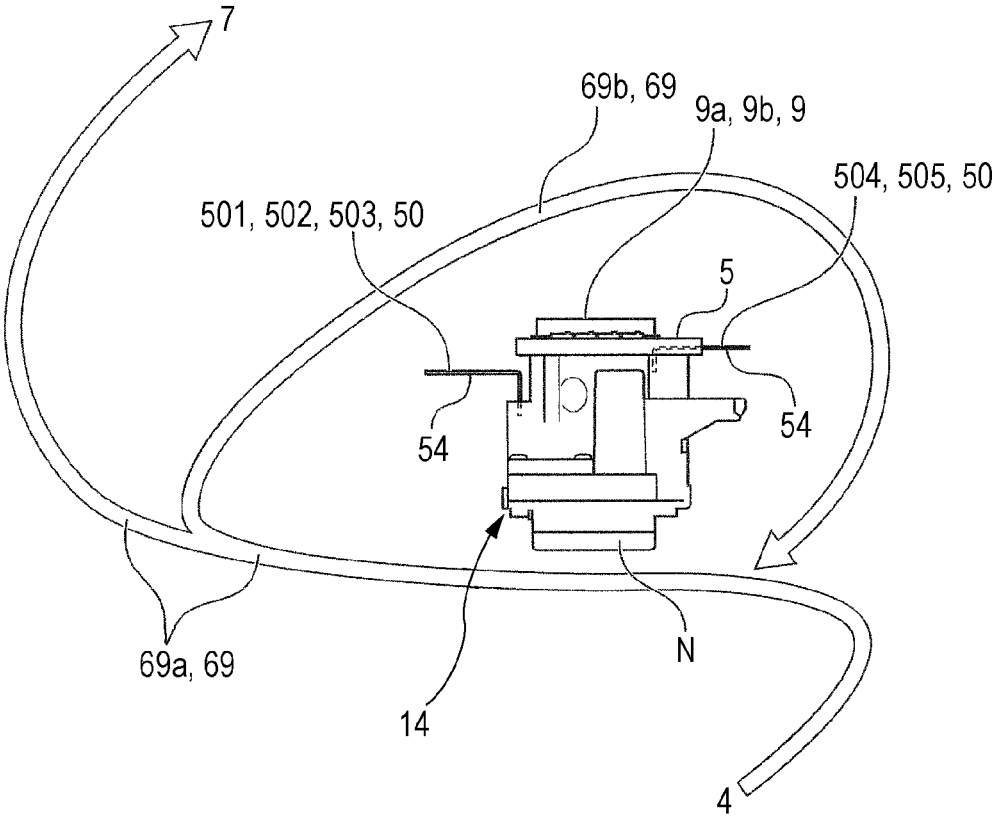
FIG. 19 is a side surface outline view which represents a positional relationship of the medium transport path and the line head which is represented in FIG. 14.
Figure 35:
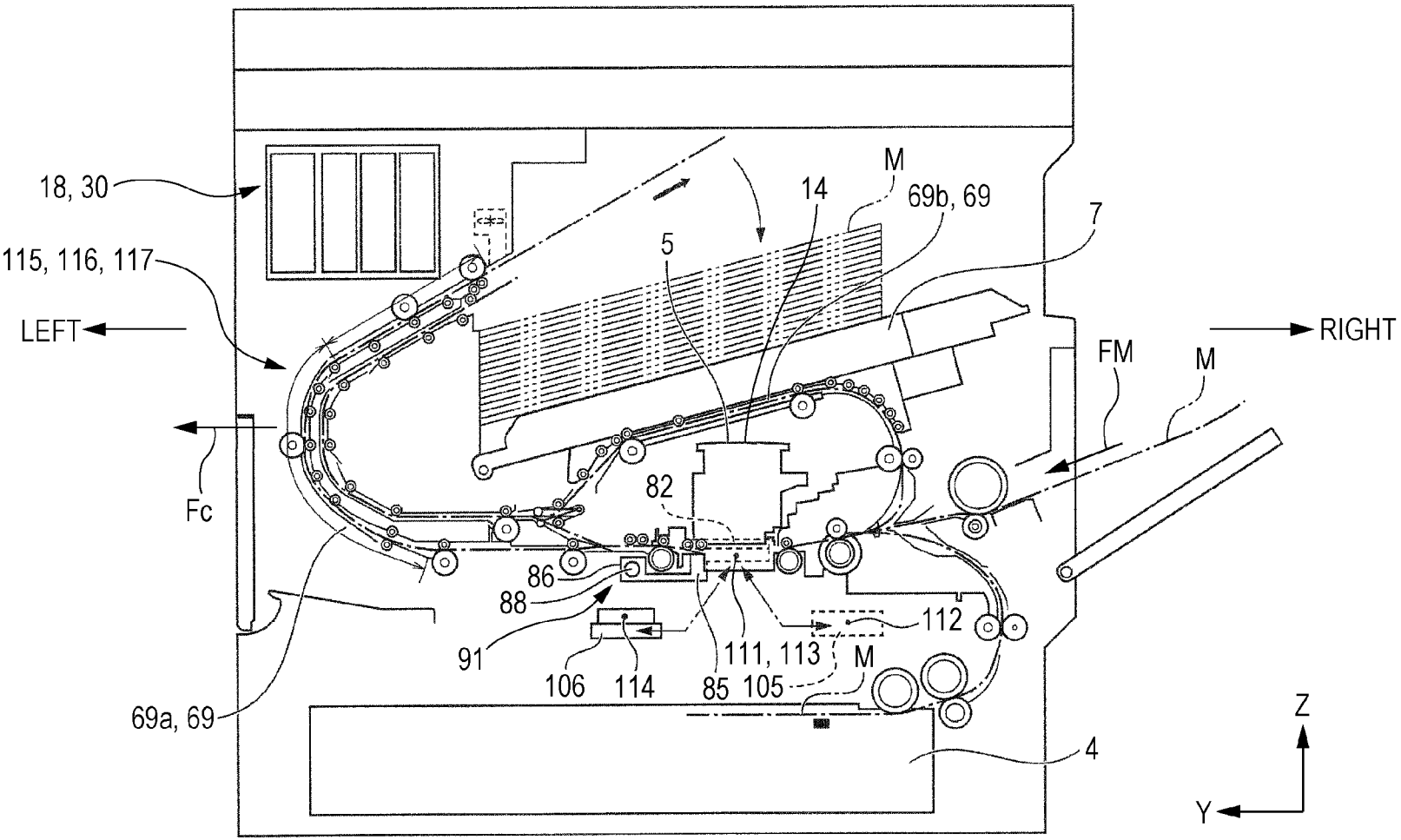
FIG. 35 is an outline perspective view which represents a positional relationship of the line head, the wiping member, and the transport path according to the embodiment of the liquid ejecting apparatus which is represented in FIGS. 1A and 1B.

(5) The embodiment which corresponds to the first aspect above has a configuration in which the transport path which transports the medium M surrounds the periphery of the line head 14 on the horizontal plane which is orthogonal to the first direction F1, but the detailed description will be described later (FIGS. 19 and 35).

(6) Others (6-1) Alternatively to the disposition above, the second joint 27 may be a structure which is disposed further on the one side (+X side) in the first direction F1 than the first joint 10.

(6-2) Other than a use for pressurizing liquid within the line head, a use or the like is given for blowing away dust or the like which is adhered to the nozzle surface as a use of "air" which is supplied to the line head via the second flexible tube 9*b*. Of course, the use is not limited thereto.

(B) Process of a Problem of Receiving an FFC by Raising and Lowering the Line Head An embodiment of a process with respect to a problem of receiving an FFC by raising and lowering the line head will be described below.

The embodiment will be described using mainly FIGS. 14 to 19. Here, configuring members which are common with the configuring members in the embodiment of (A) are given the same reference numerals and the description thereof is omitted.

Figure 14:
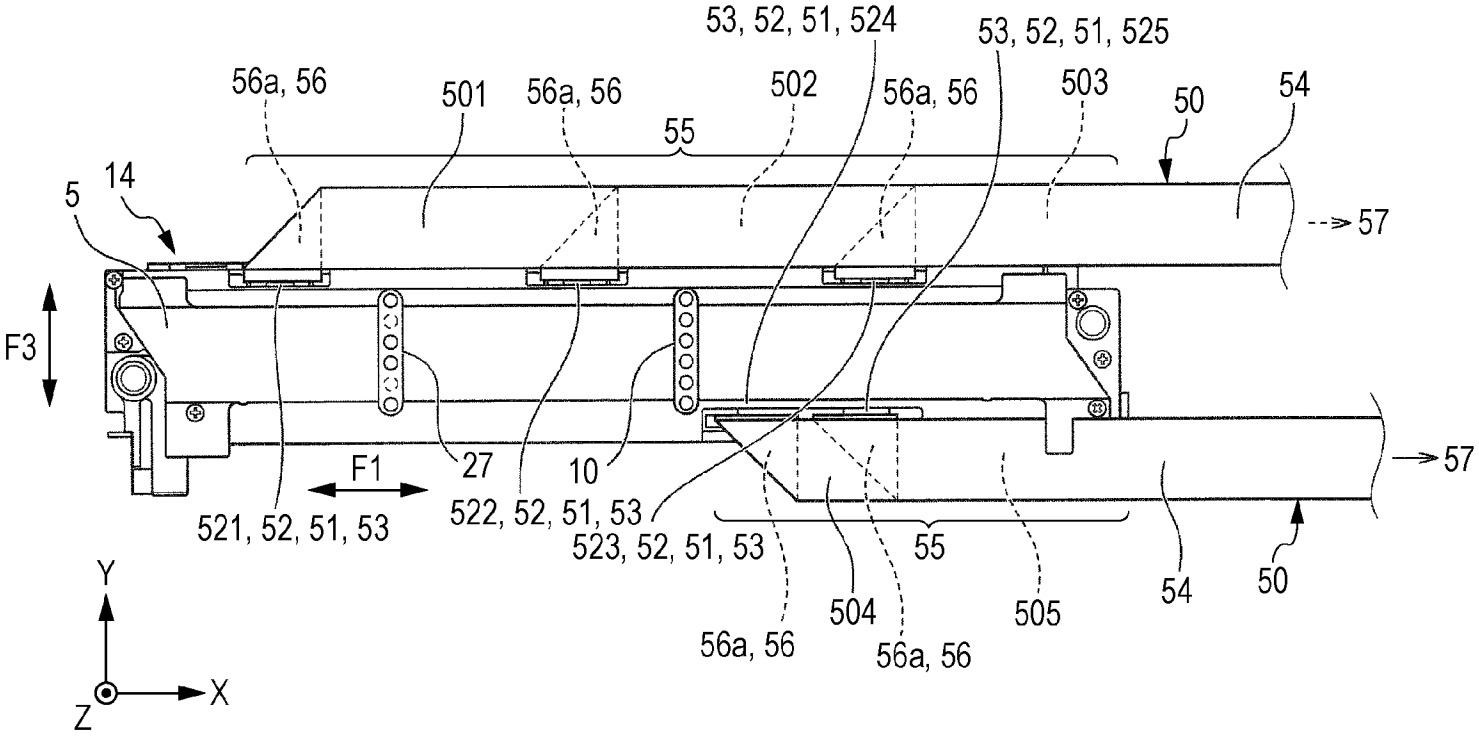
FIG. 14 is a planar view of the main section which represents portion of a line head and an FFC according to the embodiment of the liquid ejecting apparatus which is represented in FIGS. 1A and 1B.
Figure 15:
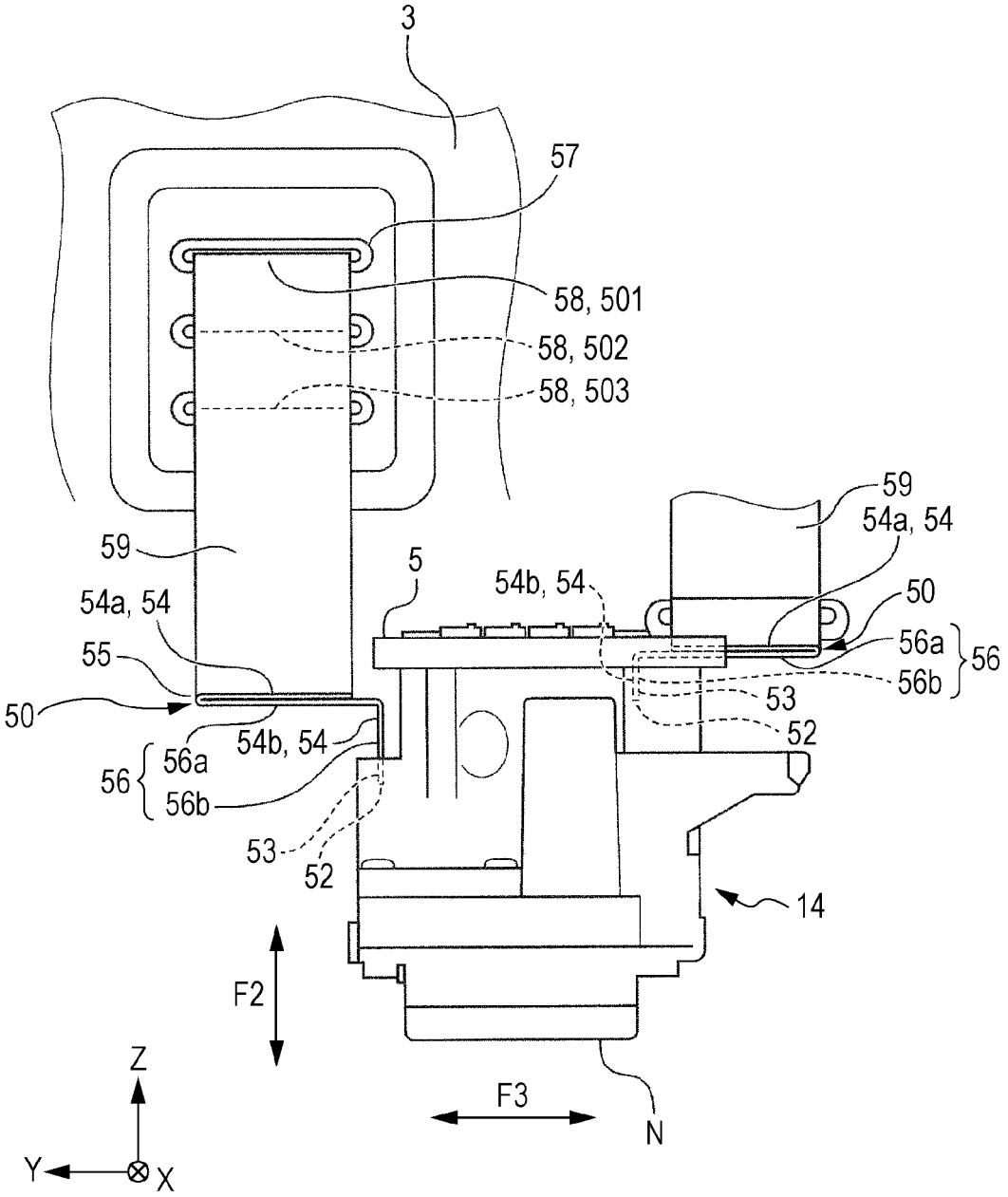
FIG. 15 is a side view of the main section of the liquid ejecting apparatus.

(B-1) Embodiment 1 (FIGS. 14 and 15)

(B-1-1) Configuration

Based on FIGS. 14 and 15, Embodiment 1 of a process is described with respect to the problem of receiving the FFC by raising and lowering the line head.

In FIGS. 14 and 15, the illustration of the first flexible tube 9*a* and the second flexible tube 9*b* is omitted in order to make the drawings easy to understand. In the embodiment, a connection position, an extension position, and the like with respect to the line head 14 of the flexible tube 9 are the same as the description in FIGS. 2 to 4.

Here, the connection position, the extension position, and the like with respect to the line head 14 of the flexible tube 9 may be different from the description in FIGS. 2 to 4.

As represented in FIGS. 14 and 15, the printer 1 of the embodiment is provided with the elongated line head 14 along the first direction F1 and an FFC 50 which is connected to the line head 14. The line head 14 is provided with a connector 52 in which a plurality of terminals 51 are positioned along the first direction F1, and is raised and lowered by a raising/lowering mechanism which is not shown in the drawings in the second direction F2 (the same as the Z direction).

The FFC 50 is provided with a cable connection portion 53 which is connected to the connector 52 on the leading end. Furthermore, in the state in which the cable connection portion 53 is connected to the connector 52, the FFC 50 is provided with a cable extension portion 55 which is orthogonal to the second direction F2, that is, disposed horizontally to a flat surface 54, extends along the first direction F1 from the cable connection portion 53 side to the one side (−X side) in the first direction F1, and does not extend to the other side (−X side).

A bent portion 56 in which the FFC 50 is bent is bent between the cable connection portion 53 and the cable extension portion 55. That is, the FFC 50 is connected to the connector 52 via the bent portion 56.

As shown in FIG. 15, in the embodiment, the connector 52 is positioned more to the "lowering" side (−Z direction) than the cable extension portion 55 in the second direction F2, that is, below.

Then, the bent portion 56 of the FFC 50 is provided with a first bent portion 56*a* which is bent from the cable extension portion 55 and in which the flat surface 54*a* is orthogonal to the second direction F2, and a second bent portion 56*b* which is bent from the first bent portion 56*a* and in which the flat surface 54*b* is orthogonal to the third direction F3. The bent portion 56 is connected to the connector 52 which is positioned below via the second bent portion 56*b*.

Here, in the embodiment, the bent portion is bent in two different directions, but as another embodiment, the connector 52 may be disposed on the same plane as the cable extension portion 55 in the second direction F2, and the bent portion 56 may have a structure of only the first bent portion 56*a*.

In addition, as shown in FIG. 14, the cable extension portion 55 of the FFC 50 is positioned to be adjacent along the long side of the line head 14 in the longitudinal direction. In the embodiment, the connector 52 includes a plurality of connectors 521, 522, 523, 524, and 525 which are disposed along the first direction F1. The FFC 50 also includes a plurality of FFC 501, 502, 503, 504, and 505 which are disposed along the first direction F1. Then, the plurality of connectors 521, 522, 523, 524, and 525 are respectively connected to each cable connection portion 53 of the plurality of FFC 501, 502, 503, 504, and 505.

Furthermore, as shown in FIG. 14, each cable extension portion 55 of the plurality of FFC 501, 502, 503, 504, and 505 are disposed so as to overlap with each other. In the embodiment, the three FFC 501, 502, and 503 overlap by being positioned on the one side of the line head 14, and the two FFC 504 and 505 overlap by being positioned on the other side of the line head 14. Here, the number of the FFC 50 is not limited to five, and may be a different plural number, or alternatively may be one.

(B-1-2) Effects

Furthermore, the FFC 50 is provided with the cable connection portion 53 which is connected to the connector 52 of the elongated line head 14 along the first direction F1, and the cable extension portion 55 on which the flat surface 54 is disposed so as to be orthogonal to the second direction F2, extends along the first direction F1 from the cable connection portion 53 side to the one side (+X side) in the first direction F1, and does not extend to the other side (−X side). Accordingly, in a case where the line head 14 is raised and lowered, it is possible to reduce a risk that twisting is generated in the FFC 50 which is connected to the line head 14 accompanying raising and lowering using the cable extension portion 55 in which the flat surface 54 is disposed so as to overlap with respect to the second direction F2. In addition, it is possible to reduce the stress which is applied to the FFC 50 accompanying the raising and lowering.

In addition, according to the embodiment, the bent portion 56 is provided with the first bent portion 56*a* which is bent from the cable extension portion 55 and in which the flat surface 54*a* is orthogonal to the second direction F2, and the second bent portion 56*b* which is bent from the first bent portion 56*a* and in which the flat surface 54*b* is orthogonal to the third direction F3. Thereby, it is possible achieve a reduction in a size in the third direction of the liquid ejecting apparatus.

In addition, since the plurality of FFC 501, 502, 503, 504, and 505 are disposed so be overlapped by the cable extension portion 55, even if the line head 14 is raised and lowered, the plurality of FFC 501, 502, 503, 504, and 505 are not bulky. Similarly, it is possible to achieve a reduction in size of the apparatus.

(B-1-3) Other Configurations and Effects (1) Furthermore, as represented in FIG. 14, the line head 14 is provided with a plurality of connectors 523 and 525 which are positioned along the third direction F3. Then, the connectors 523 and 525 are disposed such that the positions overlap in the first direction F1, that is, disposed substantially on a horizontal plane.

Thereby, since the way in which the stress is applied to the FFC 503 and 504 based on the raising and lowering of the line head 14 is equal, it is possible to effectively reduce the stress. Additionally, it is possible to dispose the plurality of connectors 52 at high density in the line head 14.

Here, of course the connectors 52 which are disposed such that the positions overlap in the first direction F1 are not limited to the pair described above (523 and 525).

(2) As previously described based on FIG. 1, in the printer 1, the line head 14 is configured so as to be separable from the apparatus main body 3 by opening the discharge tray 7 (FIG. 1) which serves as a cover that is provided on one side (+Z direction) of the second direction F2 with respect to the line head 14, that is below. That is, the line head 14 is set so as to be removed to the outside by being lifted upward from the installation position inside the apparatus main body 3 by opening the discharge tray 7.

In addition, as shown in FIG. 15, the printer 1 of the embodiment is provided, in the apparatus main body 3, with a main body side connector 57 which is connected to the cable connection portion 58 on the other end side which is the side opposite to the one end side (cable connection portion 53 side) at which the FFC 50 is connected to the line head 14.

Furthermore, the connector 57 on the main body side is provided at the one side in the second direction F2 (+Z direction) with respect to the line head 14, that is, at a position above the upper surface 5 of the line head 14. Thereby, the cable connection portion 58 on the other end side of the FFC 50 is connected to the main body side connector 57 via a rising portion 59 which rises above the position of the cable extension portion 55.

Line Head Removal

In a case where the line head 14 is removed from the printer 1, first a state is set in which the discharge tray 7 which also serves as a cover is open, and it is possible to gain access to the line head 14 within the apparatus main body 3 from above.

Next, the flexible tube 9 (illustration is omitted from FIGS. 14 and 15) is removed from the line head 14, and furthermore, the connection to the apparatus main body 3 side of the FFC 50 is removed. The main body side connector 57 of the FFC 50 is positioned at the removal side which is above the line head 14 in a state in which the cover (discharge tray 7) is open. That is, the connector 57 on the main body side is provided at a position at which it is possible to easily gain access from above. Accordingly, it is possible to easily remove the FFC 50 from the main body side connector 57.

Subsequently, the line head 14 is removed outside of the printer 1 by being lifted upward.

In this manner, it is possible to easily remove the line head 14 from the printer 1.

Figure 16:
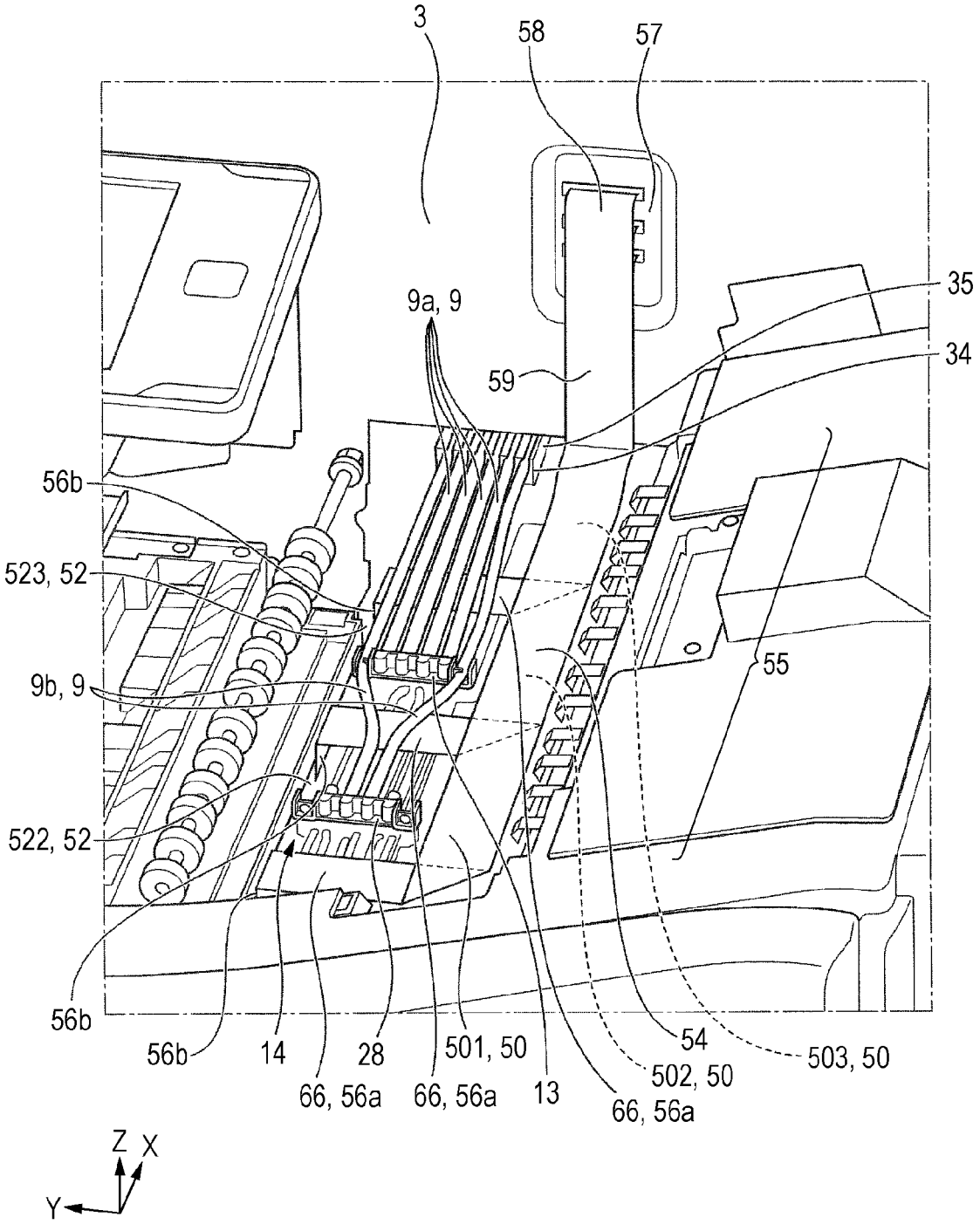
FIG. 16 is a perspective view of the main section which represents a portion of the line head, the flexible tube, and the FFC according to an embodiment of the liquid ejecting apparatus which is represented in FIGS. 1A and 1B.
Figure 17:
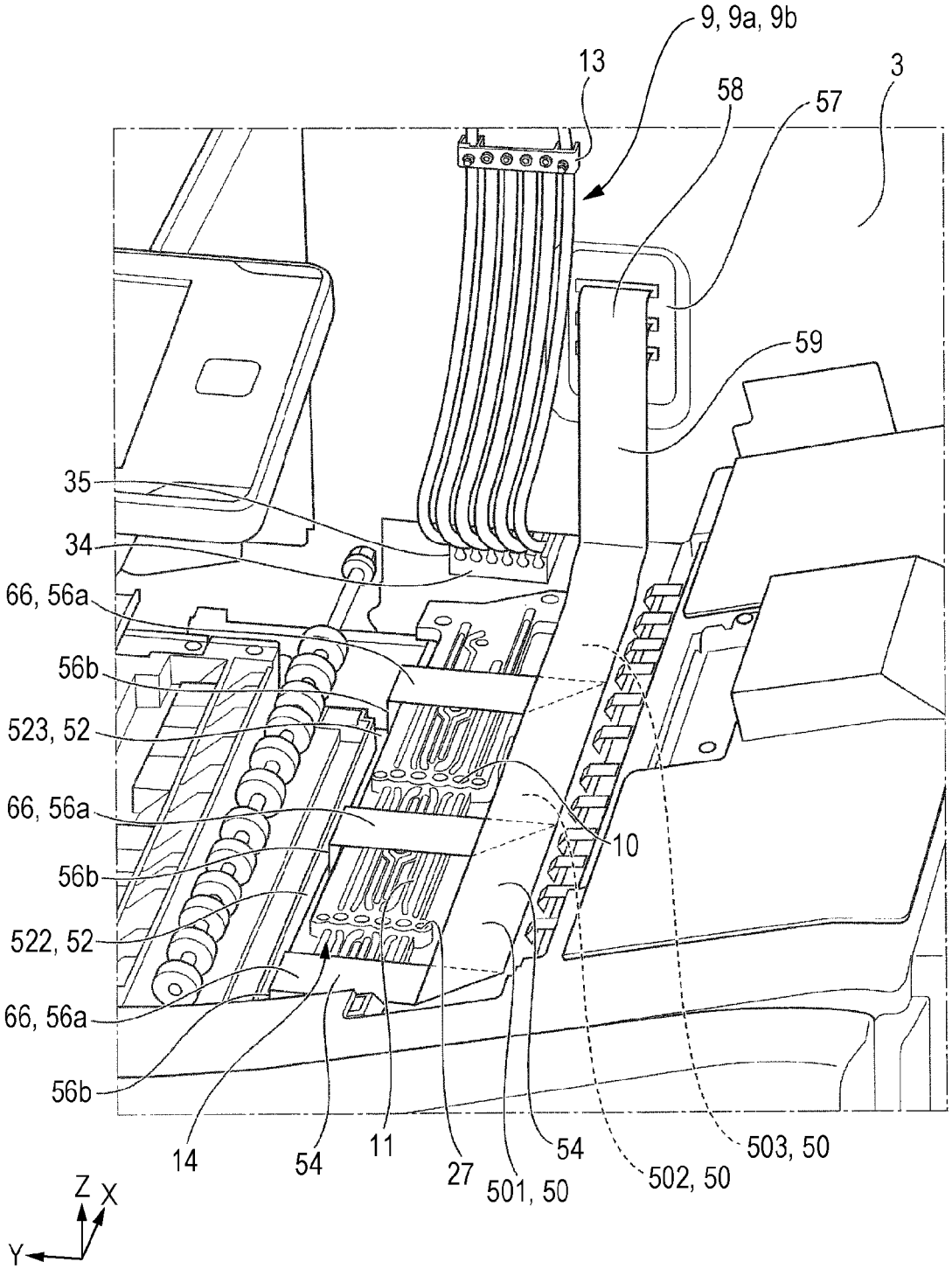
FIG. 17 is a perspective view which represents a state in which the flexible tube is removed to be lifted up from the state in FIG. 16.
Figure 18:
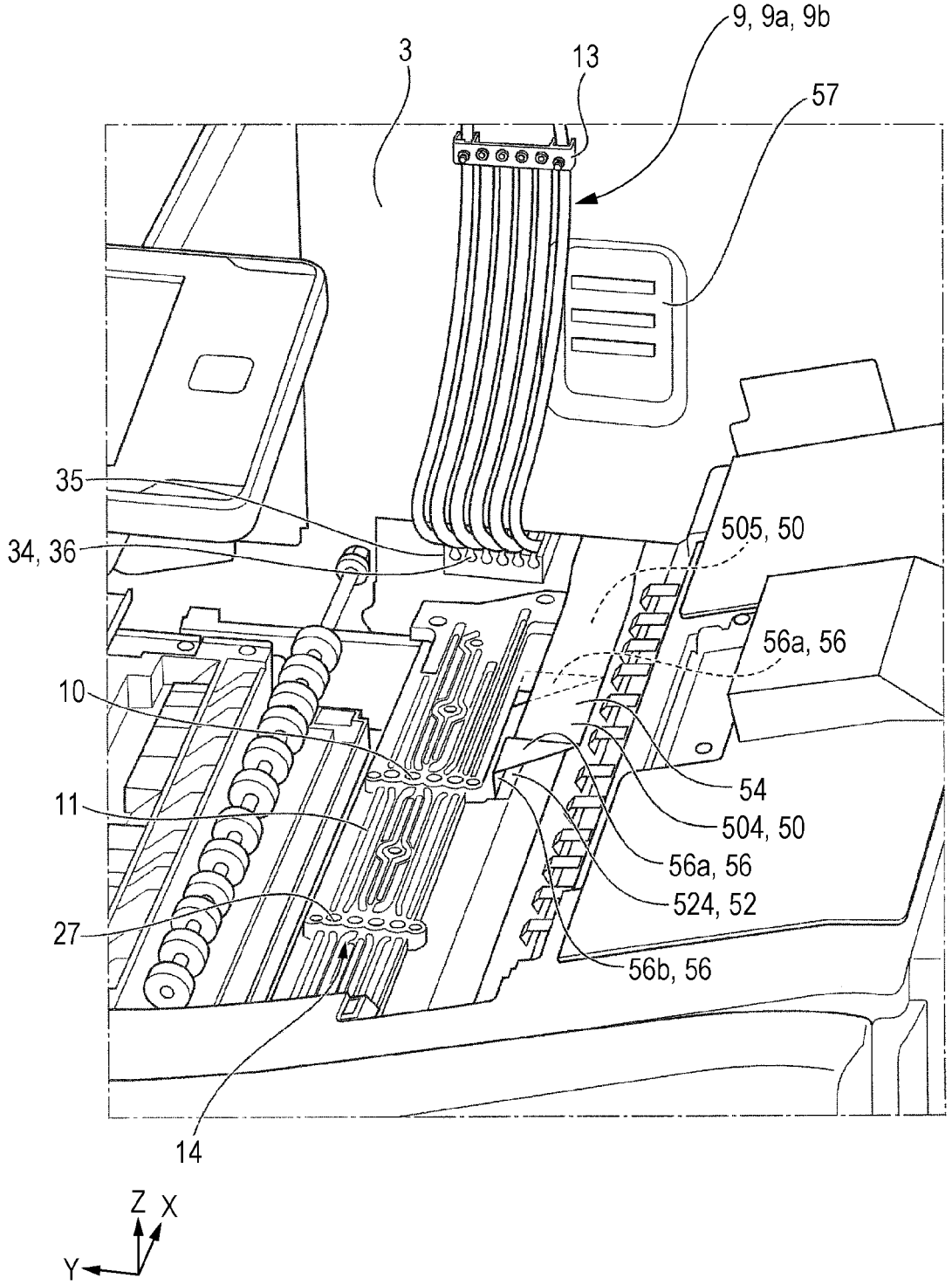
FIG. 18 is a perspective view which represents a state in which the FFC is removed from the state in FIG. 17.

(B-2) Embodiment 2 (FIGS. 16 to 18)

(B-2-1) Configuration

Embodiment 2 will be described based on FIGS. 16 to 18.

As represented in FIG. 16, in the printer 1 of the embodiment, the cable extension portion 55 of the FFC 50 is positioned to be adjacent along the length side of the line head 14 in the longitudinal direction, and three out of five first bent portions 56*a* have a cross-section 66 which extends to a position on the side opposite to the FFC 50 with respect to the line head 14.

Describing in detail, the connectors 521, 522, 523, 524, and 525 have the same disposition in FIG. 14, but the five FFC 501, 502, 503, 504, and 505 have different dispositions in FIG. 14, and are disposed on any one side of the line head 14 (side opposite to the connectors 521, 522, and 523, and the same side as the connectors 524 and 525). For this reason, the cross-section 66 which cuts across the line head 14 is provided on each first bent portion 56*a* of the FFC 501, 502, and 503.

Then, the five FFC 501, 502, 503, 504, and 505 are disposed such that each cable extension portion 55 overlap up and down. That is, in the state in which the cable connection portion 53 is connected to the connector 52, each flat surface 54 is disposed so as to be orthogonal to the second direction F2, that is, substantially on a horizontal plane.

Each cable connection portion 58 of the FFC 501, 502, and 503 is connected to the main body side connector 57.

Here, since the number of cross-sections 66 is determined which corresponds to the disposition of the plurality of connectors 52, the cross-sections 66 are not limited to three.

As represented in FIG. 16, in the embodiment, the first flexible tube 9*a* and second flexible tube 9*b* are provided on the upper surface 5 in the raising and lowering direction of the line head 14. The first flexible tube 9*a* and second flexible tube 9*b* are provided at the connection position (position of the first joint 10) and the extension position (disposition of the first extending portion 15) in the same manner as in FIGS. 2 to 4 with respect to the line head 14.

Furthermore, in the embodiment, each cross-section 66 is disposed below the first flexible tube 9*a* and the second flexible tube 9*b*. That is, each of the cross-sections 66 is disposed between the upper surface 5 of the line head 14 and the first flexible tube 9*a* and the second flexible tube 9*b*.

Line Head Removal

The case of removing the line head 14 from the printer 1 will be described in process order based on FIGS. 16 to 18.

(1) First, the discharge tray 7 which has a cover is opened from the state in FIG. 1 to be accessible from above in the line head 14 within the apparatus main body 3 in the state in FIG. 16.

(2) Next, as represented in FIG. 17, the first flexible tube 9*a* and the second flexible tube 9*b* are removed to be lifted up from the line head 14, and holding sections 71 and 80 which will be described later (FIGS. 23 and 25) that are provided on the apparatus main body 3 side are used to hold up the first connecting portion 13.

(3) Next, as represented in FIG. 18, the FFC 501, 502, and 503 which are connected to the main body side connector 57 are removed from the main body side connector 57. Furthermore, the FFC 501, 502, and 503 are removed from the line head 14. Thereby, the remaining FFC 504 and 505 are in an accessible state.

In the embodiment, the remaining FFC 504 and 505 are connected by being drawn around up to the circuit board side of a direct control source (an electronic mounting member 83 which will be described later, FIG. 30) without passing through the main body side connector 57.

The FFC 50 is used in order to transmit various signals, but there are cases where an increased influence of noise is received in a case where the plurality of FFC are wired to be connected by the connector according to the transmitted signal type (high-speed transfer and the like). As represented in FIG. 18, in a case where increased influence of noise is received, one FFC is directly connected to the control source (electronic mounting member 83, FIG. 30) without passing through the connector.

Therefore, the remaining FFC 504 and 505 are removed only from the connection portion with the line head 14 (portions of the connectors 524 and 525). Thereby, the line head 14 is released from connection with the flexible tube 9 and the FFC 50, and comes to be in a removable state. Therefore, the line head 14 is removed to the outside by being lifted up.

(B-2-2) Effects

According to the embodiment, the cable extension portion 55 is positioned on the one side along the length side of the line head 14 in the longitudinal direction, and at least one first bent portion 56*a* has the cross-section 66 which extends to the other side which is a side opposite to the FFC 50 with respect to the line head 14. Due to the cross-section 66, the degree of freedom of the disposition of the FFC 50 with respect to the disposition of the connector 52 of the line head 14 is increased, and design and manufacture become easy.

In a case where the line head 14 is removed from the printer 1 and newly exchanged, it is necessary to perform a discharge operation or the like and drive a predetermined head in order to discharge a protective liquid which is filled inside the line head 14 in a state in which the first flexible tube 9*a* and the second flexible tube 9*b* are not connected to the new line head 14.

According to the embodiment, since the cross-section 66 of the FFC 50 is disposed below the first flexible tube 9*a* and the second flexible tube 9*b*, the predetermined head is driven by securing the electrically connected state of only the FFC 50, and then the first flexible tube 9*a* and the like is able to be connected by being disposed above the cross-section 66 of the FFC 50. Accordingly, it is easy to exchange the line head 14.

(B-3) Embodiment 3 (FIG. 19)

Embodiment 3 will be described based on FIG. 19.

As represented in FIG. 19, in the embodiment, the printer 1 is provided with a transport path 69 which transports the medium M which is a subject on which liquid is discharged by the line head 14. The transport path 69 surrounds the periphery of the line head 14 on the horizontal plane which is orthogonal to the first direction F1 (X direction). In FIG. 19, the transport path 69 is schematically described.

The transport path 69 includes a single-surface recording transport path 69*a* and a both-surface recording reverse path 69*b* which face from the medium accommodating cassette 4 side to the discharge tray 7 side through a recording execution region (liquid discharge region) which faces the nozzles N of the line head 14. That is, the line head 14 surrounds the periphery using the single-surface recording transport path 69*a* and the both-surface recording reverse path 69*b*.

Here, the structure of the transport path 69 is described in detail in other embodiments which will be described later (FIG. 35).

Here, the line head 14 is provided with the flexible tubes 9 which are described in FIGS. 2 to 4 and the FFC 50 which are described in FIGS. 14 and 15. The flexible tubes 9 and the FFC 50 are not limited to the above, and may be, for example, the FFC 50 with a structure represented in FIGS. 16 to 18.

According to the embodiment, since the transport path 69 surrounds the periphery of the line head 14 on the horizontal plane which is orthogonal to the first direction F1 (X direction), it is possible to dispose the transport path 69 along the flat surface 54 of the cable extension portion 55 of the FFC 50. In addition, it is possible to dispose the transport path 69 along each extension portion 15 and 29 of the flexible tubes 9. That is, it is possible to provide the transport path 69 close to the line head 14, and it is possible to achieve a reduction in size of the apparatus.

(C) Process of a Problem when Removing a Liquid Supply Path from the Line Head

An embodiment of a process with respect to a problem of removing a liquid supply path from the line head will be described below.

The embodiment will be described using mainly FIGS. 2 to 4, and 20 to 29. Here, configuring members which are common with the configuring members in the embodiments of (A) and (B) are given the same reference numerals and the description thereof is omitted.

(C-1) Embodiment 1 (FIGS. 2 to 4 and 20 to 23)

(C-1-1) Configuration

Embodiment 1 of the process with respect to the problem which occurs when removing the liquid supply path from the line head will be described based on FIGS. 2 to 4.

As represented in FIGS. 2 to 4, the printer 1 of the embodiment is provided with the medium transport region 19 in which the medium M is transported, the line head 14 which ejects liquid onto the medium M which is transported in the medium transport region 19, and the first flexible tube 9*a* which forms a liquid supply path which supplies liquid to the line head 14 by being connected to the line head 14. The first flexible tube 9*a* is disposed such that the line head 14 is positioned within the medium transport region 19 in a vertical direction (Z direction). That is, the first flexible tube 9*a* is disposed so as to not directly face below the medium transport region 19 in a state of being connected to the line head 14, and even if it is assumed that leaking of liquid from the first flexible tube 9*a* occurs, the risk of the leaked liquid directly dripping on the medium transport region 19 is reduced by the line head 14 being within the medium transport region 19.

In the embodiment, the connecting section which is connected to the line head 14 of the first flexible tube 9*a* (the first connecting portion 13) is positioned on the upper surface 5 of the line head 14. Then, in a state in which the first connecting portion 13 is connected to the first joint 10 of the line head 14, the first flexible tube 9*a* has an extending portion (the first extending portion 15) which extends in a direction (the first direction F1) which intersects with a transport direction FM of the medium M (FIGS. 2 and 3) through the upper surface 5 of the line head 14 from the position of the first joint 10 and the first connecting portion 13. Furthermore, a portion which is outside the upper surface 5 of the line head 14 that is the first extending portion 15 is configured so to be positioned outside the medium transport region 19.

Figure 22B:
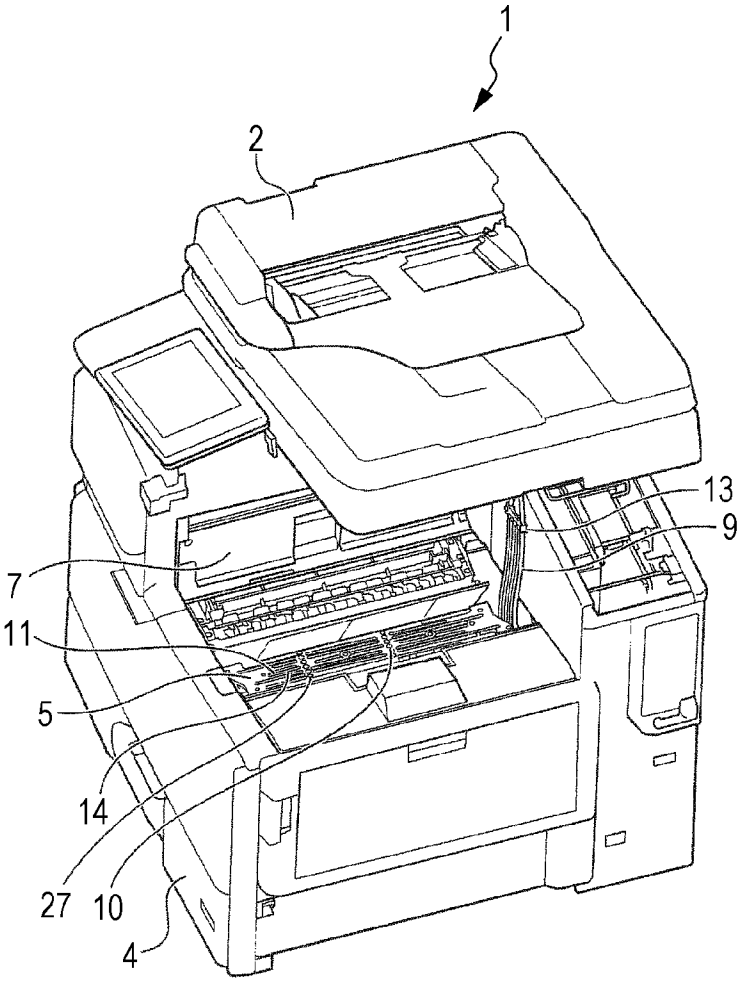
FIG. 22B is a perspective view viewed from above FIG. 22A.
Figure 22A:
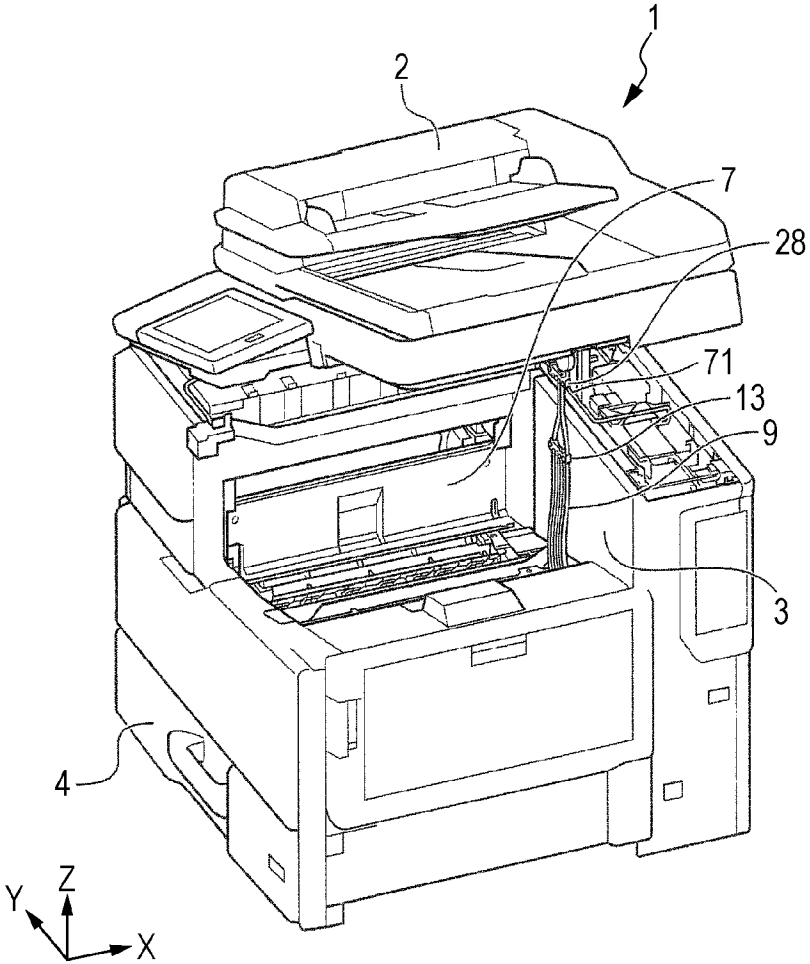
FIG. 22A is a perspective view which represents a state in which the flexible tube is removed and held in a holding section from the state in FIG. 21A.

In addition, as represented as an example in FIG. 22, the holding section 71 which holds the connecting section (first connecting portion 13) of the first flexible tube 9*a* from above is provided in a range outside the medium transport region 19 in the state of the first flexible tube 9*a* being removed from the line head 14. Here, the structure of the holding section 71 is not limited to a specific structure. The holding section 71 may have any structure as long as it is possible to hold the first connecting portion 13 from above in the range outside the medium transport region 19 in the state of the first flexible tube 9*a* being removed from the line head 14.

Line Head Removal

The case of removing the line head 14 from the printer 1 in the embodiment will be described in process order based on FIGS. 20 to 23.

Figure 20:
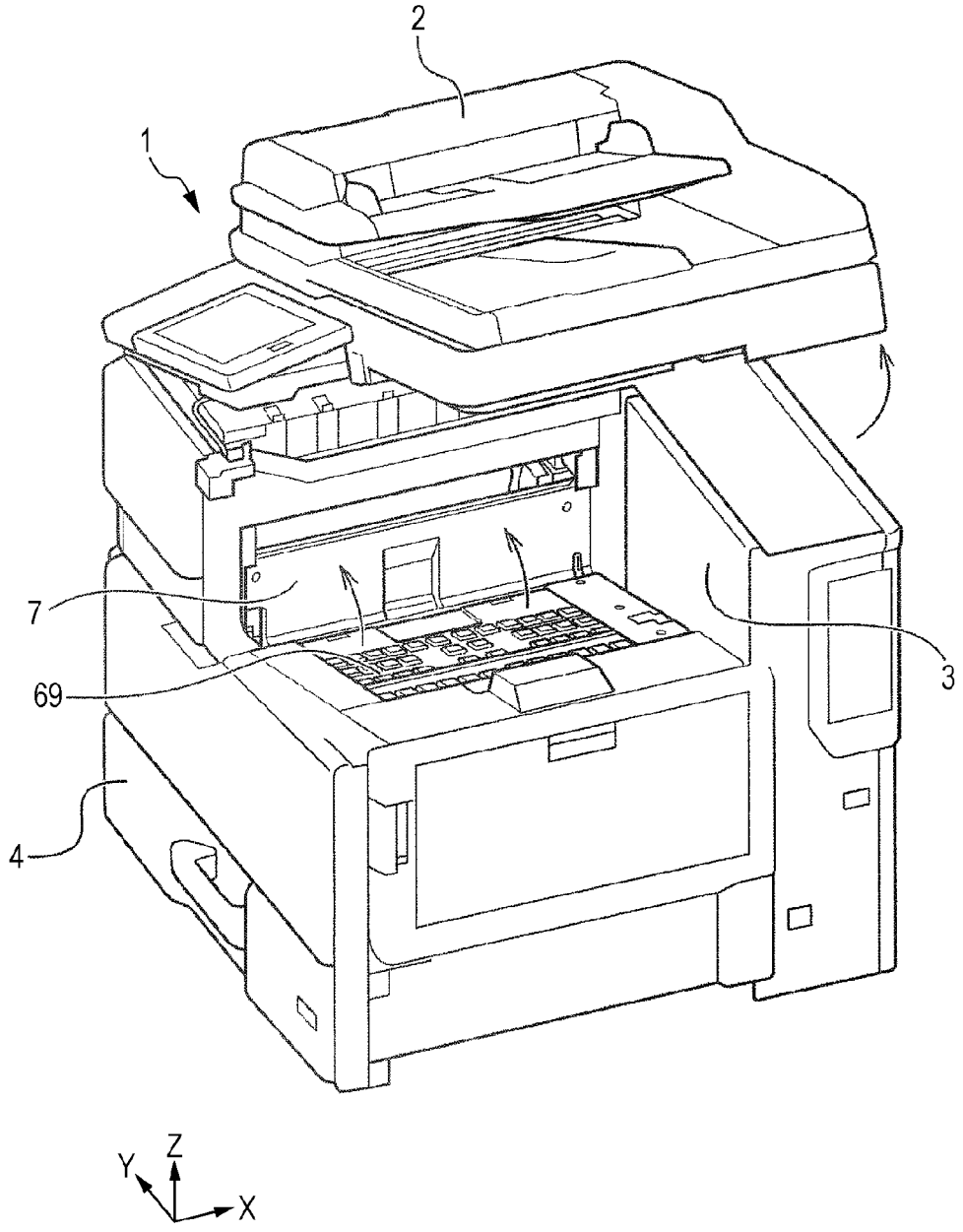
FIG. 20 is a perspective view from the front which represents a state in which a medium receiving surface of a medium discharge section is open according to the embodiment of the liquid ejecting apparatus which is represented in FIGS. 1A and 1B.
Figure 21B:
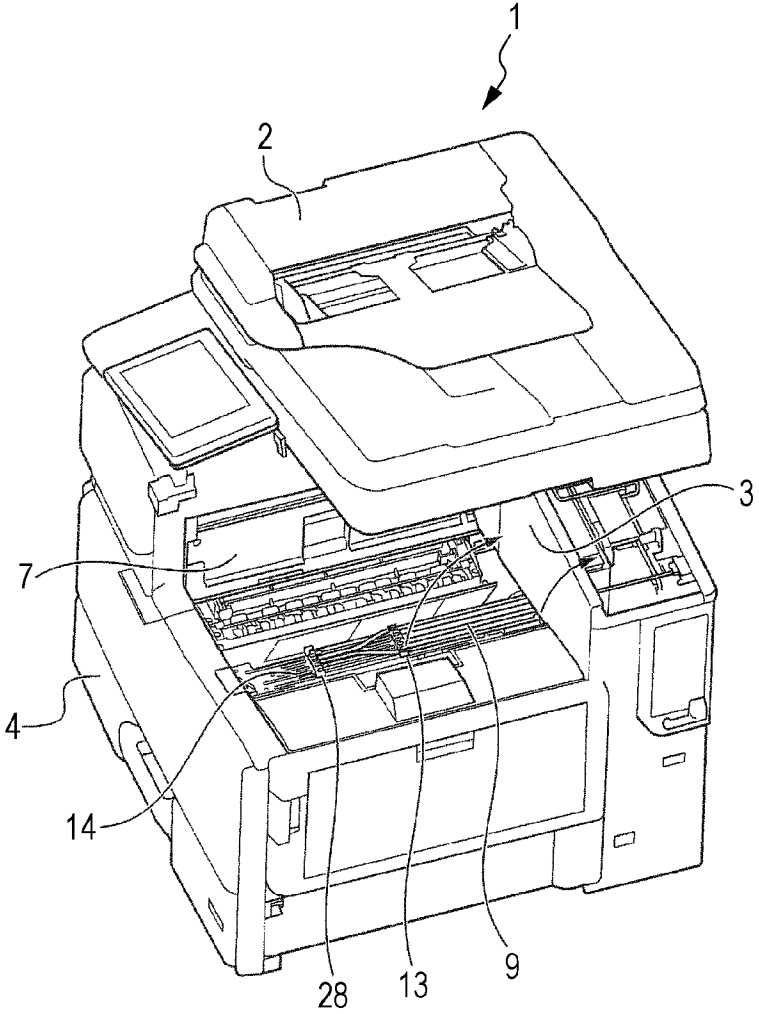
FIG. 21B is a perspective view viewed from above FIG. 21A.
Figure 21A:
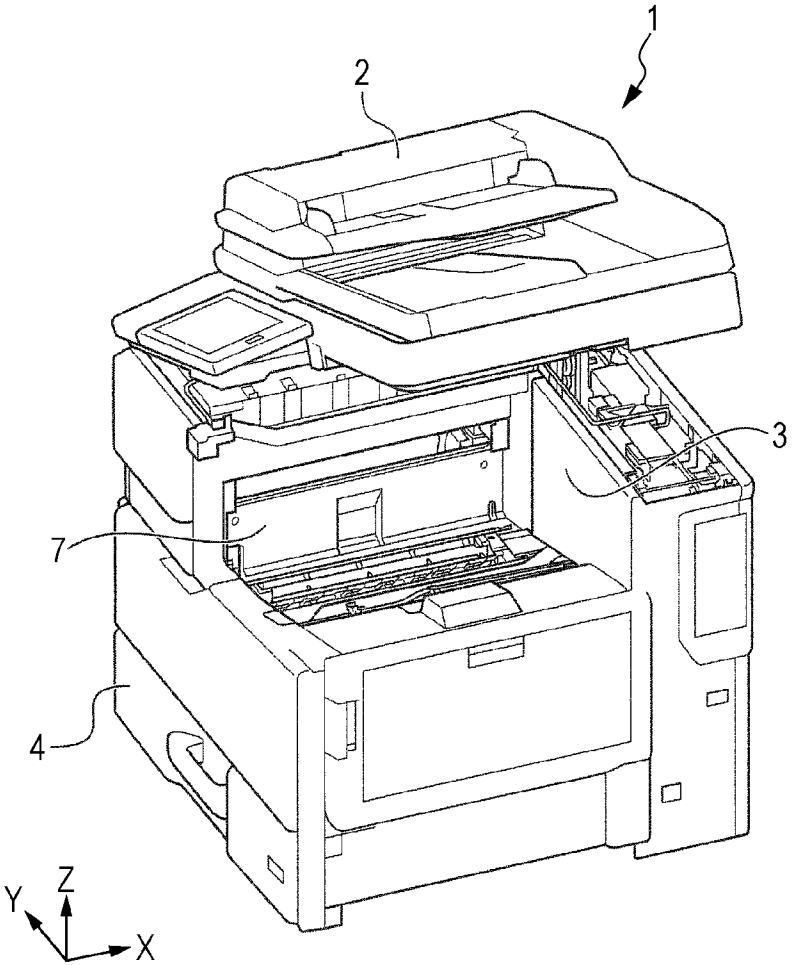
FIG. 21A is a perspective view which represents a state in which a portion of the medium transport path is removed from the state in FIG. 20.

(1) First, an upper space of the discharge tray 7 is enlarged and work is made easier by slightly rotating the scanner unit 2 from the state in FIG. 1. Then, the discharge tray 7 which has a cover is opened (FIG. 20). Furthermore, a portion of the transport path 69 which is positioned above the line head 14 within the apparatus main body 3 (FIG. 19) is removed to come to be in a state of being accessible from above the line head 14 (FIG. 21). FIGS. 2 to 4 represent only a portion of the line head 14 and the liquid accommodating body 18 in this state.

(2) Next, as represented in FIG. 22, each connecting section (the first connecting portion 13 and the second connecting portion 28) of the flexible tube 9 (the first flexible tube 9*a* and the second flexible tube 9*b*) is removed to be lifted up from each joint (the first joint 10 and the second joint 27) of the line head 14. Then, the second connecting portion 28 is locked to the holding section 71 which is provided on the apparatus main body 3, and thereby, the first connecting portion 13 and the second connecting portion 28 are held in a state of being suspended from above.

Next, the FFC 50 (FIGS. 14, 16, and the like) are removed from the line head 14. Thereby, the line head 14 is released from connection with the flexible tube 9 and the FFC 50, and comes to be in a removable state.

Figure 23B:
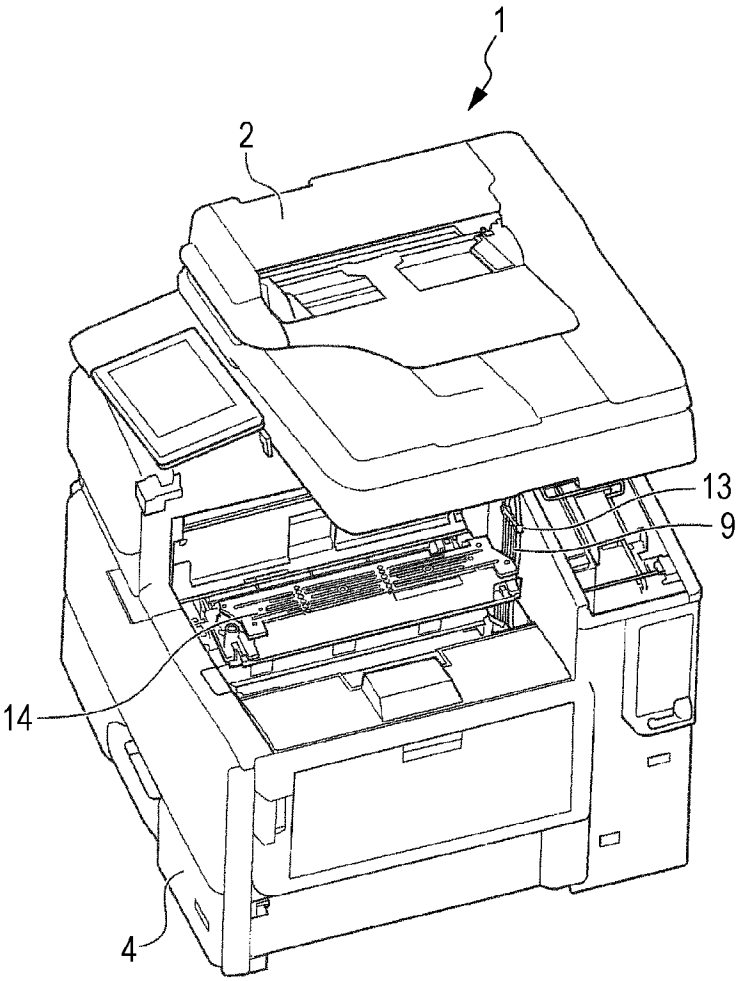
FIG. 23B is a perspective view viewed from above FIG. 23A.
Figure 23A:
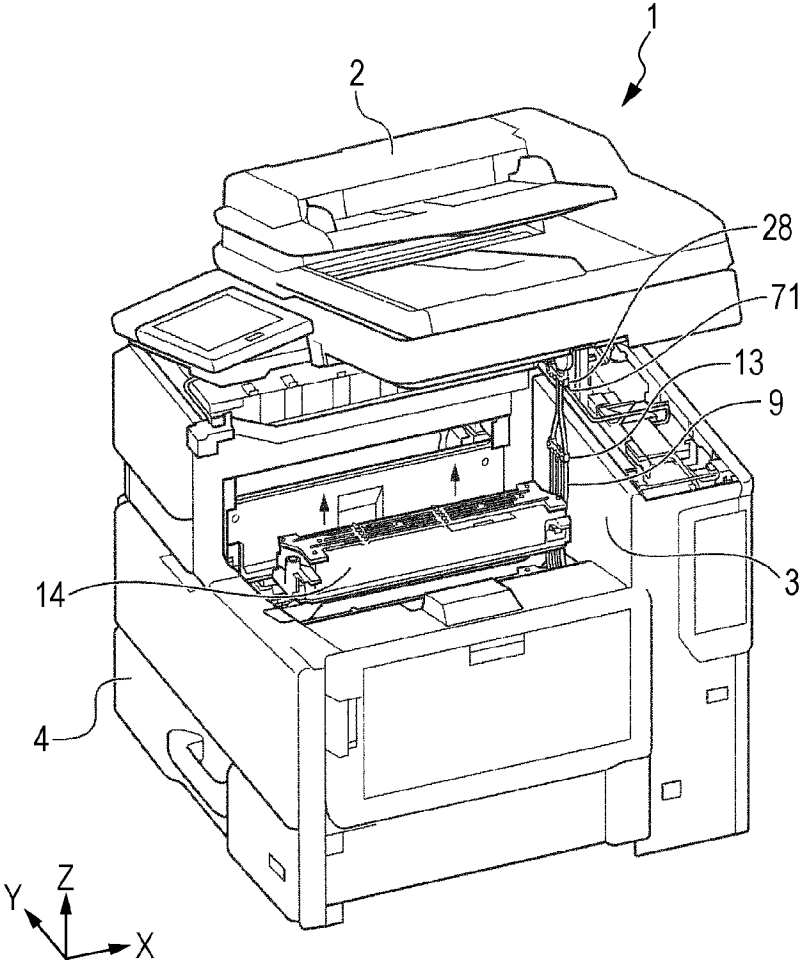
FIG. 23A is a perspective view which represents a state in which the line head is removed from the state in FIG. 22A.

(3) Next, as represented in FIG. 23, the line head 14 is removed to the outside by being lifted up from the installation position within the apparatus main body 3. Then, necessary maintenance is carried out on the line head 14, or alternatively, by replacing with a new line head 14, by a process reverse to the process described above, the new line head 14 is installed at the installation position within the apparatus main body 3, and connected to the flexible tube 9 and the FFC 50.

(C-1-2) Effects

According to the embodiment, the first flexible tube 9*a* which is a liquid supply path is disposed such that the line head 14 is positioned within the medium transport region 19 in the vertical direction. That is, the line head 14 is present on the lower side of the first flexible tube 9*a*. Thereby, even if liquid leaks from the first connecting portion 13 of the first flexible tube 9*a*, it is possible to reduce the risk of liquid dripping directly on the medium transport region 19.

In addition, in the embodiment, in a case where the first flexible tube 9*a* is removed from the line head 14, the first connecting portion 13 of the first flexible tube 9*a* is removed from the first joint 10 of the line head 14, and furthermore, even in a case where liquid from the first connecting portion 13 drips due the movement of the first connecting portion 13 of the first flexible tube 9*a* along the upper surface of the line head 14 while being lifted up, it is possible to reduce the risk of the liquid falling directly on the medium transport region 19 since the line head 14 is positioned on the upper side of the medium transport region 19. Then, when the first connecting portion 13 of the first flexible tube 9*a* is lifted up to reach the region on the outside that is removed from the upper surface 5 of the line head 14, the position is outside the range of the medium transport region 19. Accordingly, since the medium transport region 19 is directly below the first connecting portion 13 of the first flexible tube 9*a*, in the same manner it is possible to reduce the risk of liquid falling directly on the medium transport region 19.

In addition, according to the embodiment, since the holding section 71 which holds the first connecting portion 13 from above is provided in a state in which the first flexible tube 9*a* is removed from the line head 14, the first flexible tube 9*a* in the removed state is unobtrusive, and maintenance is improved when the line head 14 is removed and maintenance is carried out.

In addition, since the holding section 71 is positioned outside the range of the medium transport region 19, it is possible to reduce the risk of liquid dripping on the medium transport region 19 from the first flexible tube 9*a* which is in a state of being held by the holding section 71.

(C-2) Embodiment 2 (FIGS. 4 and 23)

Embodiment 2 of the process with respect to the problem which occurs when removing the liquid supply path from the line head will be described based on FIGS. 4 and 23.

As represented in FIG. 23, in the printer 1 of the embodiment, the line head 14 is attachable and detachable with respect to the printer 1, and furthermore, the holding section 71 is provided at a position which is removed from the attachment/detachment path of the line head 14. The attachment/detachment path has the meaning of a region through which the line head passes when the line head 14 is lifted up from the installation position within the apparatus main body 3.

In this manner, since the holding section 71 is provided at a position which is removed from the attachment/detachment path of the line head 14, the holding section 71 is removed out of the apparatus main body 3 when maintenance such as repairs, exchange, or the like are carried on the line head 14, but it is possible to hold the flexible tube 9 in a state in which the holding section 71 is not obtrusive in the removal.

In addition, as represented in FIG. 4, in the embodiment, as previously described, the liquid accommodating body 18 (FIG. 4) which accommodates liquid which is supplied to the line head 14 is provided at a position above the position of the line head. Then, a position 73 (FIG. 4) of the first connecting portion 13 of the first flexible tube 9*a* in the state of being held by the holding section 71 is configured so as to be above a center position of an outlet 72 of liquid in the liquid accommodating section 18.

Thereby, it is possible to suppress the risk of liquid dripping from the first connecting portion 13 of the first flexible tube 9*a* in the state of being removed from the line head 14.

Figure 24:
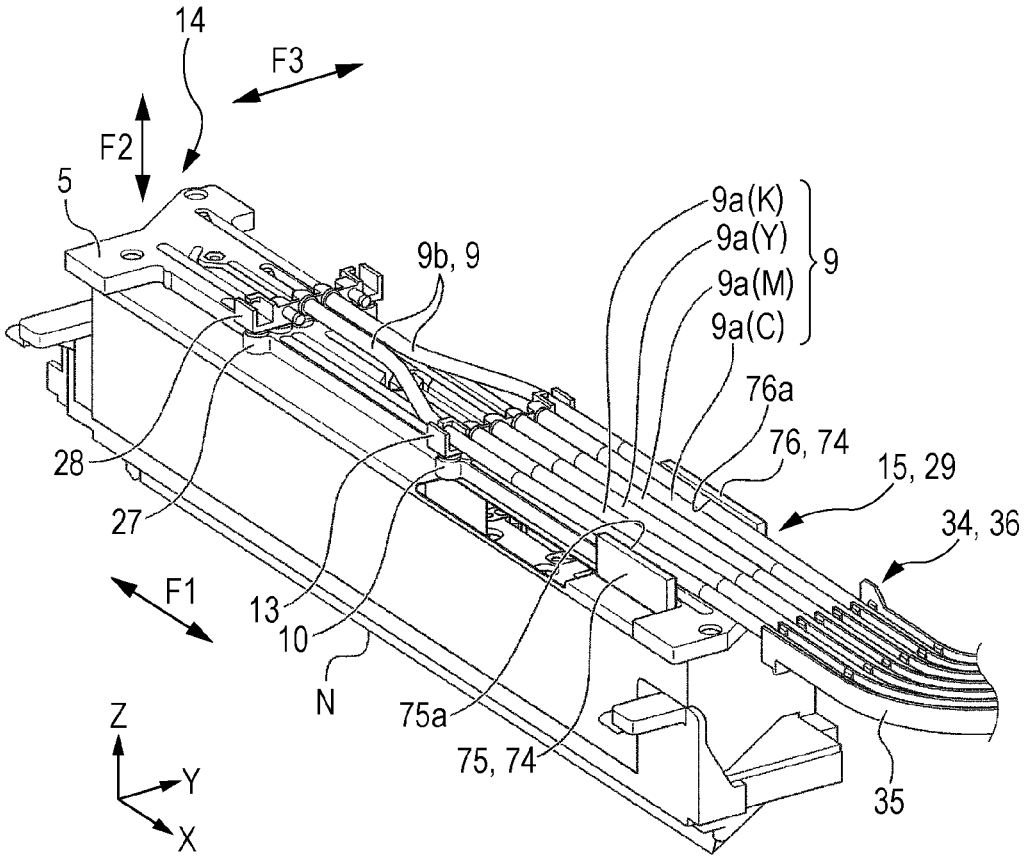
FIG. 24 is a perspective view which represents a portion of the line head and the flexible tube according to the embodiment of the liquid ejecting apparatus which is represented in FIGS. 1A and 1B.

(C-3) Embodiment 3 (FIG. 24)

Embodiment 3 of the process with respect to the problem which occurs when removing the liquid supply path from the line head will be described based on FIG. 24.

As represented in FIG. 24, the first flexible tube 9*a* is made from a plurality of flow path bodies (the first tube 9*a* (C), the second tube 9*a* (M), the third tube 9*a* (Y), and the fourth tube 9*a* (K)). Furthermore, the second flexible tube 9*b* is formed of two flow path bodies (the first tube 9*b*(A1) and the second tube 9*b*(A2)).

In the embodiment, when the connecting sections of the first flexible tube 9*a* and the second flexible tube 9*b* (the first connecting portion 13 and the second connecting portion 28) are lifted from above, a support mechanism 74 is provided which supports the connecting sections (the first connecting portion 13 and the second connecting portion 28) to move along the upper surface 5 of the line head 14.

Here, "support" by the support mechanism 74 has the meaning of guiding such that the connecting section (the first connecting portion 13) moves along the upper surface of the line head 14 when the connecting section (the first connecting portion 13) of the first flexible tube 9*a*, which is the liquid supply path, is lifted up, and a guide with a mechanical structure, a guide with a display (target display) which is a target for an arrow, a mark which is provided at a target position of a destination, the holding section 71 and other destinations, and the like are given as examples.

The support mechanism 74 in the embodiment, is configured by the guide with a mechanical structure as described below in detail.

As represented in FIG. 24, the support mechanism 74 is provided on the line head 14, is positioned on both sides along the extension portion (the first extending portion 15 and the second extending portion 29) of the flexible tube 9, and when the connecting sections of the first flexible tube 9*a* and the second flexible tube 9*b* (the first connecting portion 13 and the second connecting portion 28) are lifted up along the upper surface 5 of the line head 14, has plate shape regulating sections 75 and 76 which have regulating surfaces 75*a* and 76*a* along the lifting direction.

According to the embodiment, when the connecting sections of the flexible tube 9 (first connecting portion 13 and second connecting portion 28) are lifted up, it is possible to easily move the connecting sections (first connecting portion 13 and second connecting portion 28) along the upper surface 5 of the line head 14 by being supported on the support mechanism 74.

In detail, the regulating surfaces 75*a* and 76*a* of the regulating sections 75 and 76 which form the support mechanism 74 are along the lifting direction when the connecting sections of the flexible tube 9 (first connecting portion 13 and second connecting portion 28) are lifted up along the upper surface 5 of the line head 14. Accordingly, the regulating surfaces 75*a* and 76*a* of the regulating sections have an action of naturally promoting the connecting sections to move along the upper surface 5 of the line head 14 when the connecting sections of the flexible tube 9 (first connecting portion 13 and second connecting portion 28) are lifted up. That is, support.

In addition, the flexible tube 9 regulates the position on the upper surface 5 of the line head 14 of a plurality of flow path bodies (four first flexible tubes 9*a* and two second flexible tubes 9*b*) in the extending portions (first extending portion 15 and second extending portion 29) from both sides using the regulating surfaces 75*a* and 76*a* of the regulating sections 75 and 76. Accordingly, the regulating sections 75 and 76 are able to suppress variance in the plurality of flow path bodies (four 9*a* and two 9*b*) on the line head 14.

Figure 25:
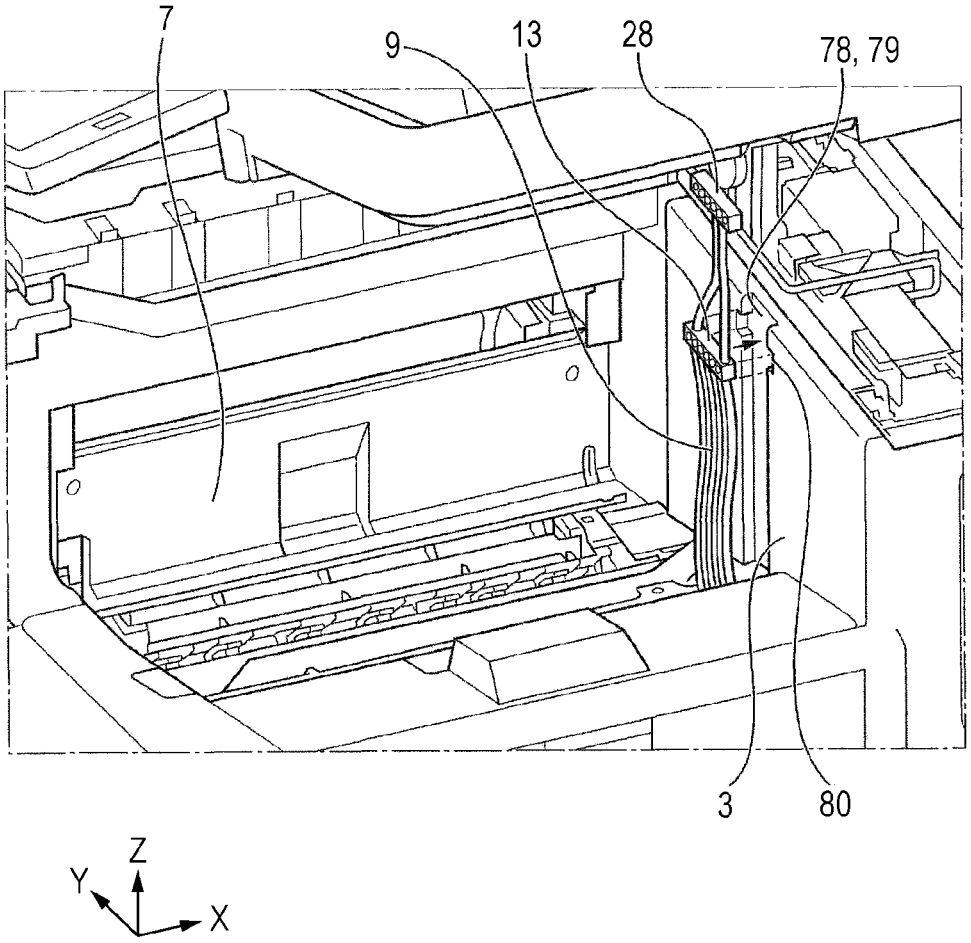
FIG. 25 is a perspective view which represents a state immediately before the flexible tube is removed and held in the holding section according to the embodiment of the liquid ejecting apparatus which is represented in FIGS. 1A and 1B.

(C-4) Embodiment 4 (FIGS. 3 and 25)

Embodiment 4 of the process with respect to the problem which occurs when removing the liquid supply path from the line head will be described based on FIGS. 3 and 25.

The support mechanism 74 in the embodiment is configured as below.

As represented in FIG. 25, the support mechanism 74 is provided at a position on a direction line 77 (FIG. 3) which moves along the upper surface 5 of the line head 14 due to the connecting sections of the flexible tube 9 (first connecting portion 13 and second connecting portion 28) being lifted upward, and has a target display 78 (FIGS. 3 and 25) which indicates a position of a destination.

The target display 78 in the embodiment is not a simple mark, and is a recessed groove 79 which accommodates the flexible tube 9 by being provided at a position that corresponds to the apparatus main body 3. Of course the target display 78 may be a simple mark. A holding section 80 which accommodates and holds the first connecting portion 13 of the flexible tube 9 is also provided in the recessed groove 79. The holding section 80 also functions as the target display 78.

Here, FIG. 25 is a state directly before the flexible tube 9 and the first connecting portion 13 are accommodated in the recessed groove 79 and the holding section 80.

According to the embodiment, the target display 78 is provided which indicates the position of the destination at a position on the direction line 77 which moves along the upper surface 5 of the line head 14 due to the connecting sections of the flexible tube 9 (first connecting portion 13 and second connecting portion 28) being lifted upward. Accordingly, it is possible for the connecting sections to be naturally promoted, that is, supported to move along the upper surface 5 of the line head 14 when the target display 78 lifts up the connecting sections of the flexible tube 9 (first connecting portion 13 and second connecting portion 28).

Furthermore, since the target display 78 is not a simple mark, and is a recessed groove 79 which accommodates the flexible tube 9 by being provided at a position that corresponds to the apparatus main body 3, it is possible to hold the flexible tube 9 which is removed from the line head 14 in a state of being accommodated inside the recessed groove 79. Thereby, it is possible to further reduce the risk of obtrusion when removing the line head 14.

(C-5) Embodiment 5 (FIG. 26)

Embodiment 5 of the process with respect to the problem which occurs when removing the liquid supply path from the line head will be described based on FIG. 26.

As represented in FIG. 26, the line head 14 is provided with a liquid reservoir section 181 which stops outflow downward by retaining liquid in a part in which the first joint 10 is provided that connects the first connecting portion 13 of the first flexible tube 9*a*.

Here "stops outflow" in "stops outflow downward by retaining liquid" is used in the specification to mean not being limited to a structure in which liquid is stopped so as completely not flow out downward, and also including a structure in which it is possible to suppress outflow downward.

According to the embodiment, when the first connecting portion 13 of the first flexible tube 9*a* is removed upward from the first joint 10 of the line head 14, even if liquid drips, it is possible to stop the liquid flowing out downward due to the liquid reservoir section 181. Similarly, it is possible to reduce the risk of the liquid dripping on the medium transport region 19.

Here, since the line head 14 is large and the form is long in comparison to a liquid discharge head of a serial type which reciprocally moves the liquid discharge region, it is easy to secure the location at which the liquid reservoir section 181 which temporarily retains the liquid is provided.

(C-6) Other Configurations (1) Sub-tank

Figure 27:
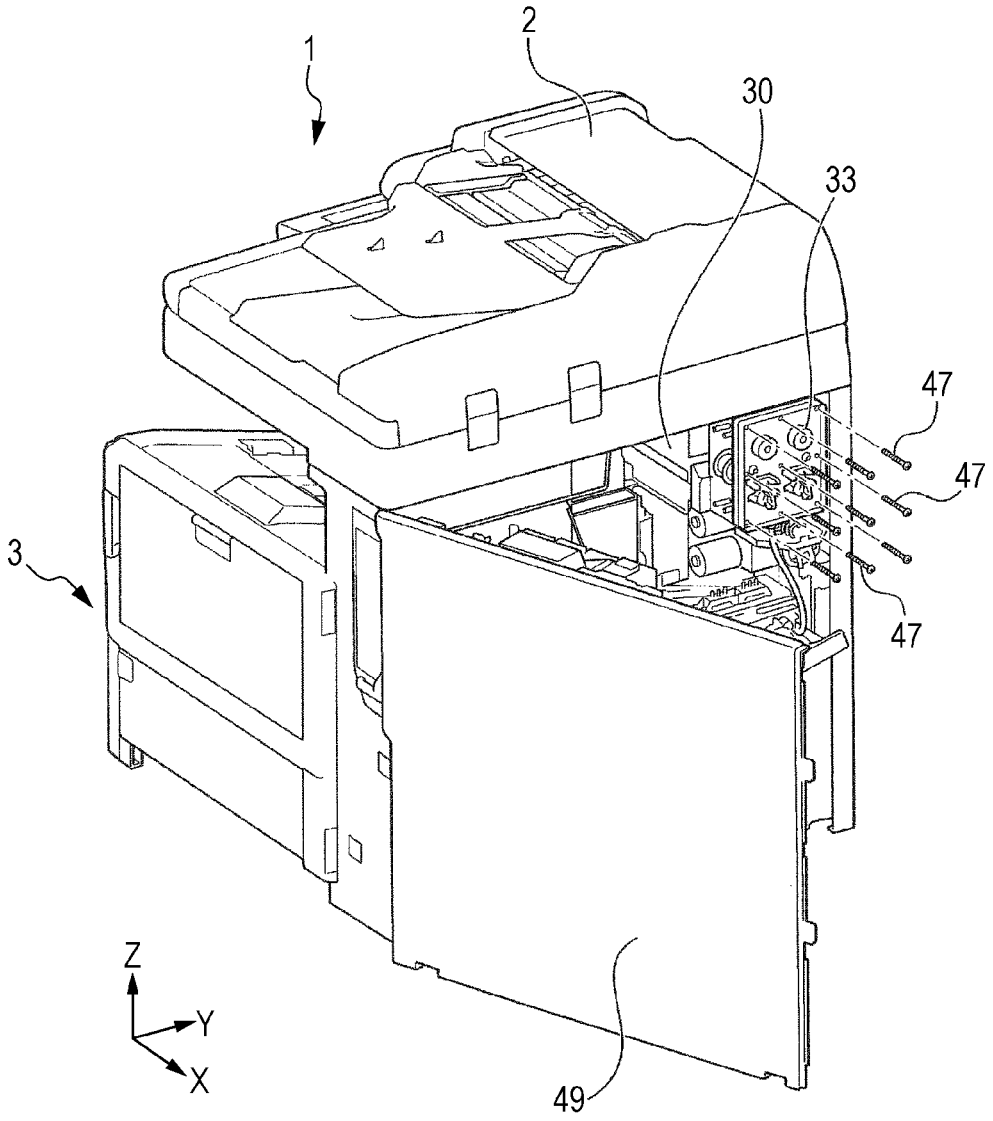
FIG. 27 is a perspective diagram view (from the rear) in a state in which it is possible to gain access to a sub-tank by opening a back surface cover of the liquid ejecting apparatus which is represented in FIGS. 1A and 1B.

As represented in FIGS. 2 to 4 and 27 to 29, a sub-tank 33 which has a liquid chamber 24 which is able to retain liquid is provided on a liquid supply path between the liquid accommodating body 18 and the line head 14 in order to be able to exchange the liquid accommodating body 18 without suspending recording by the line head 14 on the liquid supply path (first flexible tube 9*a* and the like) between the line head 14 and the liquid accommodating body 18. In FIG. 27, a reference numeral 49 is a rear surface cover.

Figure 28:
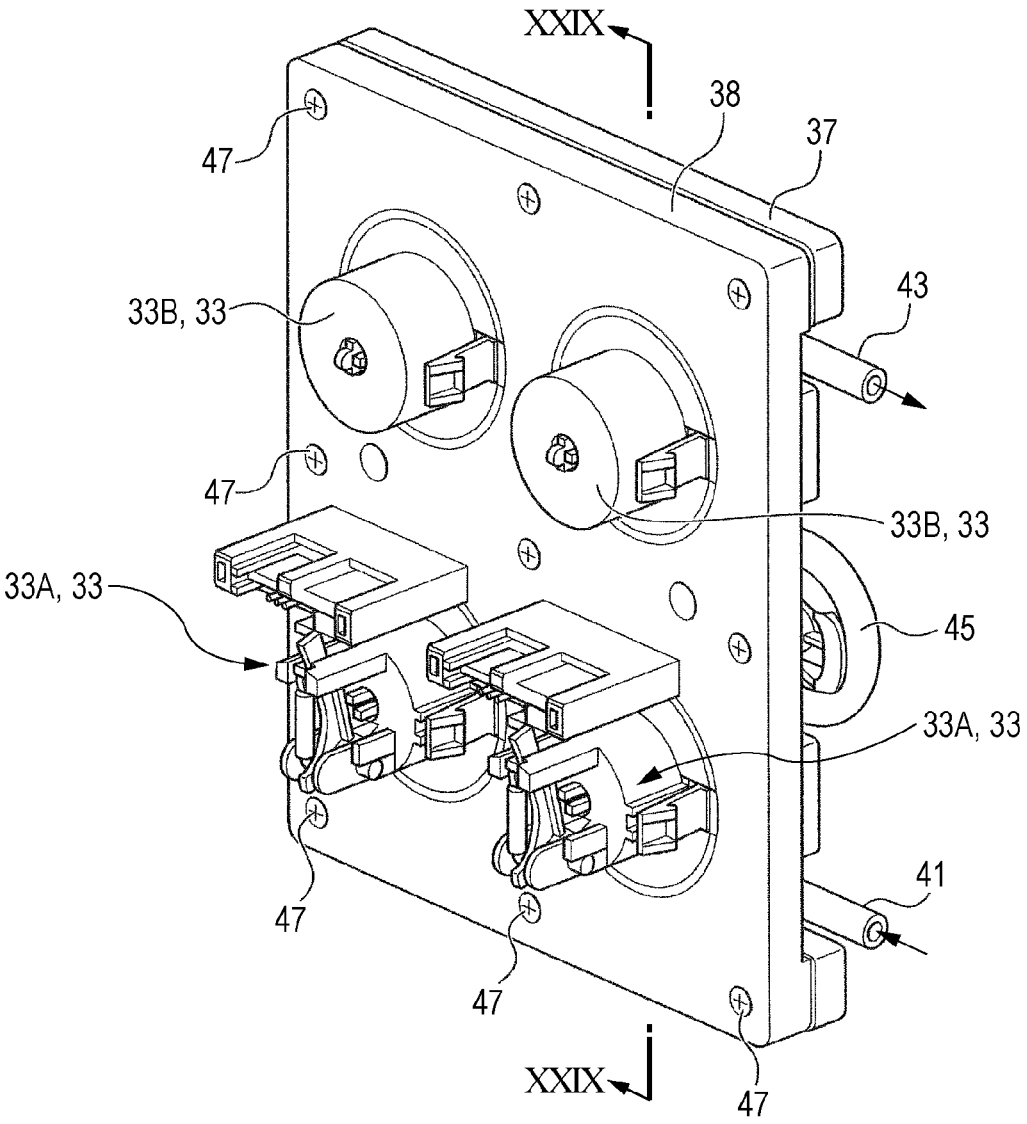
FIG. 28 is a front surface side perspective view of the sub-tank which is represented in FIG. 27.
Figure 29:
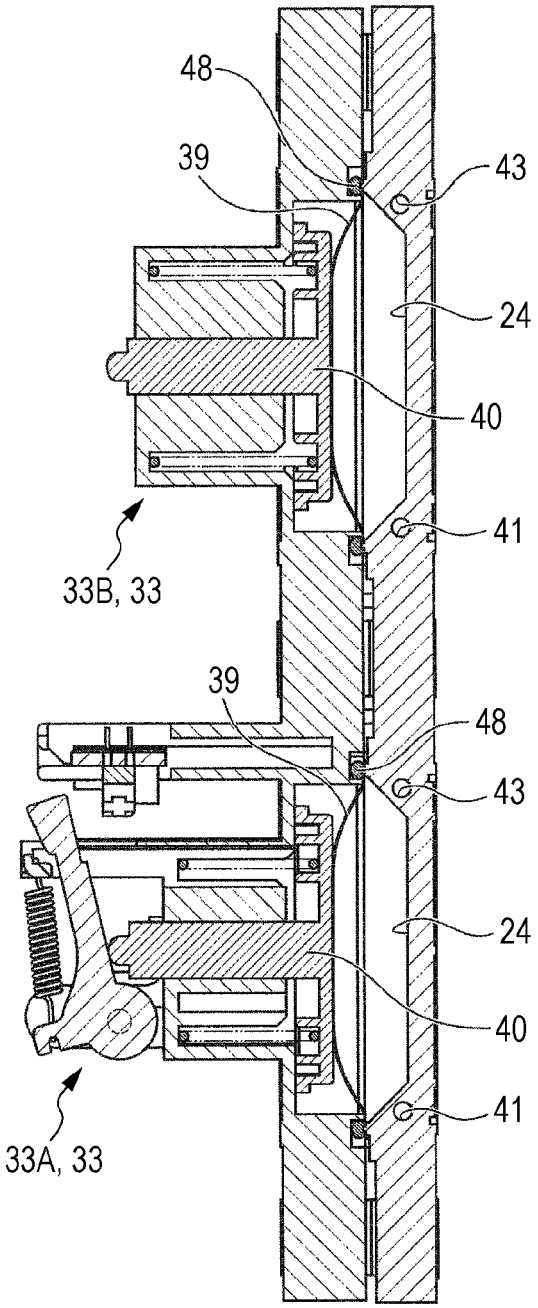
FIG. 29 is a cross sectional diagram along line XXIX-XXIX in FIG. 28.

As represented in FIGS. 28 and 29, the sub-tank 33 includes a set of two of a first sub-tank 33A which is positioned on the upstream side in the flow direction toward the line head 14 of the liquid and a second sub-tank 33B which is positioned on the downstream side. Then, the sub-tank 33 is formed by joining a first plate 37 and a second plate 38 by tightening a screw 47. The respective liquid chambers 24 of the respective sub-tanks 33A and 33B have a surface on which a film 39 is configured, and the film 39 is a pressurized by a biasing member 40. A peripheral edge section of the film 39 blocks out the atmosphere using an O-ring 48. The liquid chamber 24 changes the space area which retains the liquid by displacement of the film 39. The biasing member 40 biases in a direction in which the space area is reduced.

The liquid which is sent by being pressurized by a pressurizing pump 109 (refer to FIG. 36 which will be described later) from inside the liquid accommodating body 18 is retained to be introduced inside the liquid chamber 24 of the first sub-tank 33A from a liquid inlet 41 for the first sub-tank 33A, and furthermore passes through a tube 45 (FIG. 28) out from a liquid outlet 43, again is retained to be introduced inside the liquid chamber 24 of the second sub-tank 33B from the liquid inlet 41 for the second sub-tank 33B, and furthermore is set to the line head 14 side out from the liquid outlet 43.

In the configuration above, the liquid supply path which reaches from the liquid accommodating body 18 to the line head 14 via the sub-tank 33 is in a higher pressure state than atmospheric pressure. For this reason, in a case where the line head 14 is removed from the apparatus main body 3, when the first flexible tube 9*a* is removed simply from the first joint 10 of the line head 14, the liquid inside the first flexible tube 9*a* is ejected. Therefore, the control section which controls each operation (the electronic mounting member 83 which will be described later, FIG. 30) is normally provided with a pressure release sequence for releasing a pressurized state within the liquid supply path.

However, in a case where the pressure release sequence is not normally operated, it is not possible to remove the first flexible tube 9*a* from the first joint 10 of the line head 14.

In the printer 1 of the embodiment, in such a case, it is possible to change the space area of the liquid chamber 24 and thereby it is possible to release the pressurized state by screwing the screw 47 which joins the first plate 37 and the second plate 38 which configure the sub-tank 33. That is, when the first flexible tube 9*a* is removed from the first joint 10 of the line head 14, it is possible to reduce the risk of the liquid inside the first flexible tube 9*a* being ejected.

(2) In the embodiment, the flexible tube 9 is used as the "liquid supply path" on which the liquid is supplied to the line head 14 by connecting the line head 14, but the invention is not limited to the flexible tube 9. At least a portion of the "liquid supply path" may be formed by the flexible tube. That is, the "liquid supply path" may have a structure so as to be held in the holding sections 71 and 79 in a vertical orientation by changing the shape of a portion of the "one portion of the flexible tube" to be removed from the line head 14.

(3) A cover member may be provided between the upper surface 5 of the line head 14 and the liquid supply path. Even if liquid drips during attaching and detaching of the liquid supply path, using the cover member it is possible to reduce the risk of the dripped liquid directly dripping on the line head 14.

(4) Although the details will be described later (FIGS. 35 and 37), a support section 105 (platen, transport belt, and the like) which supports the medium M by facing a nozzle forming surface 81 of the nozzles N of the line head 14 is configured so as to be able to take both positions of a "medium support position 111" and a "retreat position 112", and when the liquid supply path is removed the line head 14, or when the line head 14 is removed from the apparatus main body 3, the support section 105 may be configured to be retreated from directly below the line head 14 and the liquid supply path by being moved to the "retreat position 112". Here, the support section 105 includes the support section (often referred to as a platen) which statically supports the lower surface of the medium M and a support section such as a moving belt which dynamically supports the medium M.

Furthermore, after the support section 105 is moved to the retreat position, a cap member 106 which will be described later that seals the nozzles N by coming into contact with the nozzle forming surface 81 of the line head 14 may be positioned by being moved below the line head 14.

Thereby, it is possible to suppress damage due to liquid dripping.

(5) When the line head 14 is removed from the apparatus main body 3 to be exchanged, for repair, and the like, the control section which controls each operation (the electronic mounting member 83 which will be described later, FIG. 30) may be provided with a sequence in which the support section 105 or the cap member 106 is automatically moved to a position at which it is possible to suppress damage due to liquid dripping.

(6) It is preferable that the first flexible tube 9*a* which is in a state of being removed from the first joint 10 of the line head 14 closes the first connecting portion 13 using a clamp or the like in order to avoid dripping and stains.

(7) As is able to be understood from the description above, a direction in which the connection of the first flexible tube 9*a* is released from the line head 14 is the same direction (up and down direction) as a direction in which the line head 14 is accessed when the line head 14 is removed. Accordingly, workability is good.

(D) Process of a Problem when Removing the Wiping Member from the Installation Location An embodiment of a process with respect to a problem of removing the wiping member, which wipes the nozzle forming surface of the line head, from the installation location will be described below.

The embodiment will be described using mainly FIGS. 2 to 4, and 30 to 37. Here, configuring members which are common with the configuring members in the embodiments of (A), (B), and (C) are given the same reference numerals and the description thereof is omitted.

(D-1) Embodiment 1 (FIGS. 2 to 4 and 30 to 37)

(D-1-1) Configuration

Based on FIGS. 2 to 4, and 30 to 37, Embodiment 1 of the process with respect to the problem of removing the wiping member from the installation location will be described.

As represented in FIGS. 2 to 4, and 30 to 37, the printer 1 of the embodiment is provided with the line head 14 which ejects liquid from the plurality of nozzles N onto the medium M, a wiping unit 91 which has a wiping member (also referred to as a wiper) 82 which is able to wipe the nozzle forming surface 81 (FIGS. 2 and 4) on which the nozzles N are formed, and the electronic mounting member 83 which is configured by an electronic circuit board or the like which governs electronic control. The wiping member 82 is configured so as to be attachable and detachable with respect to the apparatus main body 3 of the printer 1. Then, the electronic mounting member 83 is disposed at a location which is different from below the attachment/detachment path 84 when the wiping member 82 is attached and detached.

As represented in FIGS. 31 to 34, in the embodiment, the main components of the wiping unit 91 are the wiping member 82, a holding section 85, a carriage 86, and a motor 89.

The wiping member 82 is held in the holding section 85. The holding section 85 is attachable and detachable to the carriage 86 by, for example, a screw 87. Thereby, it is possible to remove the wiping member 82 from the carriage 86 in a state of being held in the holding section 85 by removing the screw 87.

The carriage 86 is attached to be movable in a screw shaft 88. The screw shaft 88 is rotated by rotation of the motor 89 being transmitted via a worm cam 90. Due to the rotation of the screw shaft 88, the carriage 86 moves in the first direction F1 which is the longitudinal direction of the screw shaft 88 (the longitudinal direction of the line head 14, a direction which intersects with the direction FM in which the medium M is transported), and the wiping member 82 wipes the nozzle forming surface 81 of the line head 14.

In the FIGS., a reference numeral 104 is a guide, and movement is stabilized in the longitudinal direction (first direction F1) of the screw shaft 88 to slidably support the wiping member 82.

As above, the wiping member 82 is movable in a direction which intersects with the direction FM (longitudinal direction of the line head 14) in which the medium M is moved. Then, the wiping member 82 is configured to be removable in at least a position of the movable direction. In the embodiment, the removable position is on the rear surface side of the printer 1.

Figure 30:
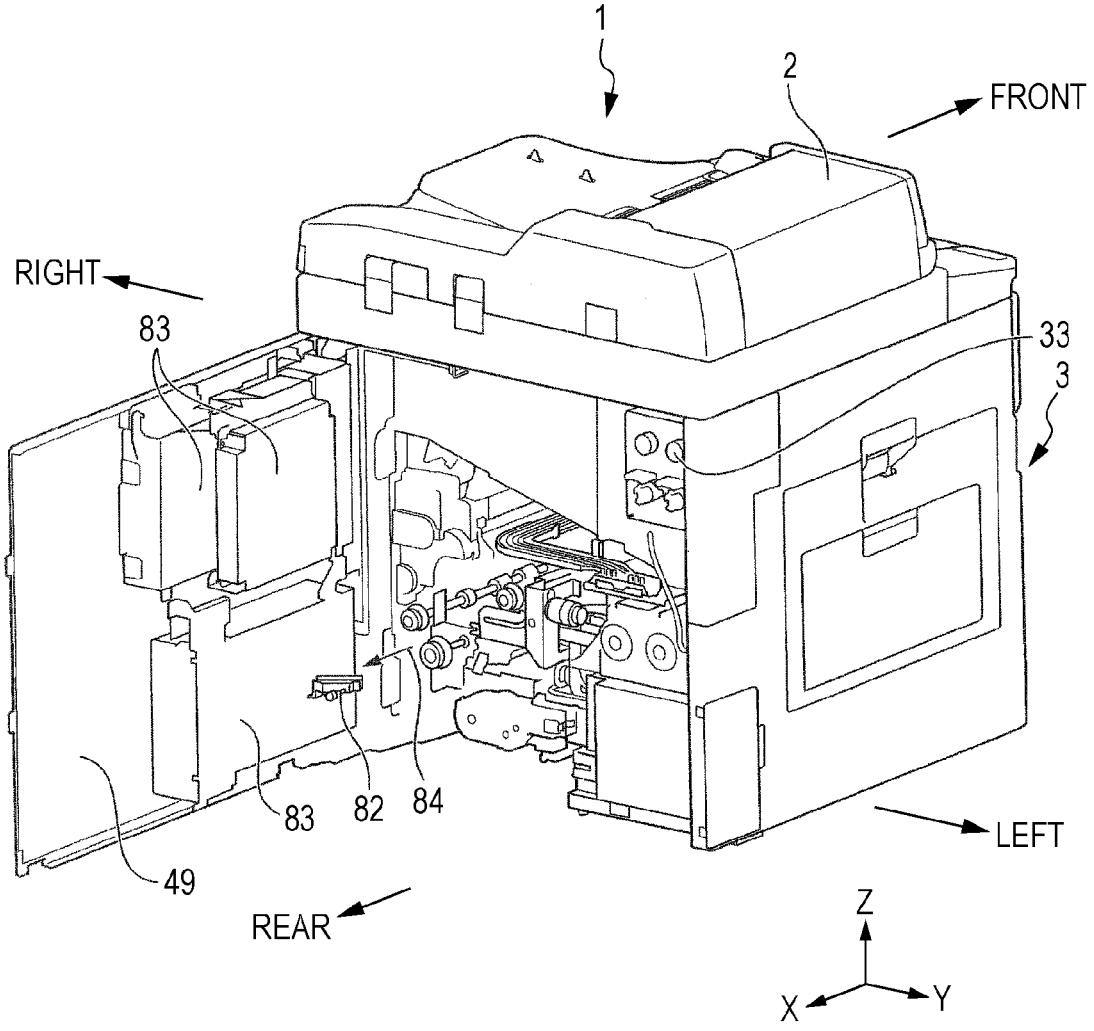
FIG. 30 is a perspective diagram view (from the rear) in a state in which it is possible to gain access to a wiping unit by opening the back surface cover according to the embodiment of the liquid ejecting apparatus which is represented in FIGS. 1A and 1B.

That is, in the embodiment, as represented in FIG. 30, when a rear surface cover 49 of the rear surface of the printer 1 is open, it is possible to gain access to the wiping member 82 which is moved. Thereby, it is possible to remove the wiping member 82 to the outside of the apparatus main body 3 by removing the screw 87 to open the rear surface cover 49.

In addition, in the embodiment, when the wiping member 82 is removed from the apparatus main body 3 of the printer 1, the wiping member 82 is configured so to automatically move to a position for attaching and detaching by the electronic mounting member 83 which is a control section that controls the operation of the motor 89.

In addition, as represented in FIG. 30, in the embodiment, the rear surface cover 49 which forms a casing of the apparatus main body 3 is provided to be openable and closeable as above on a side on which the wiping member 82 is attached and detached with respect to the apparatus main body 3 of the printer 1. The electronic mounting member 83 is attached to the inner surface of the rear surface cover 49. Then, when the rear surface cover 49 is open, the electronic mounting member 83 is configured so as to retreat from the attachment/detachment path 84 of the wiping member 82.

That is, in the normal state in which the rear surface cover 49 is closed, the electronic mounting member 83 is positioned in the attachment/detachment path 84. However, when the rear surface cover 49 is open in order to remove the wiping member 82, the electronic mounting member 83 automatically retreats from the attachment/detachment path 84 of the wiping member 82.

Here, when the wiping member 82 is attached and detached with respect to the printer 1, the attachment/detachment path 84 is a region in which there is a possibility that the wiping member 82 passes through due to the attachment and detachment operation. Simply put, having the meaning of a work region of when the wiping member 82 is attached and detached.

In addition, in the structure above, in the specification, "attachable and detachable" in the wiping member 82 is attachable and detachable with respect to the apparatus main body 3 of the printer 1" uses a meaning including both attaching and detaching a portion of the wiping member 82 which wipes by coming into contact with the nozzle forming surface 81 in order to exchange or repair, and attaching and detaching a portion or the entirety of the wiping unit 91 in order to exchange or repair.

In the embodiment, as above, the wiping member 82 and the holding section 85 are attachable and detachable, but there may be a configuration in which only the wiping member 82, or alternatively the entire wiping unit 91 are attachable and detachable.

Removal of Wiping Member

Here, the case of removing the wiping member 82 from the installation position within the printer 1 in the embodiment will be described in process order based on FIGS. 30 to 34.

(1) First, the rear surface cover 49 of the rear surface of the printer 1 is open (FIG. 30). Thereby, the electronic mounting member 83 automatically retreats from the attachment/detachment path 84 of the wiping member 82.

(2) In the embodiment, the wiping member 82 automatically moves to a position at which it is possible to be removed due to the rotation by the screw shaft 88. In a case where such automatic movement is not configured, the wiping member 82 is moved to the position at which it is possible to be removed.

(3) Next, it is possible to remove the wiping member 82 from the carriage 86 in a state of being held in the holding section 85 by removing the screw 87. At that time, since the electronic mounting member 83 retreats from the attachment/detachment path 84 of the wiping member 82, even when liquid drips from the wiping member 82, the risk of liquid attaching to the electronic mounting member 83 is slight.

Here, in the embodiment, a case in which only a portion of the wiping member 82 and the holding section 85 is removed is described, but in a case of a structure in which the entire wiping unit 91 is removed, the entirety is removed.

(D-1-2) Effects

According to the embodiment, since the electronic mounting member 83 such as an electronic circuit board is disposed at a location which is different from below the attachment/detachment path 84 (an inside surface of the rear surface cover 49 in an open state) when the wiping member 82 is attached and detached, it is possible to reduce the risk of liquid which is attached to the wiping member 82 dripping on the electronic mounting member 83 when the wiping member 82 is removed from the installation location for exchange or repair.

In addition, in the case of the elongated line head 14, there are many cases in which the line head 14 does not move, and the wiping member 82 wipes by being moved along the nozzle forming surface 81 of the line head 14. According to the embodiment, since such a movable wiping member 82 is removable from at least the one movable direction, it is possible to easily perform removal of the wiping member 82 for exchange, repair, or the like.

According to the embodiment, the electronic mounting member 83 such as an electronic circuit board is attached to the inner surface of the openable and closeable rear surface cover 49 which is provided in the casing, and retreats from the attachment/detachment path 84 of the wiping member 82 due to the cover 49 being open. Thereby, it is possible to retreat the electronic mounting member 83 which is positioned in the attachment/detachment path 84 other than when maintenance is carried out on the wiping member 82 from the attachment/detachment path 84 by opening the cover 49 when maintenance is carried out on the wiping member 82. Accordingly, it is possible to come to be in a state in which a risk that the liquid in the electronic mounting member 83 drips is reduced by opening the cover 49 when the wiping member 82 is removed from the installation location.

(D-2) Embodiment 2 (FIGS. 31 to 34, and 36)

Based on FIGS. 31 to 34 and 36, Embodiment 2 of the process with respect to the problem of removing the wiping member from the installation location will be described.

As represented in FIGS. 31 to 34, and 36, in the printer 1 of the embodiment, the holding section 85 which holds the wiping member 82 is provided with a retaining section 92 which retains liquid which is wiped from the nozzle forming surface 81 due to the wiping operation. It is necessary to discharge the liquid which is accumulated in the retaining section 92 from the retaining section 92 before becoming full.

As a discharge unit, an engagement member 93 which engages with the holding section 85 is provided at the movement end at which the wiping member 82 moves. The engagement member 93 of the embodiment is provided with a suction needle 97 which has a suction path inside as a communication section 96 which communicates with the liquid reservoir section 92 in a state of engaging with the holding section 85. Meanwhile, the holding section 85 is provided with a receiving hole 101 into which the suction needle 97 is received, and the receiving hole 101 is provided with a valve 102 which opens and closes the flow path by insertion and removal of the suction needle 97.

Figure 36:
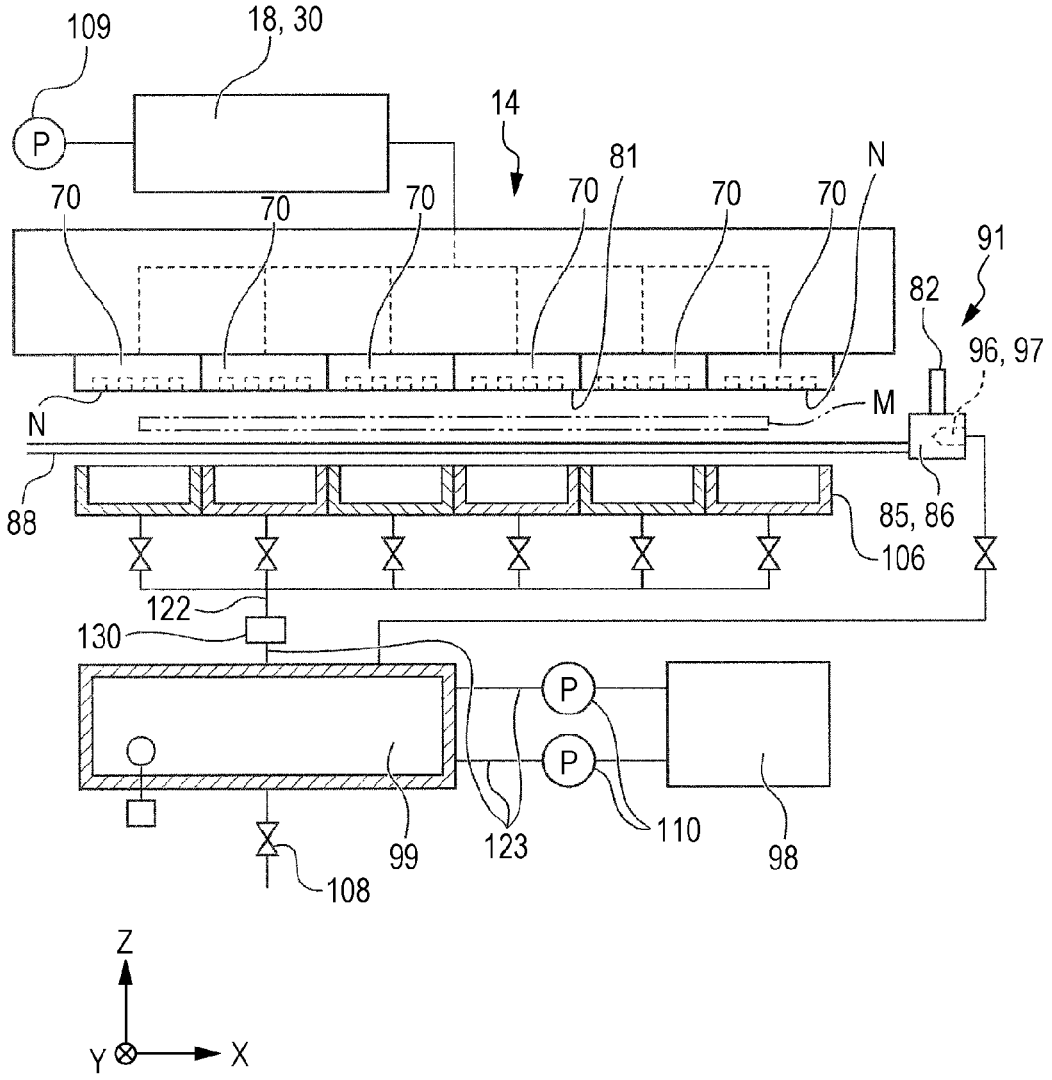
FIG. 36 is a schematic view which represents a positional relationship of the line head and the wiping member according to an embodiment of the liquid ejecting apparatus which is represented in FIGS. 1A and 1B.

As represented in FIG. 36, negative pressure is applied by a pump 110 which is a suction section in the communication section 96. The liquid within the retaining section 92 is discharged due to the application of the negative pressure, and is sent to a waste liquid retaining section 98. In FIG. 36, a reference numeral 99 is a vacuum chamber. Here, the pump 110, the waste liquid retaining section 98, and the vacuum chamber 99 serve as being provided with respect to the cap member 106 which will be described later (FIGS. 36, 37, and 38 hereinafter).

The engagement of the engagement member 93 with the wiping member 82 (insertion of the suction needle 97 in the receiving hole 101) is executed in each wiping operation. Here, the engagement need not be executed in each wiping operation.

The wiping member 82 is movable to an attaching and detaching position 95 (the position in FIG. 32) from the engaging position 94 (the position in FIG. 31) with the engagement member 93 when removed from the apparatus main body 3 of the printer 1. It is desirable that the movement from the engaging position 94 to the attaching and detaching position 95 is configured so as to be automatically executed by a command for removing the wiping member 82 from the printer 1 being sent to the electronic mounting member 83 (control section).

According to the embodiment, when the wiping member 82 is removed from the printer 1, since the wiping member 82 is movable to the attaching and detaching position 95 from the engaging position 94 in the movement end, it is possible to easily remove the wiping member 82 for exchange, repair, or the like.

In addition, liquid is accumulated due to wiping by moving the wiping member 82, and the liquid is retained in the liquid reservoir section 92 of the wiping member 82. When the wiping member 82 moves to the engaging position 94 and engages with the engagement member 93, due to the engagement, the communication section 96 of the engagement member 93 comes to be in a linking state by being inserted in the receiving hole 101 of the liquid reservoir section 92. In the linking state, the liquid which is accumulated in the liquid reservoir section 92 is discharged due to a negative pressure from the pump 110 (FIG. 36) which is a suction section acting on the communication section 96.

Furthermore, when the wiping member 82 is removed from the printer 1, since the wiping member 82 is movable to the attaching and detaching position 95 by releasing the linking state with the communication section 96 at the engaging position 94 on the movement end, it is possible to easily remove the wiping member 82 for exchange, repair, or the like.

Figures 31A, 31B, 31C, 31D:
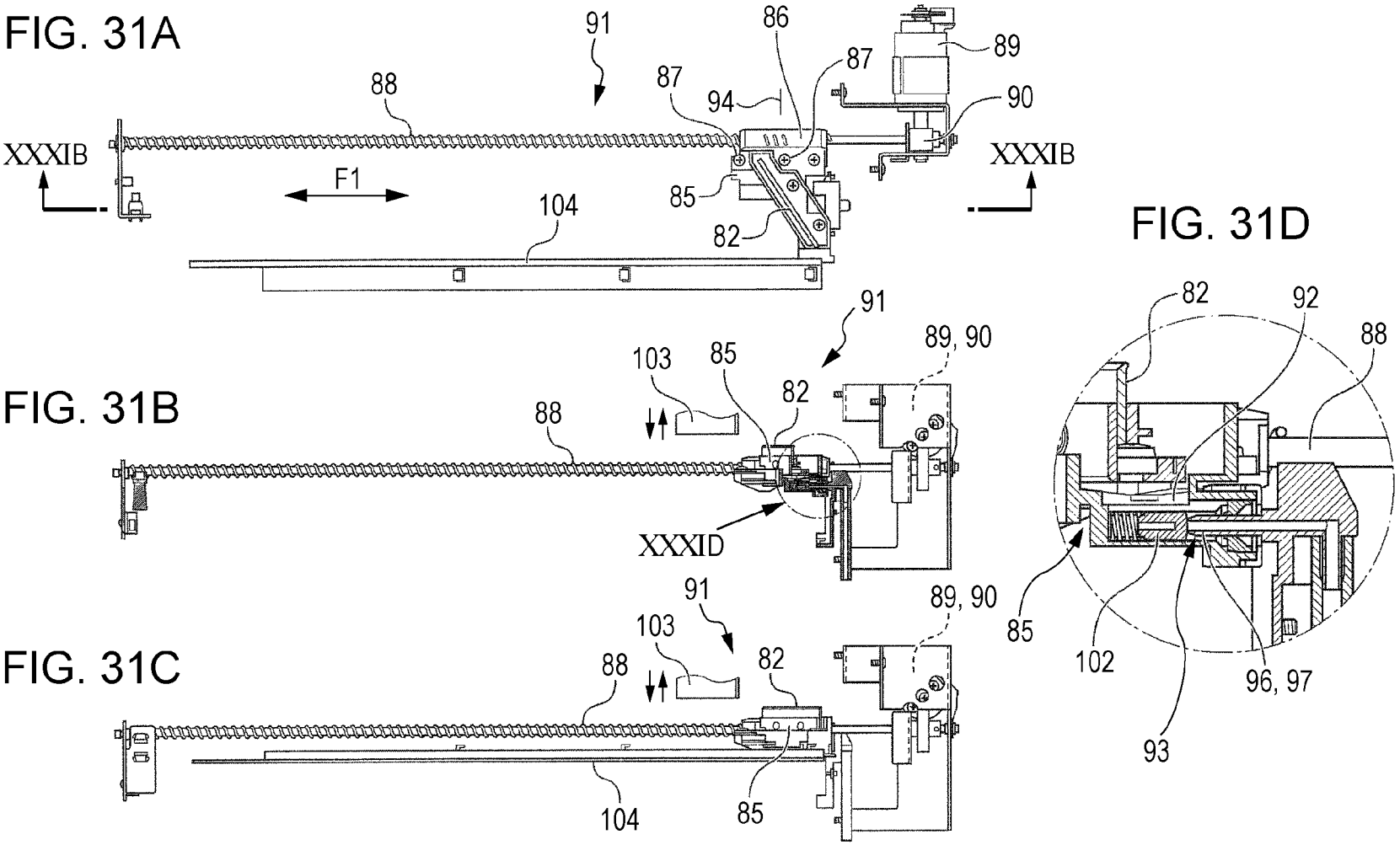
FIG. 31A is a planar view of the wiping unit of the embodiment.
FIG. 31B is a sectional view along line XXXIB-XXXIB in the planar view FIG. 31A.
FIG. 31C is a front surface view.
FIG. 31D is a main section enlarged sectional view.
Figures 32A, 32B, 32C, 32D:
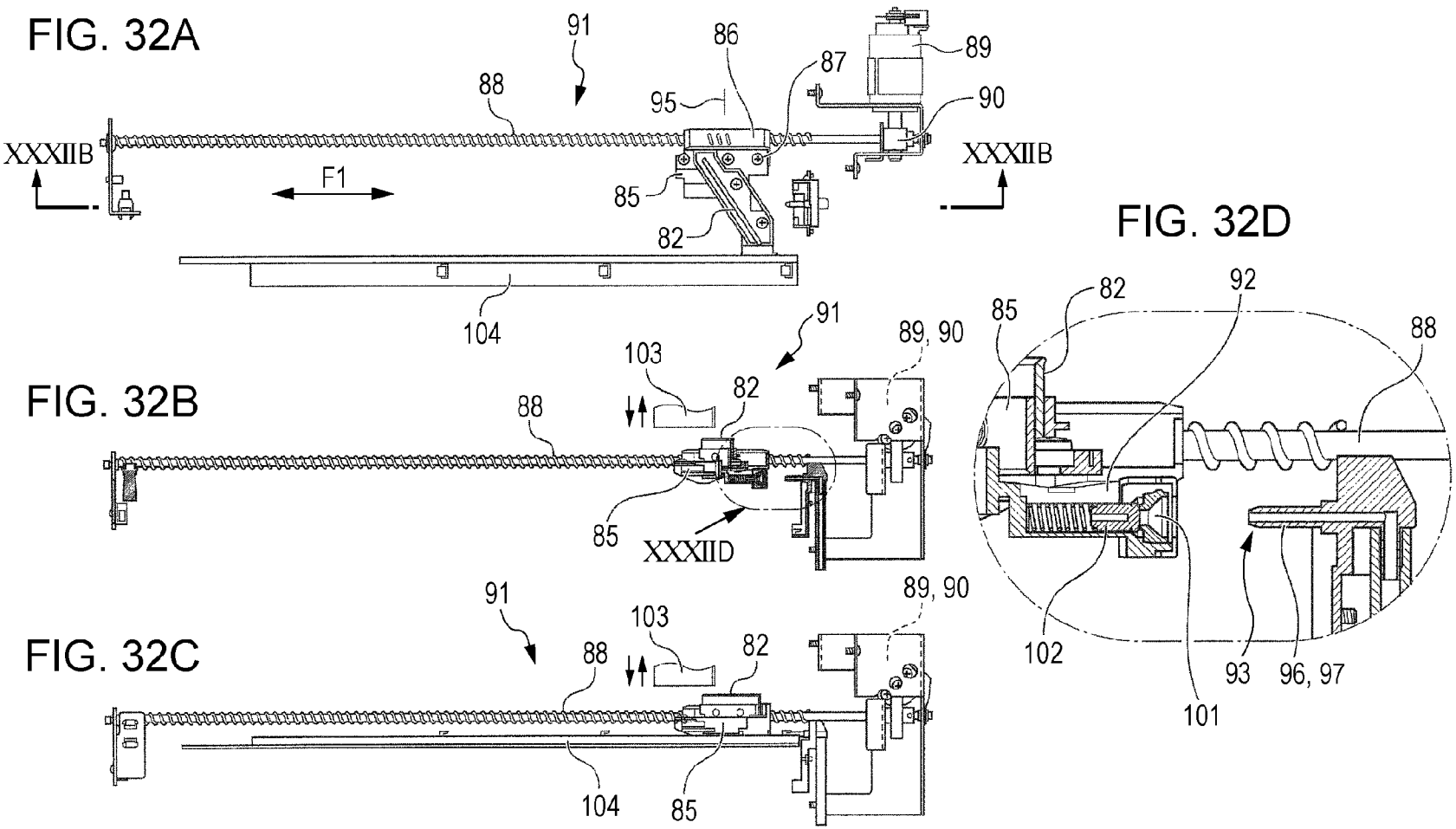
FIG. 32A is a planar view of the wiping unit of the embodiment.
FIG. 32B is a sectional view along line XXXIIB-XXXIIB in the planar view FIG. 32A.
FIG. 32C is a front surface view.
FIG. 32D is a main section enlarged sectional view.
Figure 33:
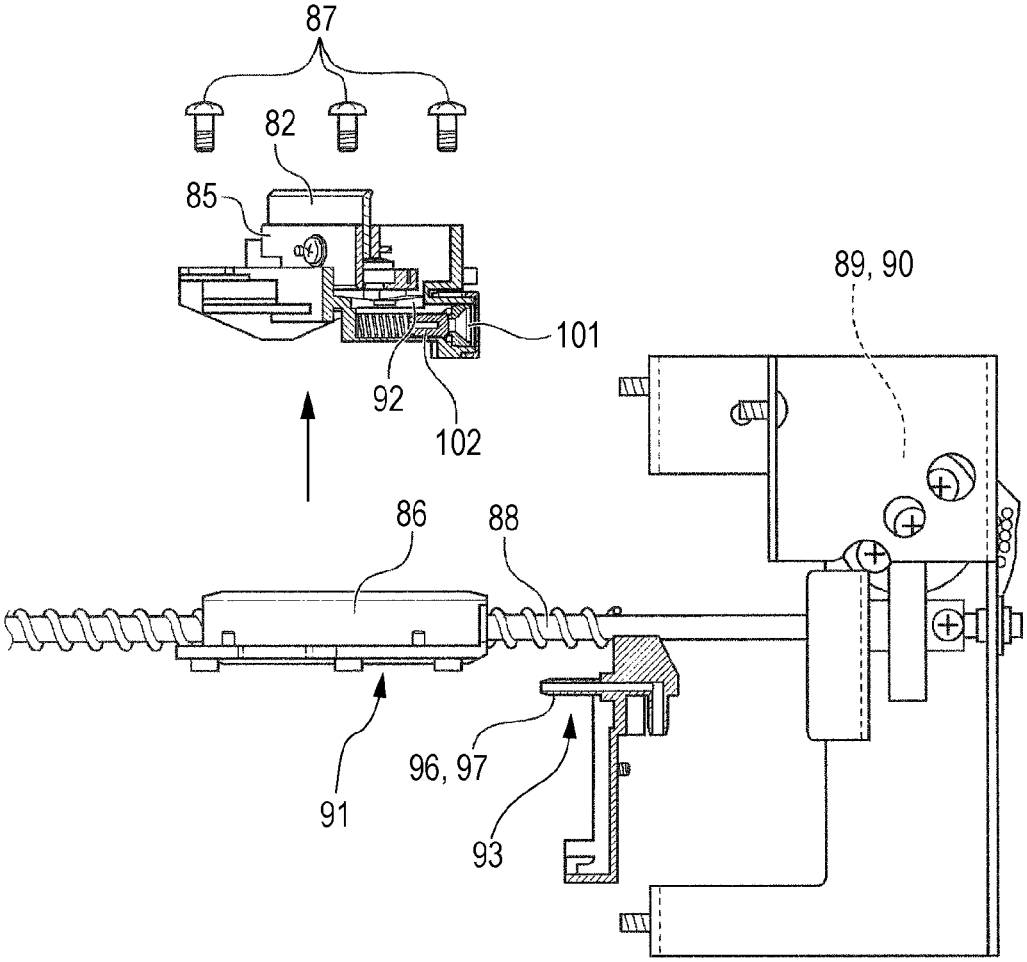
FIG. 33 is a main section enlarged exploded sectional view in which the wiping member is removed from the wiping unit of the embodiment.
Figure 34:
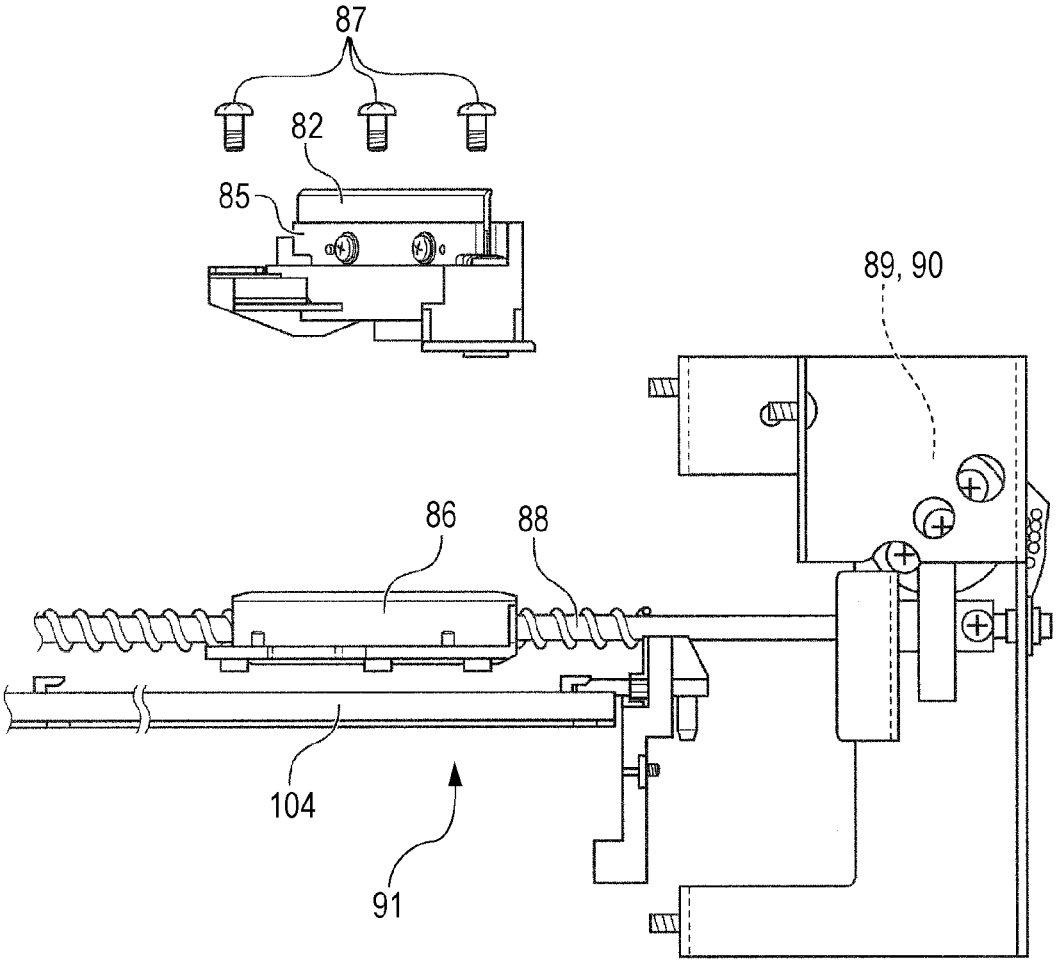
FIG. 34 is a main section enlarged front surface view in which the wiping member is removed from the wiping unit of the embodiment.

(D-3) Embodiment 3 (FIGS. 31 and 32)

Based on FIGS. 31 and 32, Embodiment 3 of the process with respect to the problem of removing the wiping member from the installation location will be described.

As represented in FIGS. 31 and 32, in the printer 1 of the embodiment, a cleaning section 103 is provided which cleans the wiping member 82. The cleaning section 103 is provided on the motor 89 side, and is movable up and down. When cleaning the wiping member 82, the cleaning section 103 is moved down to a cleaning position. When not cleaning, the cleaning section 103 moves to the retreat position. In addition, the cleaning section 103 is configured so as to be attachable and detachable in the same direction as the wiping member 82.

According to the embodiment, when the cleaning section 103 which cleans the wiping member 82 is removed in order to repair, exchange, or the like, in the same manner, it is possible to reduce the risk of liquid dripping on the electronic mounting member 83 such as an electronic circuit board.

(D-4) Other Configurations (1) In the embodiment, the attachment and detachment direction of the cleaning section 103 is described as being the same as the attachment and detachment direction of the wiping member 82, but may be configured so as to be attachable and detachable on the opposite side.

Figure 37A:
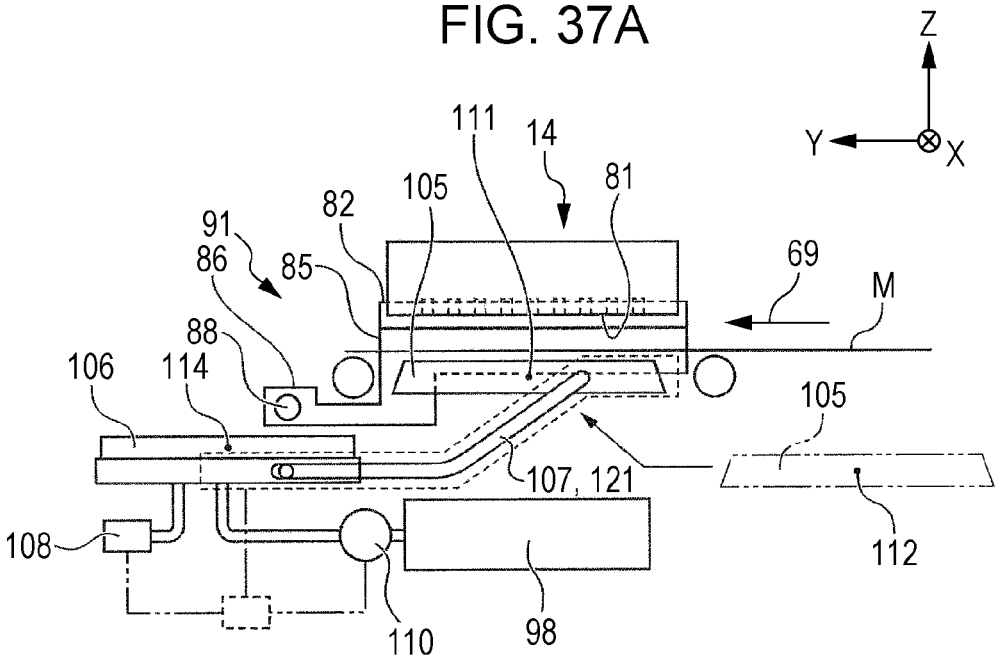
FIG. 37A is a schematic view which represents a positional relationship of the line head and the wiping member according to the embodiment of the liquid ejecting apparatus which is represented in FIGS. 1A and 1B, in a state in which a support section is in a support position in a separated state of a cap member.
Figure 37B:
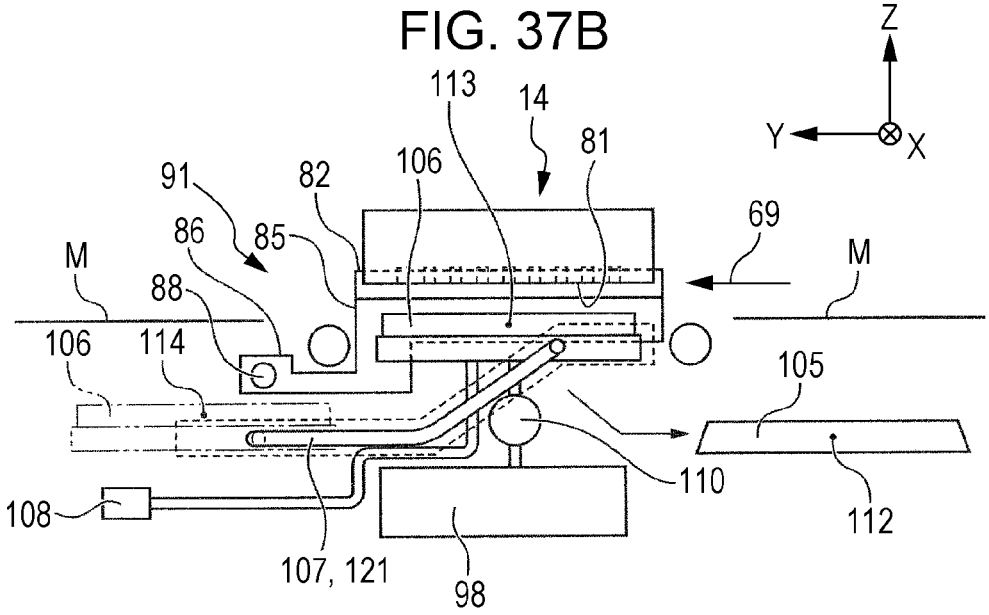
FIG. 37B is a schematic view which represents a positional relationship of the line head and the wiping member according to the embodiment of the liquid ejecting apparatus which is represented in FIGS. 1A and 1B, in which the support section is in a retreat state in a sealing state by the cap member.
Figure 38:
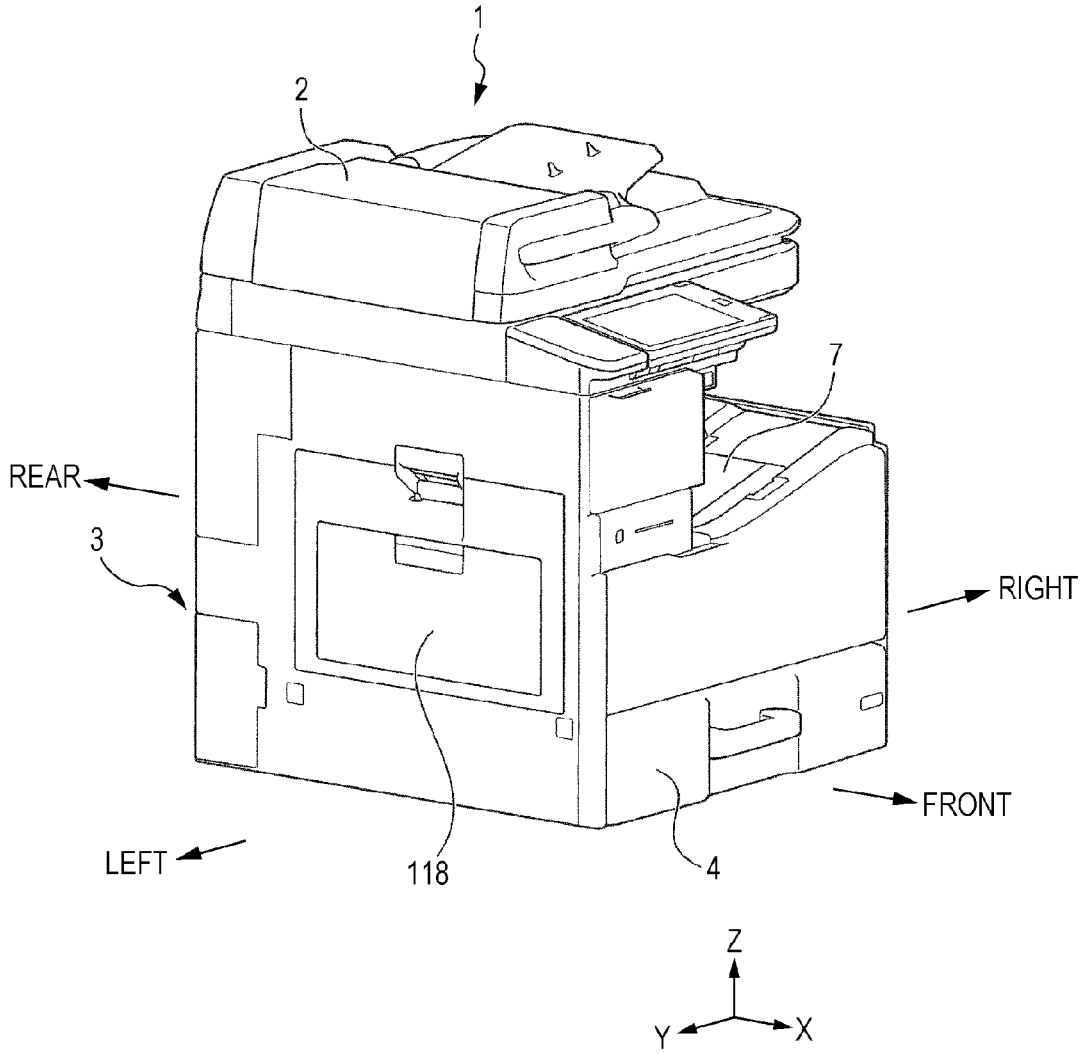
FIG. 38 is a perspective view on a left side surface according to the embodiment of the liquid ejecting apparatus which is represented in FIGS. 1A and 1B.

(2) As represented in FIG. 37, the support section 105 (platen, transport belt, and the like) which supports the medium M facing the forming surface of the nozzles N of the line head 14 may be configured such that it is possible to be taken from both directions of the medium support position 111 (FIG. 37A) and the retreat position 112 (FIG. 37B), and configured so as to be retreated from directly below the line head 14 and the liquid supply path by the support section 105 being moved to the retreat position 112 (FIG. 37B) when the wiping member 82 is removed in order to repair, exchange, or the like. Here, the support section 105 includes the support section (often referred to as a platen) which statically supports the lower surface of the medium M, and a support section such as a moving belt which dynamically supports the medium M. In FIGS. 35 and 37, the support sections are platens.

Furthermore, the cap member 106 which seals the nozzles N by coming into contact with the nozzle forming surface 81 of the line head 14 may also be caused to retreat to a retreat position 114 (FIG. 37A) which is separated from a sealing position 113 (FIG. 37B). In the drawings, a reference numeral 107 is a guide rail which guides the movement between each position of the cap member 106, and a reference numeral 108 is an air release mechanism.

Thereby, it is possible to suppress damage due to dripping from the wiping member 82.

(3) When the wiping member 82 is removed in order to repair, exchange, or the like, the control section which controls each operation may be provided with a sequence which moves the wiping member 82 to the attaching and detaching position 95, and automatically moves the support section 105 and/or the cap member 106 to the retreat positions 112 and 114.

(4) As represented in FIGS. 35 and 36, the wiping member 82 is provided such that removal from the installation position within the apparatus main body 3 is performed on the lower side of the transport path 69.

Thereby, since removal of the wiping member 82 is performed on the lower side of the transport path 69, even if the liquid drips when the wiping member 82 is removed from the printer 1, it is possible to reduce the risk of dripping on the transport path 69.

(E) Process of a Problem when Removing the Cap Member from the Installation Location with Respect to the Line Head An embodiment of a process with respect to a problem of removing the cap member from the installation location with respect to the line head will be described below.

The embodiment will be described using mainly FIGS. 35 to 37, and 38 to 46. Here, configuring members which are common with the configuring members in the embodiments of (A), (B), (C), and (D) are given the same reference numerals and the description thereof is omitted.

(E-1) Embodiment 1 (FIGS. 35 to 37, and 38 to 45)

(E-1-1) Configuration

Based on FIGS. 35 to 37, and 38 to 45, Embodiment 1 of the process with respect to the problem of removing the cap member from the installation location with respect to the line head will be described.

Figure 39:
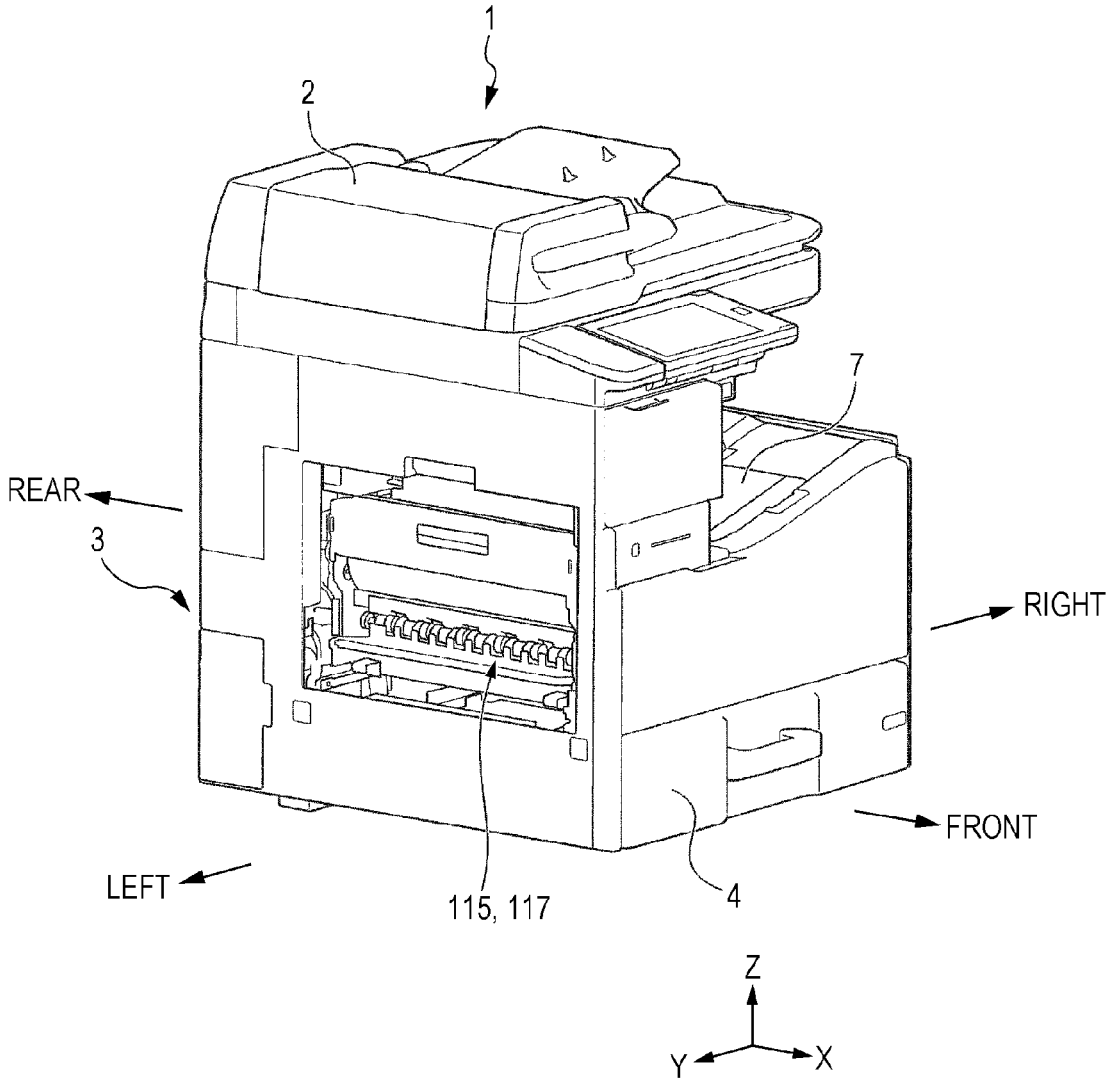
FIG. 39 is a perspective view which represents a state in which a cover on the left side surface is removed from the state in FIG. 38.
Figure 40:
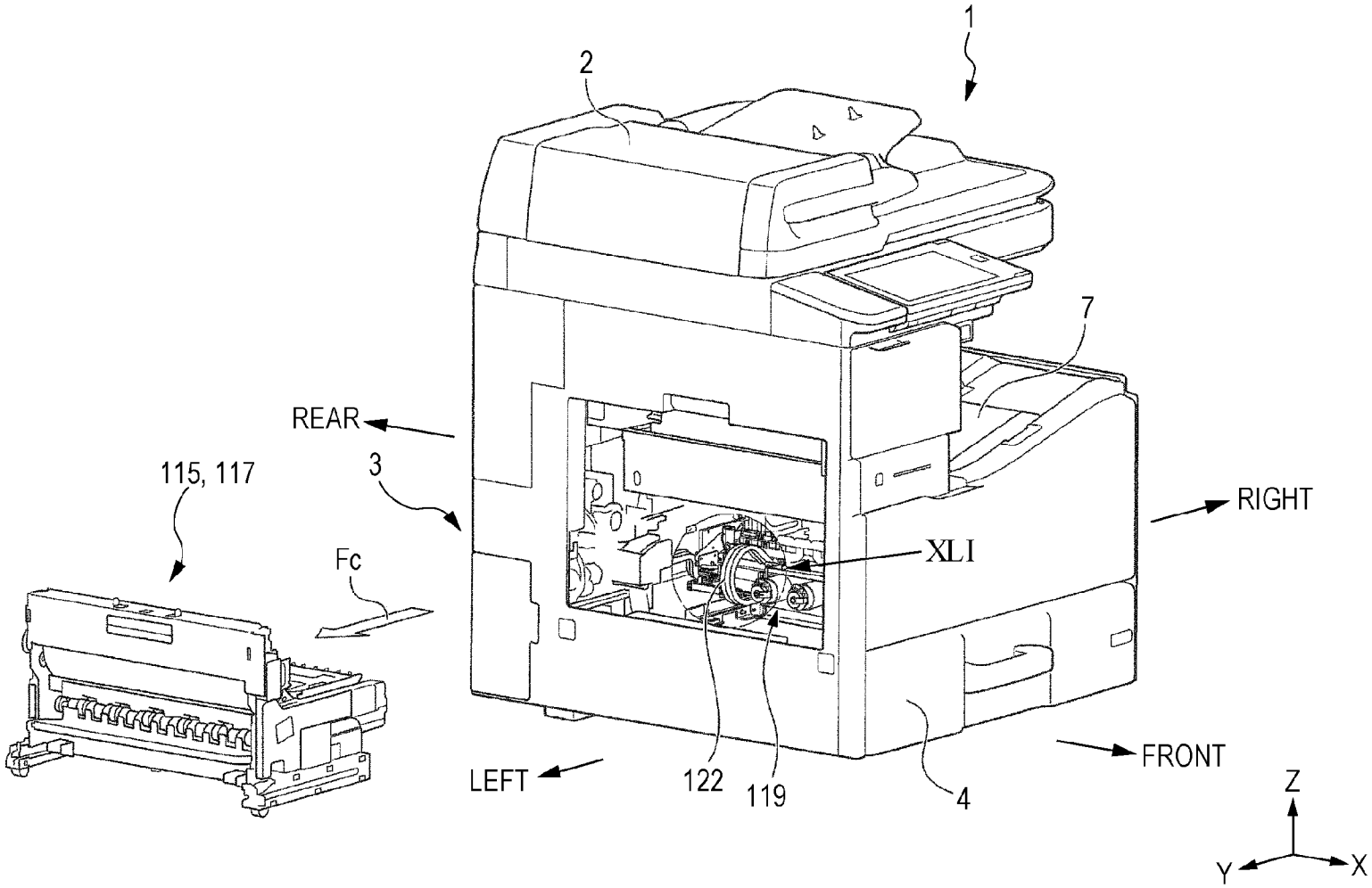
FIG. 40 is a perspective view which represents a state in which a discharge unit is removed from the state in FIG. 39.

As represented in FIGS. 35 to 37, and 38 to 45, the printer 1 of the embodiment is provided with the line head 14 which ejects liquid from the plurality of nozzles N with respect to the transported medium M, the cap member 106 which is able to seal the line head 14, and the transport path 69 on which the medium M is transported. A portion of the transport path 69 is the attaching and detaching unit 115 which is attachable and detachable with respect to the apparatus main body 3 of the printer 1 (FIG. 40).

The cap member 106 is configured so as to be able to be removed in a direction Fc (FIGS. 35, 40, and 44) which is the same as the attaching and detaching unit 115 in a state in which the attaching and detaching unit 115 is removed. The Fc direction is the left direction of the printer 1. An openable and closeable cover 118 is provided in a casing which forms the left surface of the apparatus main body 3 (FIG. 38).

As described based on FIGS. 36 and 37, the cap member 106 seals the nozzles N by coming into contact with the nozzle forming surface 81 while the line head 14 is not being used. The cap member 106 moves to the sealing position 113 (FIG. 37B) and the retreat position 114 (FIG. 37A) to be guided to the guide rail 107. When the negative pressure is applied by the pump 110 which is a suction section to the cap member 106 which is at a sealing position, liquid is suction discharged from the nozzles N of the line head 14. The liquid within the cap member 106 which is discharged is sent to the waste liquid retaining section 98.

As represented in FIG. 35, the attaching and detaching unit 115 is a discharge unit 117 which discharges the medium M which has a bent reverse path 116 to the outside of the transport path 69.

There are times when the transport path 69 of the medium M generates trouble such as clogging (also called "jamming") during transport of the medium M. It is easy for the trouble process to be performed by configuring a portion or the entirety of the transport path 69 to be attachable and detachable with respect to the apparatus main body 3 of the printer 1. In the embodiment, other than the discharge unit 117, a portion which is positioned directly below the discharge tray 7 is configured so as to be attachable and detachable in order to remove the line head 14 from above (FIGS. 20, 21, and 35).

In the structure above, in the specification, "removed" in "the cap member 106 . . . (omitted) . . . is able to be removed" uses a meaning including both removing the cap member 106, which is a member that seals by coming into direct contact with the nozzle forming surface 81 of the line head 14, in order to exchange or repair, and removing a portion or the entirety of a cap unit 119 (FIG. 44), which includes a holding section 126 (FIG. 44) which holds the cap member 106, a movement mechanism 121 related to a sealing operation of the cap member 106, and the like in order to exchange or repair.

The cap member 106 is provided on the cap unit 119 to be movable between the sealing position 113 (FIG. 37B) and the retreat position 114 (FIG. 37A) with respect to the nozzle forming surface 81 of the line head 14 due to the movement mechanism 121.

In the embodiment, the cap unit 119 is configured to be removable from the apparatus main body 3 of the printer 1 in a state of being mounted by the cap member. The movement mechanism 121 is provided with a guide rail 107, a driving mechanism (not shown in the drawings) for moving by guiding along the guide rail 107, and the like, and the operation is controlled by the control section (electronic mounting member 83).

Figure 41:
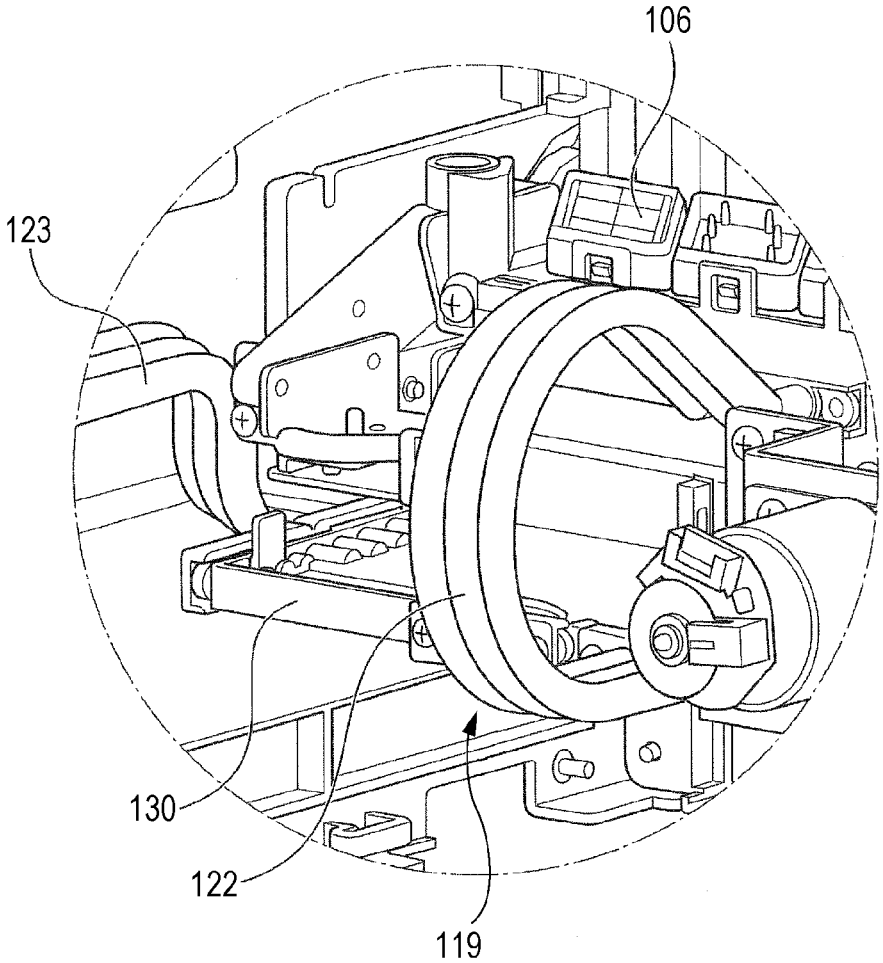
FIG. 41 is a main section enlarged perspective view of FIG. 40.

Furthermore, as represented in FIGS. 36, 40, and 41, the pump 110 which is a suction section which suctions liquid within the line head 14 by negative pressure acting on the cap member 106, and a first tube 122, one part of which is connected to the cap member 106 side, and the other part is connected to the pump 110 side are provided. The first tube 122 is configured so as to be able to release the connection of the pump 110 side and the connection in the direction in which the cap member 106 is removed.

In the embodiment, as represented in FIGS. 36 and 41, a relay flow path 130 is provided between the pump 110 and the first tube 122. That is, the other of the first tube 122 is connected to the relay flow path 130. The relay flow path 130 and the pump 110 are connected using a second tube 123.

Removal of Cap Unit (1) First, the cover 118 which is provided in the casing on the left side is removed with respect to the printer 1 in the state in FIG. 38 (FIG. 39). Thereby, it is possible to gain access to the attaching and detaching unit 115 (discharge unit 117) which forms a portion of the transport path 69.

(2) As represented in FIG. 40, the attaching and detaching unit 115 (discharge unit 117) is pulled out in the direction Fc (apparatus leftward). The attaching and detaching unit 115 (discharge unit 117) is pulled out to be guided on a rail (not shown in the drawings) on the apparatus main body 3 side. By the pulling out, it is possible to gain access to the cap unit 119 which is positioned that deep.

(3) Next, the connection of the relay flow path 130 to the first tube 122 is released. The direction of the release is the same as the direction Fc in which the attaching and detaching unit 115 (discharge unit 117) is removed from the apparatus main body 3. Thereby, the state comes to be in the state of FIG. 42. The first tube 122 is flexible, but rigidity is relatively high, and has a posture of a substantially straight line as represented in the drawing in a state in which the connection is released.

Figure 42:
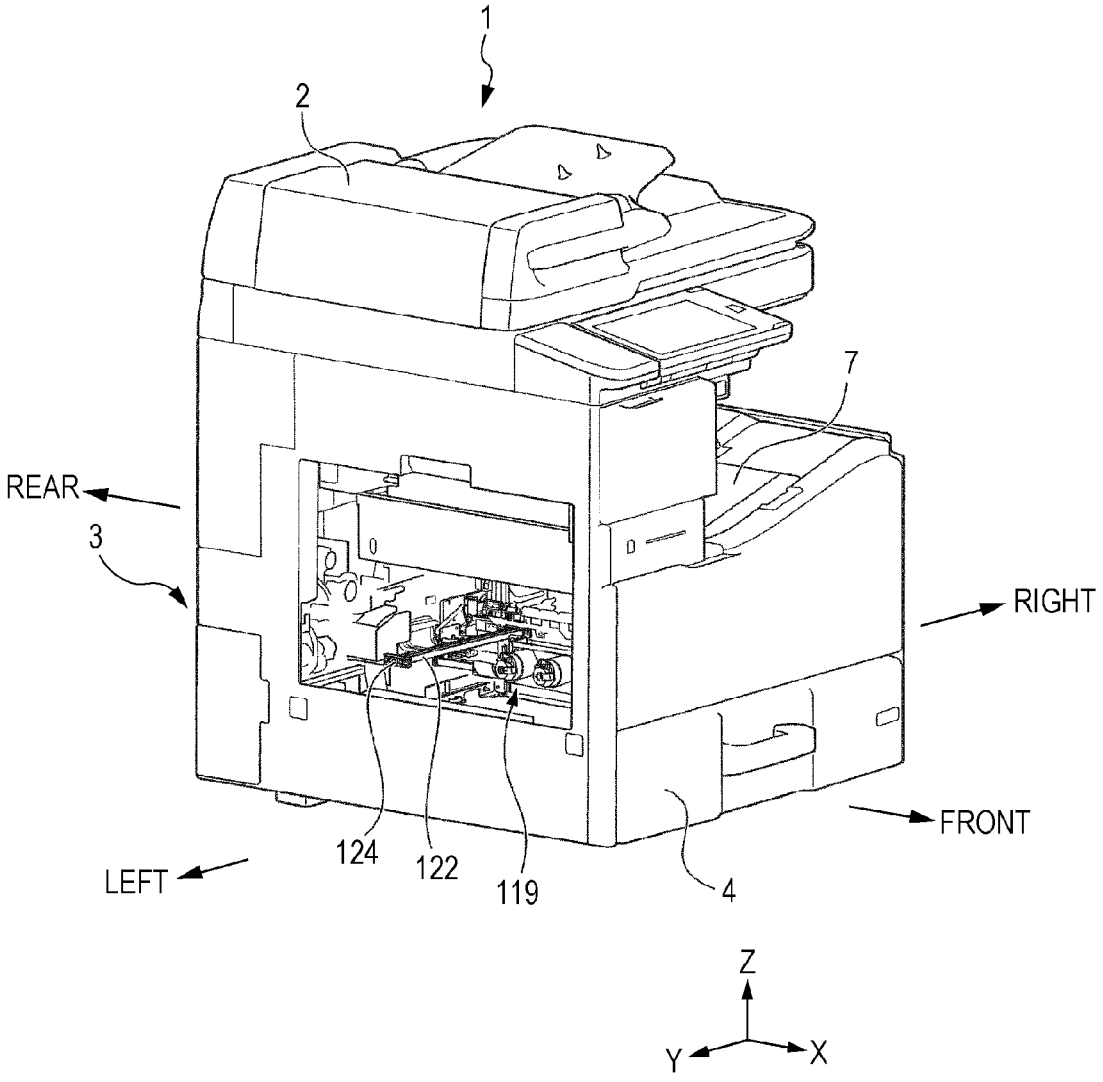
FIG. 42 is a perspective view which represents a state in which an end of a first tube is removed from a relay flow path from the state in FIG. 40.
Figure 45:
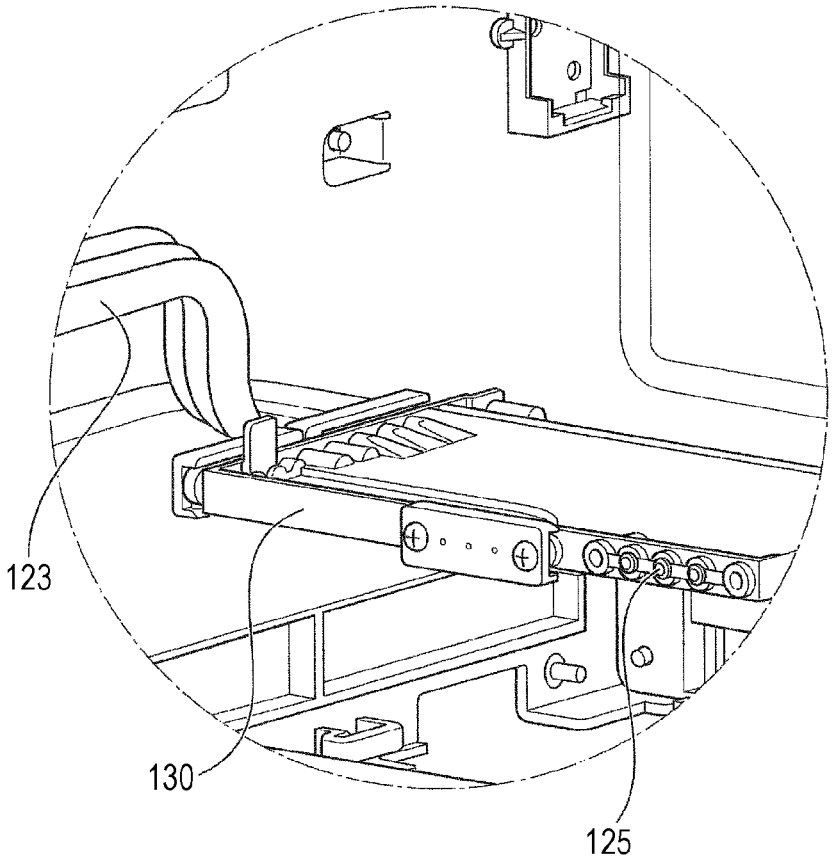
FIG. 45 is a main section enlarged perspective view of FIG. 44.

In FIG. 42, a reference numeral 124 is a connecting section of the relay flow path 130. A reference numeral 125 in FIG. 45 is a joint section on the side of the relay flow path 130 which is connected by the connecting section 124.

Figure 43:
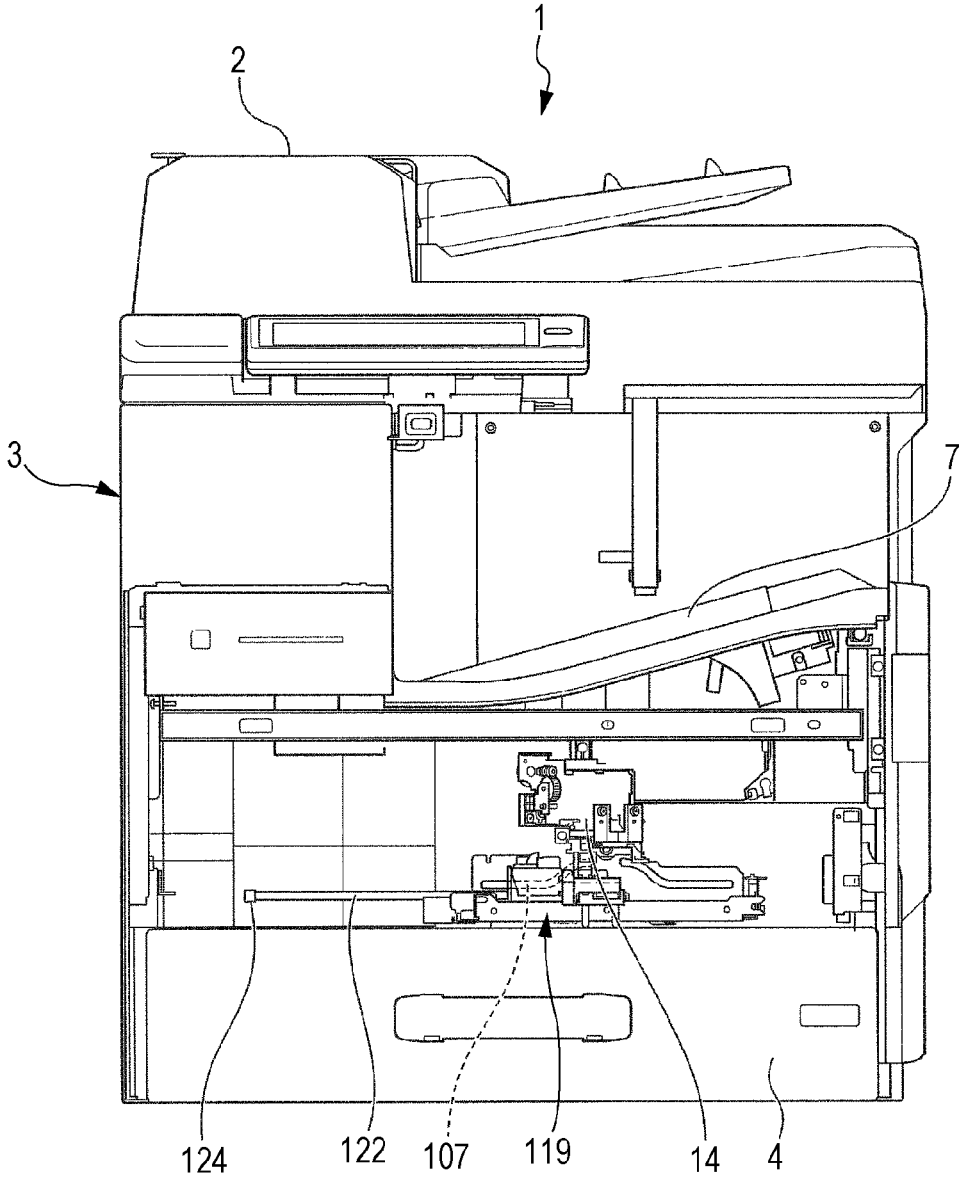
FIG. 43 is a front surface view which represents a portion which is cut away of the state in FIG. 42.

As represented in FIG. 43, the connecting section 124 on the leading end of the first tube 122 is positioned within the apparatus main body 3 in a state in which the connection with the relay flow path 130 of the first tube 122 is released. Thereby, even if liquid drips from the first tube 122, it is possible to retain the liquid within the apparatus main body 3.

Figure 44:
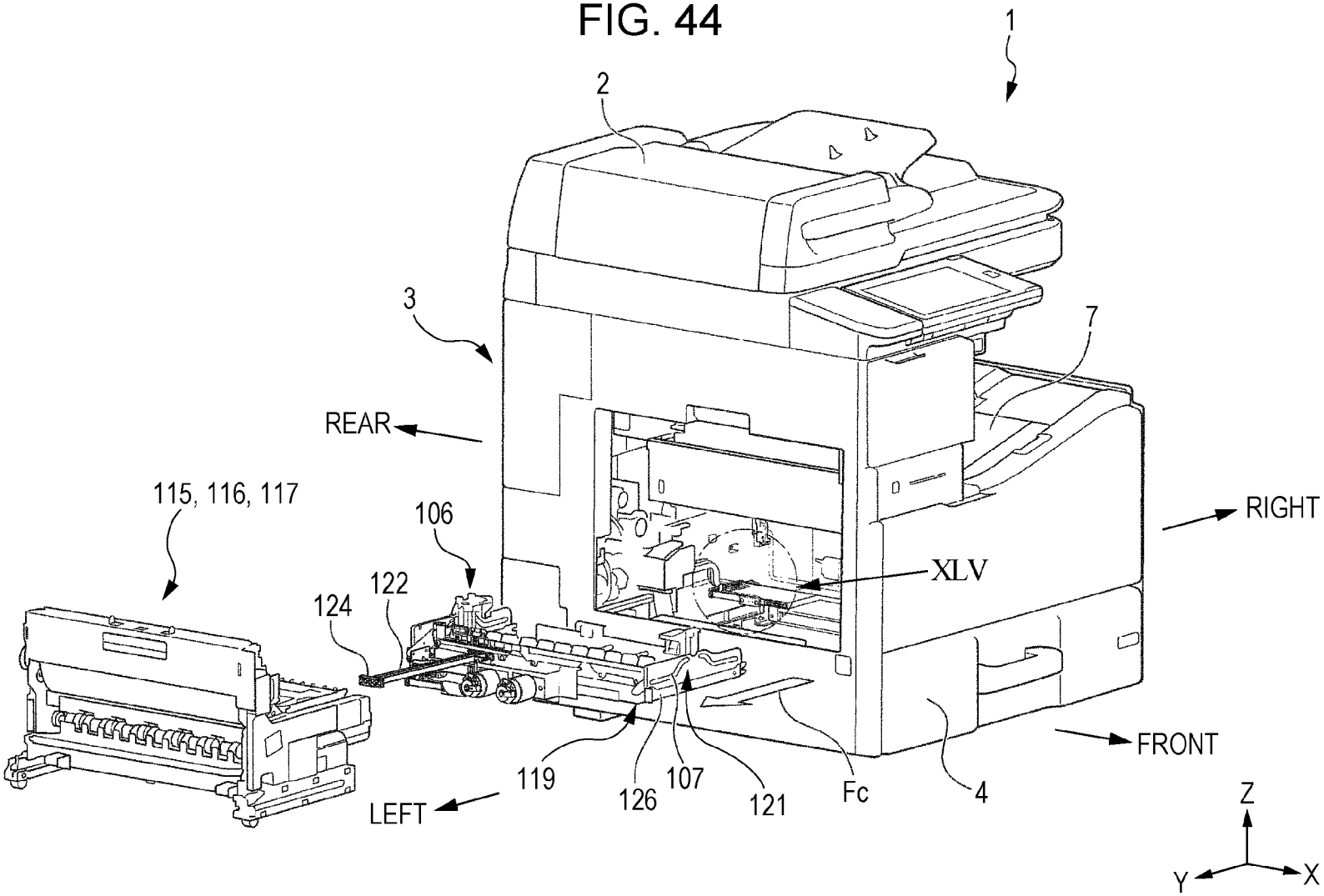
FIG. 44 is a perspective view which represents a state in which a cap unit is removed from the state in FIG. 42.

(4) Next, as represented in FIG. 44, the cap unit 119 is removed to the outside of the apparatus main body 3. The direction of the removal is the same as the direction Fc in which the attaching and detaching unit 115 (discharge unit 117) is removed from the apparatus main body 3. Thereby, the state comes to be in the state of FIG. 44.

Here, in the embodiment, the cap unit 119 is pulled out to be guided on a rail (not shown in the drawings) on the apparatus main body 3 side.

(E-1-2) Effects

According to the embodiment, the cap member 106 is provided to be removable in the direction Fc which is the same as the attaching and detaching unit 115 (discharge unit 117) in the state in which the attaching and detaching unit 115 (discharge unit 117) of the configuration is removed. That is, a space which is generated by the attaching and detaching unit 115 (discharge unit 117) being removed is a removal space for removing the cap member 106, and is configured such that the cap member 106 is removable in the same direction as the attaching and detaching unit 115 using the space. In this manner, since the cap member 106 is able to be removed in the direction Fc which is the same as the attaching and detaching unit 115 using the space which is generated by removing the attaching and detaching unit 115, it is possible to execute maintenance such as repair or exchange of the cap member 106 with good workability.

In addition, when the cap member 106 is removed, since the transport path 69 which is positioned in front of the cap member 106 becomes the attaching and detaching unit 115, the attaching and detaching unit 115 may only be integrally removed, and since removal of each part is not necessary, workability is good.

According to the embodiment, the space that is generated by removing the discharge unit 117 which is often originally configured by an attachable and detachable structure is used as a removal space for removing the cap member 106. Accordingly, since the cap member 106 is removable, the configuring member in front of the cap member 106 purposely reduces the need to change the attachable and detachable structure in order for removal of the cap member 106 to be possible, and there is no waste in the design and manufacture.

According to the embodiment, since the cap member 106 is removed as the entire cap unit 119, it is possible to easily perform repair or exchange of the entire cap unit 119 along with the workability of the repair or exchange of the cap member 106 being good.

In addition, according to the embodiment, the first tube 122 which is connected in order to cause the negative pressure to act on the cap member 106 is able to release the connection in the same direction as the direction Fc in which the cap member 106 is removed. Accordingly, during the maintenance such as repair or exchange of the cap member 106, it is possible to execute a connection release process of the damaged first tube 122 with good workability.

In addition, according to the embodiment, the cap member 106 is configured so as to be connected to the pump (suction section) 110 by the first tube 122, the relay flow path 130, and the second tube 123. Accordingly, when the cap member 106 is removed, the length of the first tube 122 which is necessary for releasing the connection is able to be shorter by portion of the relay flow path 130 and the second tube 123, and similarly, the workability of the removal is good.

(E-2) Embodiment 2 (FIGS. 41 and 45)

Based on FIGS. 41 and 45, Embodiment 2 of the process with respect to the problem of removing the cap member from the installation location with respect to the line head will be described.

As represented in FIGS. 41 and 45, in the printer 1 of the embodiment, the second tube 123 is provided on the outside of the movement path when the cap member 106 is removed. That is, the range which the movement path occupies is determined by a region which occupies a direction (X direction) which intersects with the direction Fc of the removal of the cap unit 119 that includes the cap member 106, but the second tube 123 is configured so as to be positioned outside of the range.

Thereby, since the cap member 106, or alternatively, the cap unit 119 is removed without changing the connection state of the second tube 123, workability is good.

In addition, the pump 110 which is the suction section is attachable and detachable with respect to the printer 1, and the second tube 123 is configured so as to be able to release the connection of the pump 110 in the removal direction. In the embodiment, the rear surface cover 49 is open, and is configured such that the pump 110 is removed from the rear of the apparatus main body 3.

Thereby, the second tube 123 is able to release the connection in the removal direction of the pump 110 (Y direction which is to the rear of the apparatus).

Accordingly, during removal in order to repair or exchange the pump 110, since it is possible to release the connection to gain access to the second tube 123 from the removal direction (to the rear of the apparatus) of the pump 110, the workability is good.

Figure 46:
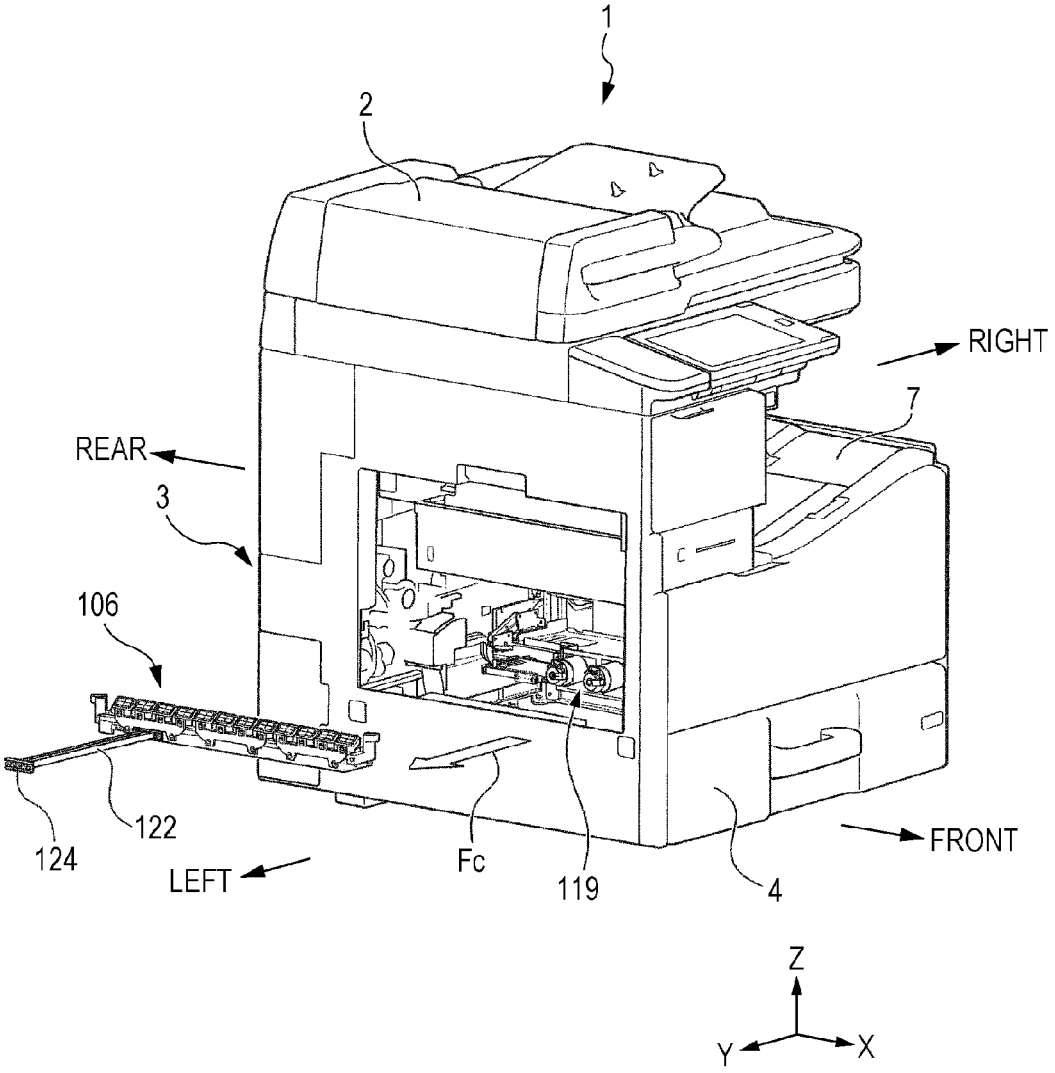
FIG. 46 is a perspective view which represents a state in which a cap member is removed from the state in FIG. 42.

(E-3) Embodiment 3 (FIG. 46)

Based on FIG. 46, Embodiment 3 of the process with respect to the problem of removing the cap member from the installation location with respect to the line head will be described.

As represented in FIG. 46, in the printer 1 of the embodiment, the cap member 106 is movable between the sealing position 113 (FIG. 37B) and the retreat position 114 (FIG. 37A) with respect to the line head 14 by the movement mechanism 121. When the cap member 106 is removed from the printer 1, the movement mechanism 121 is able to move the cap member 106 to the retreat position 114.

In the embodiment, the control section (electronic mounting member 83) is provided which controls the movement operation between the sealing position 113 and the retreat position 114 of the cap member 106, and when the cap member 106 is removed from the printer 1, the control section (electronic mounting member 83) receives the signal to configure so as to automatically move the cap member 106 to the retreat position 114. Here, the movement structure is not limited to being automatic.

Then, the cap member 106 is configured so as to be able to be removed in the direction Fc from the retreat position 114 on the cap unit 119. The cap unit 119 is not removed, and remains within the apparatus main body 3.

Thereby, it is possible to use the retreat position 114 of the cap member 106 as the removal position for removing the cap member 106, and there is no waste in the design and manufacture.

(E-4) Other Configurations (1) As represented in FIG. 35, the cap member 106 is provided such that removal from the installation position within the apparatus main body 3 is performed on the lower side of the transport path 69.

Thereby, since removal of the cap member 106 is performed on the lower side of the transport path 69, even if the liquid drips when the cap member 106 is removed from the printer 1, it is possible to reduce the risk of dripping on the transport path 69.

(2) The first tube 122 and the second tube 123 may be closed using a clamp or the like such that liquid does not drip in a state in which connection on one end is released.

(3) The first tube 122 may release the connection of the connection portion of the cap member 106.

(4) When the cap member 106 is removed in order to repair, exchange, or the like, the control section (electronic mounting member 83) which controls each operation may be provided with a cap movement sequence which automatically moves the cap member 106 to the attaching and detaching position (retreat position 114 and the like).

(5) When the cap unit 119 is removed from the apparatus main body 3 in FIG. 44, a movement rail may have a structure so as to serve as a rail for removing the attaching and detaching unit 115 (discharge unit 117).

(6) As represented in FIG. 35 and the like, the medium accommodating cassette 4 is disposed below the attachment/detachment path of the cap member 106, but a shielding member may be provided between the attachment/detachment path of the cap member 106 and the medium accommodating cassette 4. Due to the shielding member, it is possible to reduce the risk of the dripped liquid directly dripping on the medium accommodating cassette 4 during attachment and detachment of the cap member.

(7) As described in each of the embodiments of (A) to (E), in the printer 1, since the line head 14 is configured such that the cover (discharge tray 7) is opened from above the apparatus main body 3 to be pulled out upward, the cap member 106 which seals the nozzles N which come into contact with the nozzle forming surface 81 of the line head 14 is configured so as to be pulled out from the inner surface of the apparatus main body 3 to the outside, and a suction section 97 and the second tube with respect to the wiping member 82 and the cap member 106 are configured so as to be pulled out from the rear surface of the apparatus main body 3, it is possible to effectively perform maintenance.

The entire disclosure of Japanese Patent Application No. 2015-057153, filed Mar. 20, 2015 is expressly incorporated by reference herein.

What is claimed is:

1. A liquid ejecting apparatus comprising:

a head which ejects a liquid from a plurality of nozzles with respect to a medium;

a wiping member which is able to wipe a nozzle forming surface on which the nozzles are formed, and the wiping member is attachable and detachable with respect to the liquid ejecting apparatus along an attachment/detachment path when the wiping member is attached and detached;

an electronic mounting member which governs an electronic control; and a cover which is openable and closeable, and forms a casing of a main body of the liquid ejecting apparatus, wherein the attachment/detachment path intersects with a direction in which the medium is transported, and wherein the electronic mounting member is attached to an inner surface of the cover, wherein when the cover is closed, at least a part of the electronic mounting member is positioned below the attachment/detachment path, and when the cover is opened, the electronic mounting member is not positioned below the attachment/detachment path.

2. The liquid ejecting apparatus according to claim 1, wherein the head extends in a longitudinal direction which intersects with the direction in which the medium is transported, and wherein the wiping member is movable along the longitudinal direction and is removable from the longitudinal direction.

3. The liquid ejecting apparatus according to claim 2, further comprising:

an engagement member which is provided to an engaging position in one end of the moving direction, and is able to engage to the wiping member.

4. The liquid ejecting apparatus according to claim 3, wherein the wiping member is movable to an attaching and detaching position different from the engaging position when removed from the liquid ejecting apparatus.

5. The liquid ejecting apparatus according to claim 4, further comprising:

a liquid reservoir section which retains the liquid accumulated by wiping using the wiping member, wherein the engagement member has a connection section which is able to connect to the liquid reservoir section, and wherein the liquid in the liquid reservoir section is discharged through the connection section when the liquid reservoir section is connected to the connection section.

6. The liquid ejecting apparatus according to claim 2, wherein the cover is configured to cover at least one side of the longitudinal direction and is openable and closeable horizontally.

7. The liquid ejecting apparatus according to claim 1, further comprising:

a cleaning section which cleans the wiping member, wherein the cleaning section is attachable and detachable in the same direction as the wiping member.

8. A liquid ejecting apparatus comprising:

a head which ejects a liquid from a plurality of nozzles with respect to a medium transported in a transport direction;

a wiping member that is able to wipe a nozzle forming surface on which the nozzles are formed; and an electronic mounting member that governs an electronic control, wherein the wiping member is attachable and detachable with respect to the liquid ejecting apparatus on an attachment/detachment path that lies along a direction which intersects the transport direction and a vertical direction, and the electronic mounting member is disposed at a location which is different from below the attachment/detachment path when the wiping member is attached and detached.

9. The liquid ejecting apparatus according to claim 8, further comprising:

a support member which supports the wiping member and moves the wiping member along the nozzle forming surface, and the wiping member is attachable and detachable with respect to the support member.

* * * * *